United States Patent [19]

Botte et al.

[11] 4,201,464

[45] May 6, 1980

[54] COPY PRODUCTION MACHINES HAVING JOB SEPARATION CAPABILITIES

[75] Inventors: Anthony J. Botte; James H. Hubbard, both of Boulder; Paul R. Spivey, Longmont, all of Colo.

[73] Assignee: International Business Machines Corporation, Armonk, N.Y.

[21] Appl. No.: 841,623

[22] Filed: Oct. 13, 1977

[51] Int. Cl.[2] ..... G03G 15/00

[52] U.S. Cl. ..... 355/14 R; 93/93 D; 271/4; 355/23; 355/77

[58] Field of Search ..... 355/14, 23, 24, 26, 355/77; 271/4; 93/93 D

[56] References Cited

U.S. PATENT DOCUMENTS

| | | | |
|---|---|---|---|
| Re. 27,976 | 4/1974 | Sahley | 355/64 |
| 3,830,590 | 8/1974 | Harris et al. | 355/14 |
| 4,123,155 | 10/1978 | Hubert | 355/26 |

*Primary Examiner*—R. L. Moses

*Attorney, Agent, or Firm*—H. F. Somermeyer; C. M. Wright

[57] ABSTRACT

Copy production machine selectively interleaves copy separation sheets between successive copy jobs, subjobs, or job portions. The copy separation sheets can be from the same copy sheet supply source or from an alternate source. The supplied copy separation sheets need not be operated upon by the copy production machines, i.e., receive an image. Such sheets may be preimaged if so desired. When copy sheet supply means has different size copy sheets, the separation mode may be inhibited. The number of separation sheets supplied depends on the number of copy receiving bins in an output means and the number of copies produced from a single image. The effective capacity of a collator is extended by the use of separation sheets.

66 Claims, 29 Drawing Figures

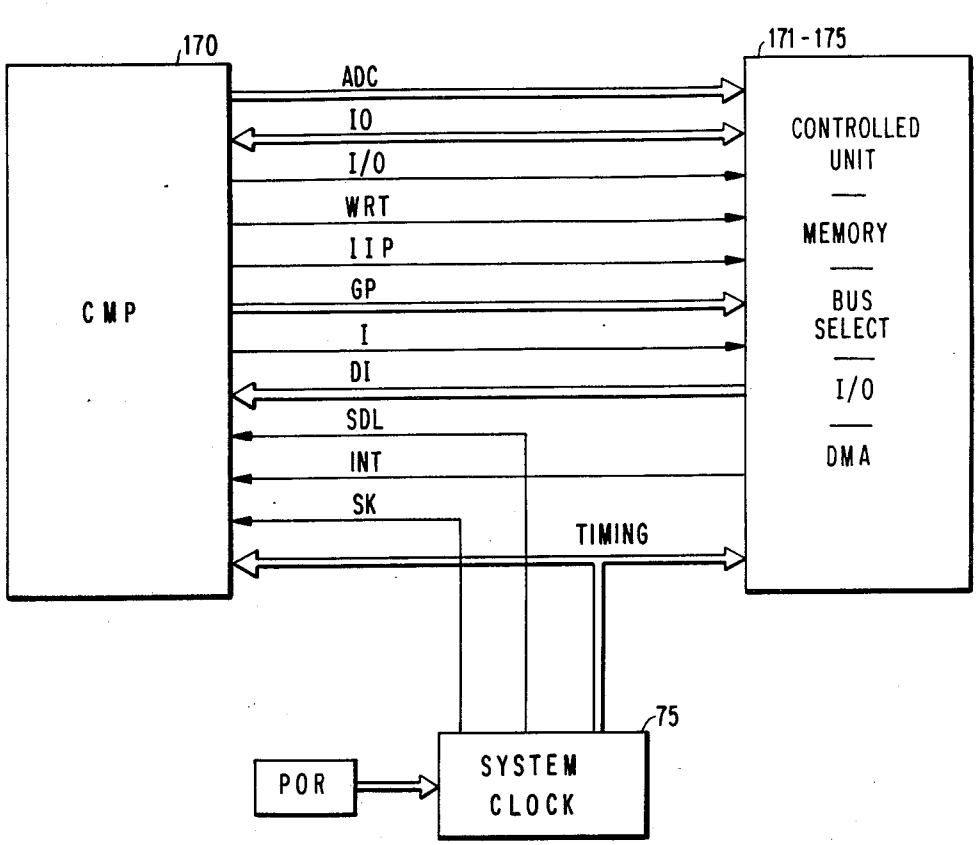
FIG. 5
FIG. 4
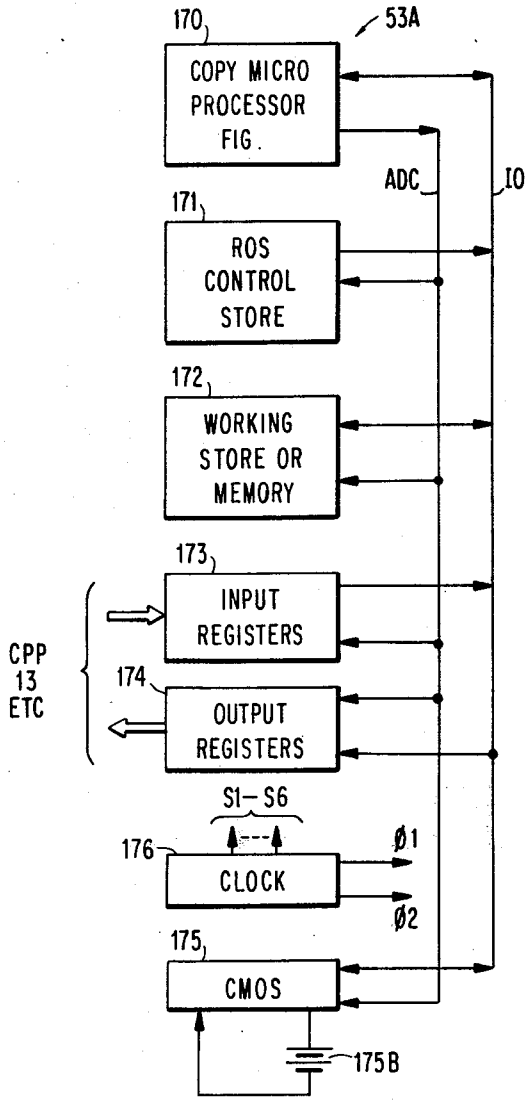

| INSTR | SEQ 1 CL | SEQ 1 ALU | SEQ 2 CL | SEQ 2 ALU | SEQ 3 CL | SEQ 3 ALU | SEQ 4 CL | SEQ 4 ALU | SEQ 5 CL | SEQ 5 ALU | SEQ 6 CL | SEQ 6 ALU |
|---|---|---|---|---|---|---|---|---|---|---|---|---|
| AR SR LR | IBL | M | (TB⇒IB) IRH | M X | PCI | M NOTE 4 | (TERM) | NOTE 4 | | | | |
| LRE LRD | IBL | M | (TB⇒IB) IRH | M X | PCI | M NOTE 5 | WRT IRL | NOTE 5 | WRT IRH | TBNS (XX→DB) ACH + DO | (TERM) | TBNS |
| STR | PCI | M | (TB⇒IB) WRT IRH | X (X→DB) ACH→DO | WRT IRL | ACL→DO | (TERM) | TBNS | | | | |
| AI SI | PCI | M | PCI | M NOTE 1 | (TERM) | NOTE 5 | | | | | | |
| CI GPI [LI XI OI NI] | PCI | M | PCI | M ACL x TB → DO → [ACL] | (TERM) | X | | | | | | |
| CB [AB SB LB XB OB NB] | PCI | M | TB | M (ACL→DO) | (TB⇒IB) PCI | X | (TERM) | ACL ± TB → DO → [ACL] | | | | |
| STB | PCI | M | WRT TB | ACL→DO | (TB⇒IB) PCI | X | (TERM) | X | | | | |
| A1 S1 SHL SHR | PCNI | M | (TB⇒IB) PCI | M NOTE 2 | (TERM) | NOTE 2 | | | | | | |
| TRA | PCI | M | (TERM) | NOTE 3 | | | | | | | | |
| CLA / [IC] | PCI | M CL AC / SET IC | (TERM) | X / COT* → EQ | | | | | | | | |
| TBP [TBR] | PCI | M | (TERM) | ACL M → DO → [ALL] | | | | | | | | |
| POR (IJD) | | | | | | | IB→"CLA" POR CODE | X RST LOGIC 32→DO | | | | |

INSTRUCTION PREVIOUS

TIME Ø2 220 Ø1 Ø2 Ø1 Ø2 Ø1 Ø2 Ø1 Ø2 Ø1 Ø2 Ø1 Ø2

NOTE 1: ACL ± TB ; + DB → ACH ; ACH → DO → ACL
NOTE 2: ACL MODIF → DB → ACH ; ACH → DO → ACL
NOTE 3: ACL → DB → ACH ; ACH → DO → ACL
NOTE 4: ACL ± TB → DB → ACH ; ACH → DO → ACL
NOTE 5: ACL + Δ → BB → ACH ; ACH → DO → ACL

FIG. 7

| INSTR | SEQ 1 CL | SEQ 1 ALU | SEQ 2 CL | SEQ 2 ALU | SEQ 3 CL | SEQ 3 ALU | SEQ 4 CL | SEQ 4 ALU | SEQ 5 CL | SEQ 5 ALU | SEQ 6 CL | SEQ 6 ALU |
|---|---|---|---|---|---|---|---|---|---|---|---|---|
| BAL | PCI | PREVIOUS INSTRUCTION | IB SET PCI | (ACH→DO) ACL→DB | NOTE 7 | PCL→DO | WRT IRH | PCH-1 + CR →DO | NOTE 9 | NOTE 10 | (TERM) | SET TRA |
| RTN | IBL | | IRH | NOTE 5 | IRL+8 | (ACH→DO) ACL→DB | NOTE 8 | NOTE 10 | PCI | NOTE 11 | (TERM) | (ACL→DO) |
| BØØ | PCNI | | NOTE 3 | PCH-1 → AOH | PCI | X | (TERM) | X | | | | |
| $\overline{\text{BØØ}}$ | PCI | | PCI | X | (TERM) | X | | | | | | |
| IJO | PCNI | | NOTE 4 | PCH-1 → ACH | PCI | X | (TERM) | X | | | | |
| $\overline{\text{IJO}}$ | PCI | | (TERM) | X | | | | | | | | |
| BLI | IBL | | (TB⟹IB) IRH | NOTE 5 | PCI | (ACH→DO) ACL→DB | ACL→AOH TB→AOL | NOTE 10 | (TERM) | ITAL | | |
| BSI | IBL | | (TB⟹IB) IRH | NOTE 5 | PCI | (ACH→DO) ACL→DB | WRT ACL→AOH TB→AOL | NOTE 10 | (TERM) | TBNS | | |
| IN | PCI | | OUT 1st IO WRT TB | NOTE 6 | OUT 2nd IO WRT TB | ACL→DO | (TB⟹IB) PCI | X | (TERM) | IOD AC7*→EQ | | |
| OUT | PCI | | OUT 1st IO WRT TB | NOTE 6 | OUT 2nd IO WRT TB | ACL→DO | (TB⟹IB) PCI | X | (TERM) | IOD AC7*→EQ | | |
| INTERUPT 1-5 | NOTE 1 | | STR ACH WRT 4H | NOTE 5 | STR LOW AC WRT 4L | ACL→DB ACH→DO | STR OLD STAT WRT 8L | TBNS STAT →DO→ACL | HI ADD READ 12 H | TBNS PCL→DO →ACL | (TERM) | |
| INTERUPT 6-10 | NOTE 2 | ACL-1→DO | STR PCH WRT OH | PCH-1 + CR →DO | NEW STAT 8H | X | NOTE 9 | NOTE 10 | PCI | UPDATE STAT | (TERM) | |
| | 220 | Ø1 | Ø2 | Ø1 | Ø2 | Ø1 | Ø2 | Ø1 | Ø2 | Ø1 | Ø2 | Ø1 Ø2 |

NOTE 1: LOW ADDRESS READ 12 L
NOTE 2: STR PCL WRT OL
NOTE 3: CAL HIGH BITS; TB→AOL
NOTE 4: CAL HIGH BITS; IB→AOL
NOTE 5: ACL→DB→ACH; ACH→DO→ACL
NOTE 6: TB (MODIFIED)→DO
NOTE 7: SET IB TO "TRAP"; WRITE IRL
NOTE 8: UPDATE PC; ACL→ACH; TB→ACL
NOTE 9: UPDATE PC; ACL→AOH; TB→AOL
NOTE 10: ACL→AOH; DB→ACH; ACH→DO→ACL
NOTE 11: (ACL→DO) STAT UPDATE IF REGO GRPO

FIG. 8

| | GROUP | MEMORY TYPE |
|---|---|---|
| ZONE 3 | 31 | DIAGNOSTIC SPACE |
| | 30 | REPLICATE I/O |
| | 29 | CMOS |
| | 28 | |
| | 27 | WORK REGISTERS |
| | 26 | |
| | 25 | |
| | 24 | |
| ZONE 2 | 23 | DIAGNOSTIC SPACE |
| | 22 | REPLICATE I/O |
| | 21 | CMOS |
| | 20 | |
| | 19 | WORK REGISTERS |
| | 18 | |
| | 17 | |
| | 16 | |
| ZONE 1 | 15 | DIAGNOSTIC SPACE |
| | 14 | REPLICATE I/O |
| | 13 | CMOS |
| | 12 | |
| | 11 | WORK REGISTERS |
| | 10 | |
| | 9 | |
| | 8 | |
| ZONE 0 | 7 | DIAGNOSTIC SPACE |
| | 6 | REPLICATE I/O |
| | 5 | CMOS |
| | 4 | |
| | 3 | WORK REGISTERS |
| | 2 | |
| | 1 | |
| | 0 | |

FIG. 19
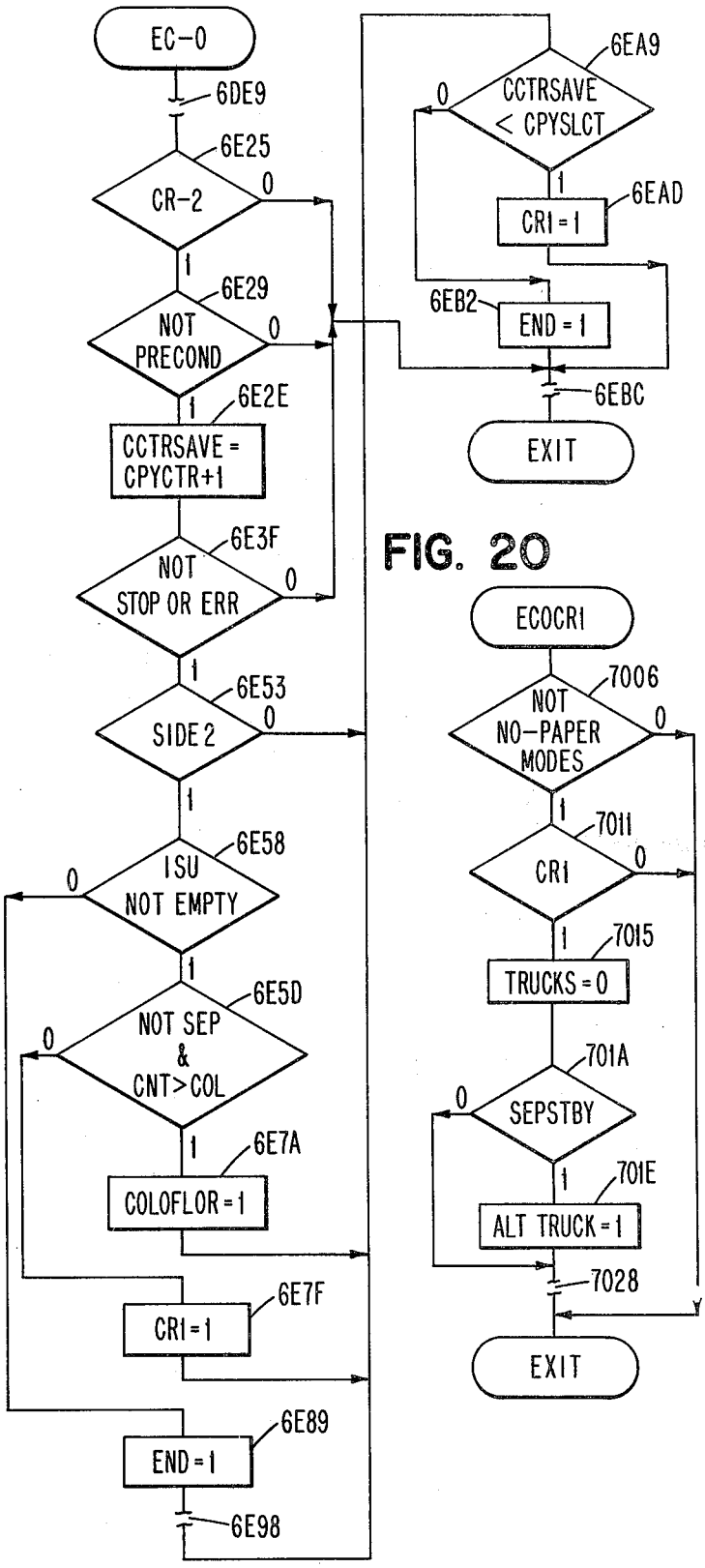
FIG. 20
FIG. 22
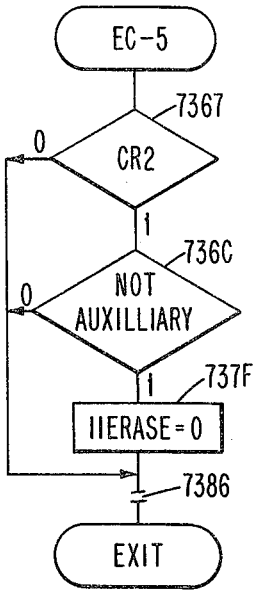
FIG. 23
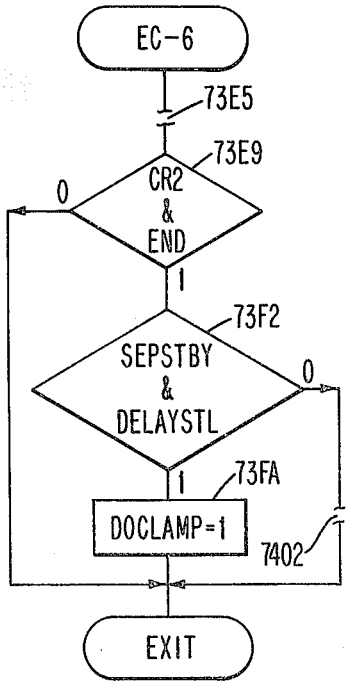

COPY PRODUCTION MACHINES HAVING JOB SEPARATION CAPABILITIES

DOCUMENT INCORPORATED BY REFERENCE

Commonly assigned, copending application Ser. No. 794,327, filed May 5, 1977, on a collator control, issued now as U.S. Pat. No. 4,114,871.

BACKGROUND OF THE INVENTION

The present invention relates to copy production machines, particularly of the convenience copier type, having the capability of producing a succession of copy jobs (which may be unrelated) in a succession of copy runs and of controlling a succession of such copy runs as a single copy job.

Transfer electrographic copy production machines as well as other copy production machines of diverse types, employ various forms of image transformation for putting an image on a sheet of copy paper. Usually an image in latent form is generated and transferred to a copy sheet. In some convenience copier types of copy production machines only one run of copies can be produced automatically, i.e., an original document containing a single image is placed on a document glass. Upon actuation of a start button or by suitable document sensing apparatus, the copy production machine is activated to produce a given number of copies in accordance with the operator-inserted number in a control panel on the copier. When the selected number of the copies have been produced, the copy production machine usually stops.

However, in some instances, a semiautomatic document feed (SADF) enables an operator to insert a succession of original documents in a semiautomatic mode onto the document glass. The copy production machine senses the presence of a waiting original document and automatically restarts to make a second run. A succession of related original documents can be conveniently termed a copy job, i.e., an operator wants to produce a given number of copies of a given number of original documents. Each copy job is characterized by one or more copy runs.

Some copy production machines have what is automatic recirculating document feed which produces collated sets without collating the produced copies, i.e., each collated set is made separately from the originals. In this case, a copy job includes a plurality of successive runs producing a plurality of sets of documents. As used herein, the term "set of documents" is referred to as a subjob to be separted by a separation sheet, for example. When an automatic document feed is used to feed the original documents to the copy production machine, a subjob is considered as a complete job for the copy production machine. The automatic document feed links a succession of such jobs into a complete copy job.

Some copy production machines usually have a plurality of copy paper sources, commonly referred to as the main supply and the auxiliary supply. Generally, the main supply has a capability of storing greater number of copy sheets than the auxiliary supply. By operator selection the copy production machine will select copy sheets from either of the copy sheet supplies. In some machines, a roll of paper provides a source of copy sheets, a plurality of rolls may be provided, or a combination of rolls and precut sheets of copy paper may be utilized as a plurality of sources of copy paper.

One feature of copy production machines is that collators for collating produced copies can be attached to such machines. Such collating apparatus is usually quite expensive. Accordingly, it is desired in order to control cost, to minimize the size of the attached collator. When the collator has reduced size, the copy producing capability of the copy production machine may be limited by the collator capacity. Also, it may be desired not to have a collator, which often occurs in a relatively small office where collating copies is a minor requirement.

For operator convenience, it is desirable to have the copy production machine produce as many copy jobs as possible without intervention by the operator, i.e., without requiring the operator to remove produced copies from the output portion of the copy production machine during a copy job.

SUMMARY OF THE INVENTION

It is an object of the invention to provide an enhanced separation mode for use in copy production machines.

It is another object to provide means for extending collator capacity by using automatic controls in connection with a separation mode.

A copy production machine constructed in accordance with the present invention includes means for indicating a standby or copy producing mode, means for indicating a desired end of run, and means responsive to the two indicators far initiating a separation mode run. A separation mode run is characterized by placing a single copy separation sheet in each copy receiving bin which receives a produced copy during either the immediately preceding copy run or the immediately following copy run. When a collator is employed, the number of bins in the collator for receiving separation sheets is selected in accordance with the number of copies selected for production by the operator.

When the copy production machine has a plurality of copy paper supply sources, it is preferred that the copy sheet taken be from one source and the copy separation sheet be taken from a second source. By proper selection, i.e., timing the copy paper for both the copies and the copy separation sheets may be selected from the same source.

In copy production machines having a plurality of copy paper sources, each source may have a different size copy paper. A control means monitors the selection of paper sizes. If predetermined paper size differences occur, the separation mode is inhibited.

Either one separation sheet may be provided between two successive jobs or a plurality of separation sheets may be provided. Fully automatic means can be utilized for programming the operation of the copy production machines in accordance with the invention.

Copy jobs requiring a greater capacity collator are performed by segmenting the job into segments related to the capacity of the collator. Then, by repeating the segments separated by a separation sheet, an entire collate copy production job is performed with a minimal operator inconvenience.

For efficient collation, a number of separator sheets equal to the number of sets to be collated in the next succeeding collating segments are supplied, one to each of predetermined bins. Subsequently, collated sets are directed to those predetermined bins on top of the separator sheets.

The foregoing and other objects, features and advantages of the invention will be apparent from the following more particular description of preferred embodiments of the invention, which are illustrated in the accompanying drawing.

BRIEF DESCRIPTION OF THE DRAWING

FIG. 4 is a block diagram of a control system employing a programmable processor usable in connection with the present invention.

FIG. 5 is a block diagram of the bus control connections for the processor control system illustrated in FIG. 4.

FIGS. 7 and 8 are charts showing instruction execution sequencing of the programmable processor.

FIG. 13 is a flow chart showing separation mode control procedures.

FIGS. 19 and 20 are flow charts showing actions at ECO time of a copy production machine relating to the separation mode.

FIGS. 21–23 are flow charts showing timed machine actions relating to the separation mode.

DETAILED DESCRIPTION

General

Figure 1:
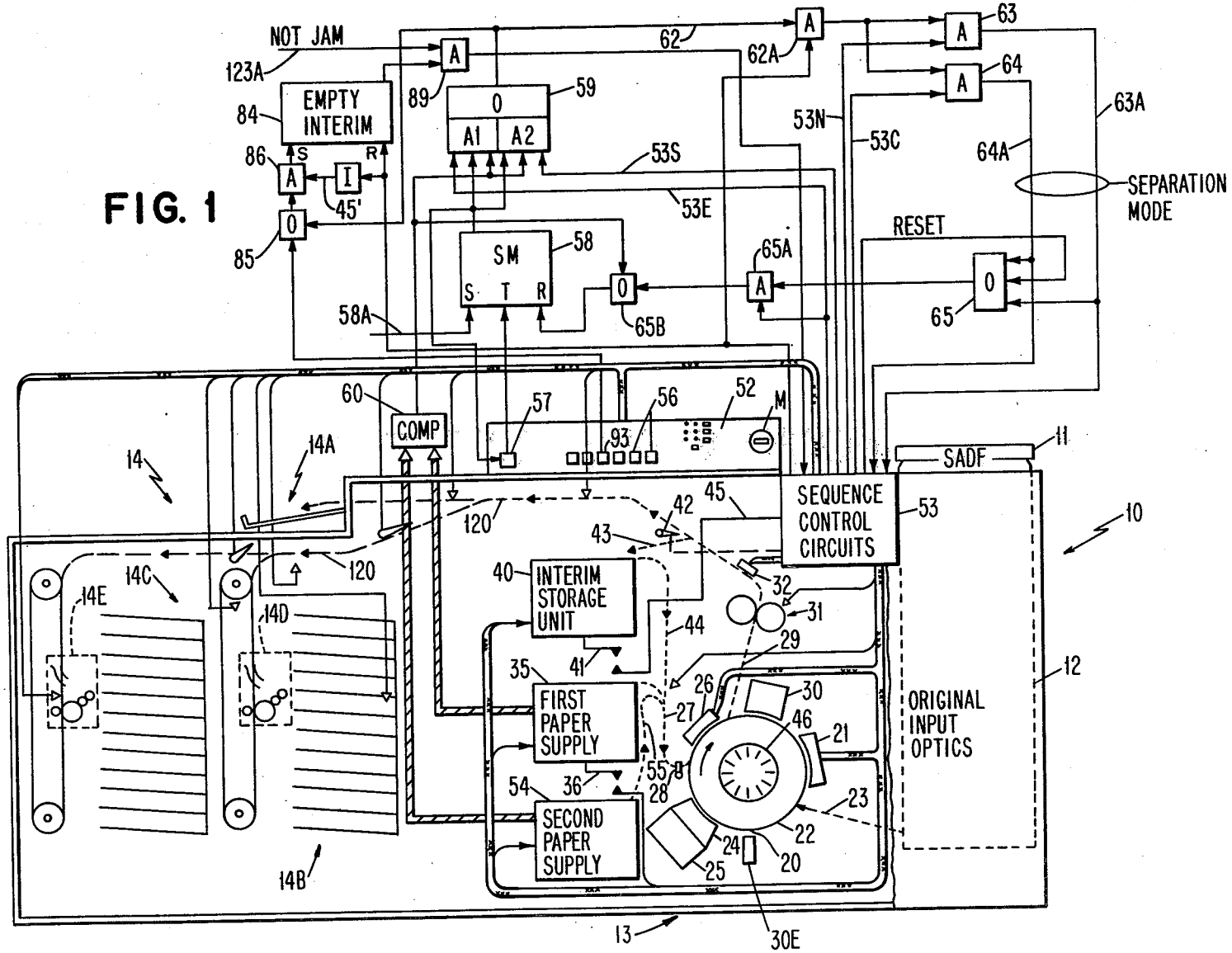
FIG. 1 is a block diagram of a copy production machine employing the present invention showing the logic of certain control circuits for implementing the invention.

In the drawings, like numerals indicate like parts and structural features in the various figures. A copy production machine 10 (FIG. 1) employing a first version of the present invention includes a semiautomatic document feed (SADF) 11 for feeding manually inserted original documents to be copied. The document glass (not shown) in SADF 11 is scanned by known optical scanners included in original input optics 12 to provide an illuminated image over path 23 to a later described copy production portion 13. Copy production portion 13 transfers the optical image from path 23 to copy paper, as will be later described, and supplies the produced copies to output portion 14 for pick up by an operator or for automatic transfer to other utilization apparatus (not shown). In a constructed version of the invention, output portion 14 includes a copy output tray 14A which receives all produced copies in a noncollate mode. When the copy production machine 10 is to be used in an environment requiring automatic collation, a collator 14B is included in output portion 14. When the number of copies to be collated becomes relatively large, a second collator 14C is connected to the first collator 14B in tandem for receiving copies to be collated.

In accordance with the present invention, control means are provided in the copy production machine 10 for automatically or semiautomatically selecting copy separation sheets from copy production portion 13 and inserting them between copies of successive jobs in output portion 14. This action includes selectively supplying copy separation sheets to copy exit tray 14A and to a selected number of copy receiving bins in collators 14B, 14C. In the latter case, if ten copies are being made of each image, then ten separation sheets are provided to collator 14B. Similarly, if 15 copies are being made, then 15 copy separation sheets are supplied. If it is desired to have a plurality of copy separation sheets between two successive copy jobs, then the copy production portion 13 is actuated to supply that plurality of copy separation sheets in the manner described for the single copy separation sheet per copy bin. Furthermore, if more copies are to be produced than there are collator bins, then sequence control circuits 53 keep a tally of copies produced for a given copy production job, as later detailed in the section "LOGICAL EXTENSION OF COLLATOR CAPACITY USING THE SEPARATION MODE."

The copy production machine 10 includes an operator's control panel 52 having a plurality of manually actuable switches for introducing copy production parameters to copy production portion 13. Such parameters are well known and are not detailed except for those parameters arbitrarily having an operative and direct relationship with a first constructed embodiment of the present invention.

Before proceeding further with the description of the invention, the operation of copy production portion (CPP) 13 is described as a constructed embodiment of a xerographic copy production machine 10. Photoconductor drum member 20 rotates in the direction of the arrow past a plurality of xerographic processing stations. The first station 21 imposes either a positive or negative electrostatic charge on the surface of photoconductor member 20. It is preferred that this charge be a uniform electrostatic charge over a uniform photoconductor surface. Such charging is done in the absence of light so that projected optical images, indicated by dash line arrow 23, alter the electrostatic charge on the photoconductor member in preparation for image developing and transferring. The projected optical image from original input optics 12 exposes the photoconductor surface in area 22. Light in the projected image electrically discharges the surface areas of photoconductor member 20 in proportion to the amount of lift. With minimal light reflected from the dark or printed areas of an original document, for example, there is no corresponding electrical discharge. As a result, an electrostatic charge remains in those areas of the photoconductive surface of member 20 corresponding to the dark or printed areas of an original document in SADF 11 (semiautomatic document feed). This charge pattern is termed a "latent" image on the photoconductor surface. Interimage erase lamp 30E discharges photoconductor member 20 outside defined image areas.

The next xerographic station is developer 24 which receives toner (ink) from toner supply 25 for being deposited and retained on the photoconductive surface still having an electrical charge. The developer station receives the toner with an electrostatic charge having a polarity opposite from that of the charged areas of the photoconductive surface. Therefore, the toner particles adhere electrostatically to the charged areas, but do not adhere to the discharged areas. Hence, the photoconductive surface, after leaving station 24, has a toned image corresponding to the dark and light areas of an original document in SADF 11.

Next, the latent image is transferred to copy paper (not shown) in transfer station 26. The paper is brought to the station 26 from an input paper path portion 27 via synchronizing input gate 28. In station 26, the copy paper (not shown) is brought into contact with the toned image on the photoconductive surface, resulting in a transfer of the toner to the copy paper. After the transfer, the sheet of image bearing copy paper is stripped from the photoconductive surface for transport along path 29. Next, the copy paper has the electrostatically carried image fused thereon in fusing station 31 for creating a permanent image on the copy paper. During such processing, the copy paper receives electrostatic charges which can have an adverse effect on copy handling. Therefore, the copy paper after fusing is electrically discharged at station 32 before transfer to output portion 14. After the image area on member 20 leaves transfer station 26, there is a certain amount of residual toner on the photoconductive surface. The cleaner station 30 has a rotating cleaning brush (not shown) to remove the residual toner to clean the image area in preparation for receiving the next image projected by original input optics 12. The cycle described is then repeated by charging the just-cleaned image area by charging station 21.

The production of simplex copies or the first side of duplexing copies by portion 13 includes transferring a blank sheet of paper from blank paper supply 35 to transfer station 26, fuser 31, and, when in the simplex mode, directly to the output copy portion 14. Blank paper supply 35 has an empty sensing switch 36 which inhibits operation of portion 13 in a known manner whenever supply 35 is out of paper.

When in the duplex mode, duplex diversion gate 42 is actuated by sequence control circuits 53 to the upward position for deflecting single image copies over path 43 to the interim storage unit 40. Here, the partially produced duplex copies (image on one side only) are stored until the next subsequent single image copy producing run in which the copies receive the second image. Copies stored in interim storage unit 40 are in an intermediate copy production state. Instead of using gate 42, the paper path portion at 42 can be moved for directing sheets to interim storage unit 40.

In the next successive single image run, intiated by inserting a document into SADF 11, the copies are removed one at a time from the interim storage unit 40 and transported over path 44 to input path 27 for receiving a second image in a manner as previously described. The two-image duplex copies are then transferred into output copy portion 14. Switch 41 of interim storage unit 40 detects whether there are any copies or paper in interim storage unit 40. If so, an intermediate copy production state signal is supplied over line 45 sequence control circuits 53, to be described later.

The copy production machine 10 control panel 52 includes a plurality of lights and switches (most not shown) is connected to sequence control circuits 53 which operate the entire copy production machine 10 synchronously with respect to the movement of the photoconductor member 20. Billing meter M counts images processed for billing purposes. For example, paper release gate 28 is actuated synchronously with the image areas moving past developer station 24. Such controls are well known in the art and are not detailed here for purposes of brevity.

CPP 13 also has second or alternate copy paper supply 54 which supplies copy paper to input path 27 via paper path 55. Selection of paper supply 35 or 54 as a copy paper source is controlled from panel 52 by actuation of switches 56 labelled FIRST or SECOND paper supply. Selection is mutually exclusive. Control circuits 53 respond to switches 56 to actuate paper pickers (not shown) in the respective copy paper supplies 35, 54 in a usual manner.

SEPARATION MODE BASIC OPERATIONS

FIG. 1 also includes circuits showing incorporation of a separation mode control in the illustrated copy production machine 10. Control panel 52 includes separation mode selection switch 57 which, when depressed, switches separation mode SM trigger 58 to the state opposite from its present state. Normally, SM 58 is in the reset state indicating no separation sheets are to be provided at the end or beginning of a copy producing run. In addition to switch 57, SM 58 may be set by computerized control (not shown) at its set input S via line 58A. When SM 58 is set to the separation mode state, it supplies an activating signal to AO circuit 59 for actuating CPP 13 to supply one or more copy separation sheets to output portion 14. The A1 input portion of AO 59 responds to SM 58 being set to the active condition, to a noncollate indicating signal received from sequence control circuits 53 over a line 53E indicating end of a copy run (last copy), and to a compare equal signal from compare circuit 60; it supplies a separation mode initiating signal over line 62 to AND circuits 63, 64. Therefore, the A1 input portion initiates a separation mode run at the end of a copy run. In a similar manner, and A2 input portion of AO 59 responds to a start or beginning of run signal received over line 53S from control circuits 53, to the SM 58 signal and the compare circuit 60 signal to supply a separation mode actuating signal over line 62. This latter A2 signal starts a separation mode at the beginning of a copy run.

AND circuit 63 supplies a noncollate, separation mode actuating signal to control circuits 53 over line 63A whenever AND circuit 63 is receiving a noncollate indicating signal over line 53N from control circuit 53 and 63 is responding to the line 62 signal to initiate the separation mode. Similarly, AND circuit 64 responds to a collate indicating signal received over line 53C from control circuits 53 and the line 62 signal to supply a collate type separation mode actuating signal over line 64A to control circuits 53. OR circuit 65 combines the separation mode actuating signals to reset SM 58 via AND circuit 65A at the end of each separation mode run, i.e., deselect separation mode. OR circuit 65B combines the above described reset signal with an inhibit signal described below. In this particular arrangement, the operator selects one separation sheet per actuation of separation mode switch 57. Furthermore, SM 58 is reset by signals from control circuits 53, e.g., by a time-out timer actuated when the copy production machine is in a standby mode, the stop button is depressed, reset button is depressed, or the like. The separation mode is indicated on panel 52 by a light within switch 57 and actuated by a separation mode indicating signal from SM 58.

The line 63A signal, indicating noncollate separation mode, actuates sequence control circuits 53 to cause CPP 13 to supply one copy separation sheet without image transfer to copy exit tray 14A. Upon completion of such transfer, copy production machine 10 is ready for the next copy producing run. Similarly, line 64A signals actuate sequence control circuits 53 to cause CPP 13 to provide a plurality of copy separation sheets to collators 14B, 14C in accordance with the number of copies selected to be produced, i.e., each bin in the collators 14B, 14C which received produced copies or which will receive produced copies from CPP 13 each receive one copy separation sheet per actuation of separation mode button 57.

When copy production machine 10 is producing copies with button 57 depressed, the machine 10 detects the last copy and a separation mode run is automatically invoked as above described. If, however, button 57 is not depressed until copy production machine 10 is in the standby mode (between successive copy producing runs), then upon starting a copy producing mode, CPP 13 will provide a copy separation sheet as above described before producing any copies from the original document.

In certain areas of the world, paper sizes vary so substantially that a paper transport path usually does not accommodate different sizes. In such situations, the separation mode is inhibited whenever the alternate or second paper supply 54 has such a different size but is permitted when the paper sizes are compatible.

Compare circuit 60 indicates to AO 59 whether or not the size of paper supplies 35 and 54 are compatible or have predetermined differences preventing paper path operation. Copy production machine 10 may be used in many nations which use these different size papers. Within reason, different sized copy paper can be used efficiently for copy separation sheets. For example, USA letter size 8.5×11.0 inches is similar to DIN A4 size paper such that they could be used interchangeably for copy separation sheets and copy producing sheets. Similarly, USA legal sizes 8.5×13.0 inches or 8.5×14.0 inches are similarly suited for interchange with copy producing and copy separation sheets. However, DIN size B4 has a much greater width than the letter, legal, and DIN A4 sizes; therefore, copy transport path characteristics are usually substantially different and copy separation sheets of B4 size would not be suitable for separating A4 size paper in most copy producing machines. Accordingly, if compare 60 senses A4 paper in supply 35 and B4 paper in supply 54, the separation mode is inhibited by a disable signal supplied to AO 59 by compare 60. The compare output also resets SM 58.

In a constructed embodiment, the copier separation sheets were transported from second supply 54 via paths 55, 27, 29 to output portion 14. In each such transfer, copy separation operations of CPP 13 were inhibited during such transfers as will be explained with respect to the description of the separation mode as incorporated in the copy production machine 10. In a duplex mode of operation, separation sheets are never directed to interim storage unit 40.

Figure 2:
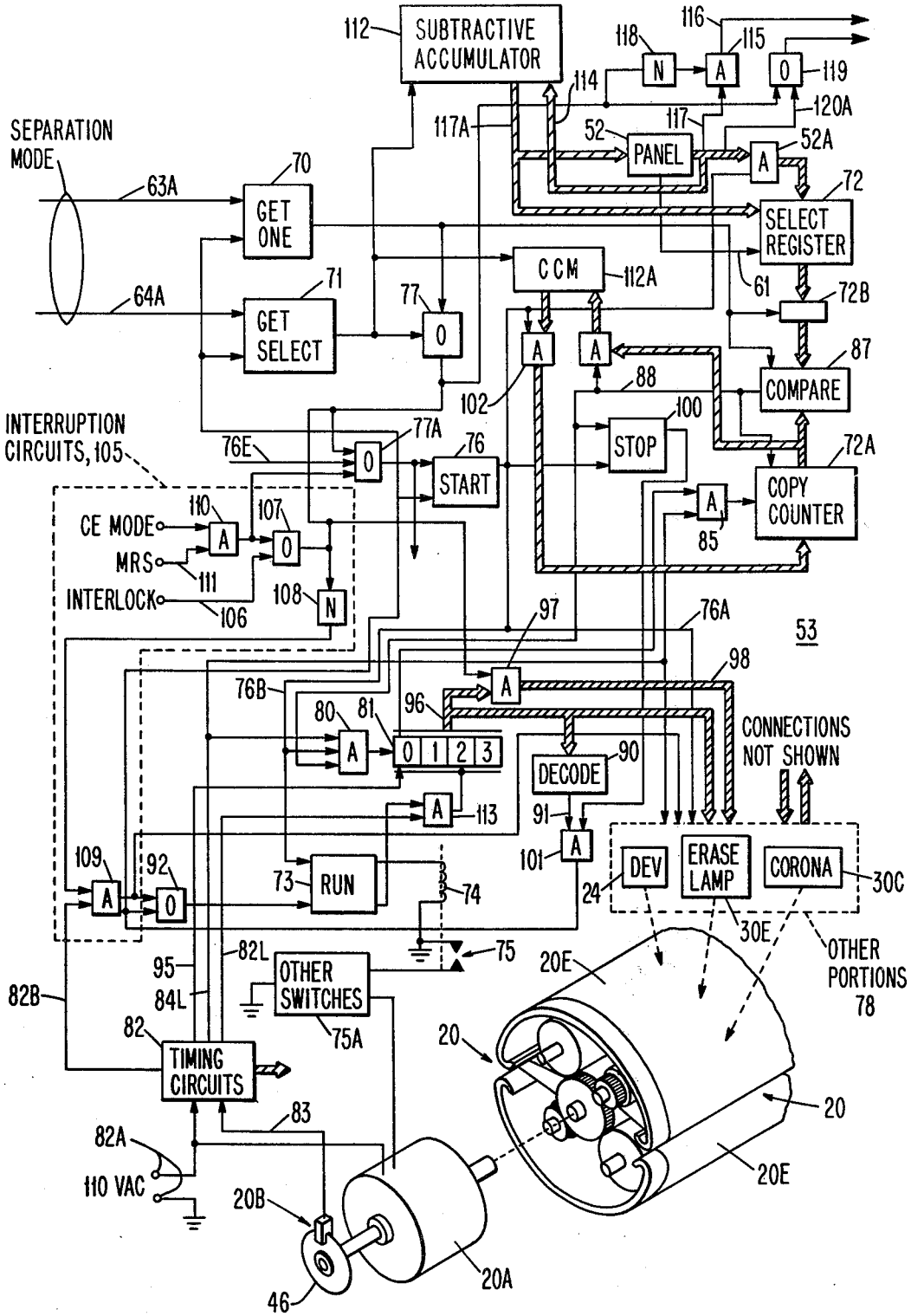
FIG. 2 is a logic diagram of control circuits and associated hardware for implementing the separation mode of the present invention in one embodiment.

Operation of a separation mode for copy production machine 10 is best understood from FIG. 2. The separation mode signals on lines 63A, 64A respectively set GET ONE latch 70 or GET SELECT latch 71. Latch 70 actuates copy production machine 10 to transfer one copy separation sheet from CPP 13 second paper supply 54 to output portion 14 and latch 71 actuates CPP 13 to supply the number of such copy separation sheets indicated by copy select register 72 to output portion 14. Latches 70, 71 start copy production machine 10 via its usual starting circuits, including start latch 76. OR circuit 77 passes the latch 70, 71 active signals to the set input of start latch 76. OR circuit 77A receives this signal plus other signals for activating start latch 76. Start latch 76, in addition to the functions performed in the illustrated figure, enables power to be applied to CPP 13 of the copy production machine 10. Repowering copy production machine 10 includes activating power relay 74 described as PR 1A U.S. patent 3,588,242 which is herein incorporated by reference. CPP 13 may be controlled as described in U.S. Pat. No. 3,588,242. For enabling repowering, an activating signal is supplied by start latch 76 over line 76A to other portions 78 of the document reproduction machine 10. Other portions 78 represent the xerographic processing stations 21, 24, 30, 30E and those 26 of FIG. 1 and associated with the photoconductor of copy drum 20, as described in U.S. Pat. No. 3,588,242. Other portions 78 may have interactions not described herein or in U.S. Pat. No. 3,588,242.

Figures 9, 10:
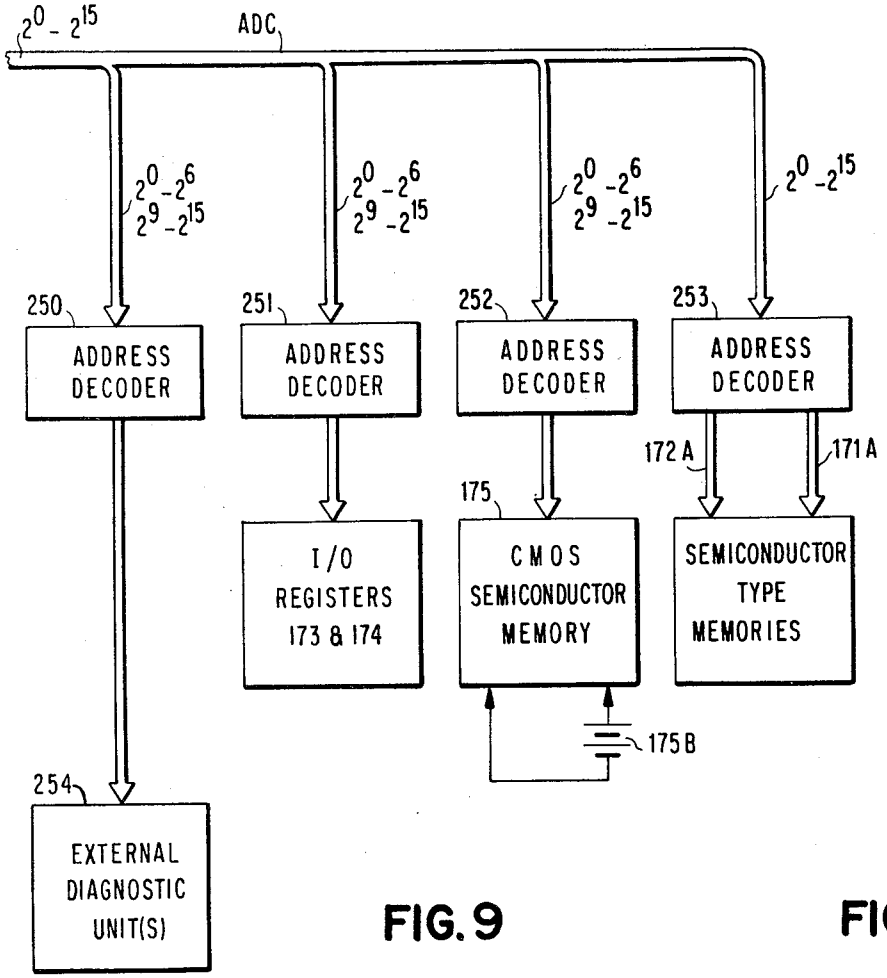
FIG. 9 is a block diagram of a memory addressing system for use with the illustrated processor control system.
FIG. 10 is a table showing register space assignments of the illustrated processor control system.

Start latch 76 also supplies an activating signal over line 76B for setting run latch 73 to the active condition. Run latch 73 in turn powers motor control relay 74 to close a pair of normally open contacts 75. These contacts 75 provide ground reference potential through other switches 75A, such as shown in FIG. 9 of U.S. Pat. No. 3,588,242, for energizing motor 20A to rotate copy drum 20 and to power other mechanical portions of the document reproduction machine 10. Other mechanical portions are included in the diagrammatic representation 78. Motor 20A of the present application corresponds to motor 12 of FIG. 9 of U.S. Pat. No. 3,588,242. Additionally, start latch 76 enables AND circuit 80 for passing copy cycle indicating signals (later described) for inserting indicating signals into shift register 81 for controlling the copy separation mode.

Timing circuits 82 provide synchronized and nonsynchronized timing signals for operating the document reproduction machine 10. These timing signals are provided to other portions as well as the illustrated circuits. The AC power supply, indicated by terminals 82A, actuates timing circuits 82 to generate a plurality of timing signals in synchronism with the power frequency. Terminals 82A also supply AC power to motor 20A. Additionally, timing signals synchronous with the reproduction process are derived from emitter wheel 20B having emitter wheel 46 on copy drum motor 20A. Emitter wheel 20B fiducial mark signals, i.e., representing image cycles of copy drum 20, are supplied over line 83 to timing circuits 82. As a result, timing circuits 82 generate a copy cycle initiating timing signal supplied over line 84L. In addition to synchronizing other portions 78 to the copy drum 20 rotation, the image cycle indicating signal passes through AND circuit 80 to insert binary ones synchronously into the low-order digit position of shift register 81. Each binary one in shift register 81 signifies a copy cycle of the document reproduction machine 10. The binary ones in register 81, as will be later explained, are used to terminate the copy separation mode. Additionally, the copy cycle indicating signals on line 84 travel through AND circuit 85 for incrementing copy counter 72A whenever the lowest digit position 0 of shift register 81 has a binary one. Copy counter 72A is an electronic equivalent of the relay copy counter 140 of U.S. Pat. No. 3,588,242. Accordingly, copy counter 72A signifies the number of copy cycles, or machine cycles, elapsed since start latch 76 was set to the active condition. To determine when the desired number of cycles (copies produced or copy separation sheets transferred) has been completed, compare circuit 87 receives signals from select register 72 and copy counter 72A for detecting equality.

Select register 72 is responsive to operator control panel 52 via AND circuits 52A to indicate the number of copies to be made of a given image, usually on an original document. When there is an equality, compare circuit 87 removes a noncompare active signal from line 88 thereby disabling AND circuit 80 and setting stop latch 100. This action inhibits a further introduction of binary ones in the low-order stage of shift register 81 and conditions the illustrated circuits to terminate the copy separation mode or a copy production run.

When a binary zero occurs in the low-order stage of shift register 81, AND circuit 85 is disabled thereby inhibiting further counting action of copy counter 72A. As will become apparent, the binary one in the low-order stage of shift register 81 is then shifted toward the most significant stage three. Eventually, the binary one is shifted out leaving the signal contents of shift register 81 equal to zero. When this occurs and the stop latch 100 has been set, the separation mode has been completed, i.e., all sheets have left CPP 13. Decode circuit 90 responds to an all-zeros condition of shift register 81 to supply a stop signal over line 91 via AND circuit 101 to reset run latch 73 via OR circuit 92 as well as resetting both separation mode latches 70, 71 and start latch 76. Stop latch 100 being set conditions AND circuit 101 to pass the line 91 stop signal. At this time, a new copy run can be initiated from panel 52 and normal operations of the document reproduction machine 10 can ensue.

The signal contents of shift register 81 are shifted to the right, as viewed in the figure, once each copy cycle of drum 20. In this regard, timing circuits 82 provide a time delayed image-indicating pulse over line 95 which follows the line 84 pulse. The line 95 signal shifts the signal contents of shift register 81 to the right once each copy cycle, i.e., once each half rotation of copy drum 20.

The signal contents of shift register 81 cooperate with other portions 78 for controlling the reproduction processes. In this regard, cable 96 carries signals from shift register 81 to other portions 78 for purposes beyond the scope of the present description. Additionally, other machine functions are selectively activated by the shift register 81 signals via AND circuits 97. AND circuits 97 respond to the separation mode signal from OR 77 to pass the control signals over cable 98 to other portions 78. These separation mode control signals disable certain reproduction processes during the separation mode to inhibit any image transfer to copy separation sheets. Those reproduction processes disabled during the separation mode include the panel 52 displays except for a standby indicating signal (not shown). Billing meter M is disabled such that the user will not be charged for operations during the separation mode. Also the edge erase lamps (not shown) are disabled, a document scanning lamp (not shown) is not illuminated, and interimage erase (not shown) is not timed (remains on at all times to erase the drum 20 photoconductor surfaces). The latter inhibited function prevents the erase lamp from turning off between image cycles during the copy separation mode. Certain apparatus in other portions 78 which respond to signals supplied by control circuit 53 over cable 96 are also inhibited during the separation mode.

During the copy separation mode, the copy production machine 10 may be subjected to interruptions of operation caused by someone opening a panel on the machine (not shown) or the machine being placed in a maintenance or CE mode. Despite such intended or unintended interruptions, the copy separation mode should be completed as originally contemplated. Accordingly, the illustrated circuits restart the machine in the copy separation mode after the above-described interruptions. The interruptions of the machine processing are processed by circuits 105. For example, if a panel (not shown) is opened on the machine 10, exposing high voltage to an operator, the high voltage must be shut down. An interlock signal on line 106 signifies that all panels and doors are properly closed. If any panel or door is opened, the line 106 interlock signal is removed. When active, the line 106 interlock signal passes through OR circuit 107 to inverter circuit 108 and to AND circuit 109. AND circuit 109 responds to the inverse of the OR circuit 107 signal to pass a power derived timing signal received over line 82B from timing circuits 82 to reset run latch 73 and also provides a turnoff procedure to other portions 78, such as removing high voltage, but maintaining low voltage such that machine state indications of the document reproduction machine can be maintained. In this regard, copy separation mode latches 70, 71 are not altered during such interruption.

A second source of interruption is the maintenance or CE mode. AND circuit 110 responds to a maintenance or CE (customer engineer) mode being selected and to a momentary run switch (MRS) (not shown) being depressed, as signified by the signal on line 111, to pass an active signal through OR circuits 77A and 107. If, during the maintenance mode, the MRS is opened, AND circuit 110 removes the enabling signal thereby activating AND circuit 109 to prevent operation of the document reproduction machine 10. Upon restoration of the enabling signal at AND circuit 110, start latch 76 is again set to the active condition. One of the copy separation latches 70, 71 was in the set condition, providing an AND circuit enabling signal via OR circuit 77. Start latch 76 being set again sets run latch 73 and all procedures of the copy separation mode are restored to the conditions immediately prior to interruption. Start latch 76 being set resets stop latch 100.

When run latch 73 is reset during an interruption, shift register 81 has to start again from the lowest order digit position zero. To this end, timing circuits 82 supply an AC power synchronous timing signal over line 82L to AND circuit 113, which is enabled by run latch 73 being reset. AND circuit 113 then resets all stages of shift register 81 to the zero condition.

Additionally, during a copy separation mode, it is desired that no signals from panel 52 travel through AND circuits 52A to select register 72. In this regard, the start latch 76 supplies an activating signal to a standby circuit (not shown) which supplies a display indicating standby for operator observation. It also supplies a disabling signal preventing AND circuits 52A from transferring any operator initiated signalling to select register 72. The stop signal is acknowledged by means not shown.

The above-described separation mode circuits operate in response to the GET SELECT latch 71 set to the active condition for initiating transfer of a number of copy separation sheets equal to the number of copies to be made in a next succeeding copy production run from paper supply 54 through the illustrated paper paths of FIG. 1 into output portion 14 for the collators 14B and 14C. Not shown but assumed is that the collate mode has been selected as indicated by the signal on line 53C. The collate control circuits are of usual design and are not described herein for purposes of brevity.

Accordingly, the copy separation sheets will be equal to the number of copies to be made in the next succeeding run in accordance with select register 72. It should be noted that SM 58 of FIG. 1 being set activates AND circuit 64 in response to the last copy signal supplied over line 53E. Similarly, if the start button (not shown) is depressed, the signal of line 53S establishes the separation mode in copy production machine 10 for transferring copy separation sheets to collators 14B, 14C. Accordingly, if SM 58 is triggered to the set state by closing switch 57 during a run, one copy separation sheet will be supplied to each bin of the collators 14B, 14C at the end of the run (termed a trailing separate run). Redepressing the switch 57 and then pushing the start button causes a second separation sheet to be transferred to the same number of bins, i.e., copy select register 72 has maintained the copy count selection.

For collating efficiency it is desired that the collators 14B, 14C collate in both directions. Such operations are described in said copending, commonly assigned application for patent, Ser. No. 794,327. An example is that the next succeeding collate run is to produce five sets. If the collator had previously had twenty sets collated, the automatic control still puts five separator sheets, preferably in the top five collator bins, no limitation thereto intended. Then the five succeeding sets are bidirectionally collated into the five top bins. After the five sets are collated, twenty separator sheets can be added. If such twenty additional separator sheets are not desired, then the original five separator sheets are a minimum number of separator sheets to achieve collator set separation.

When exit tray 14A is receiving copies in a noncollate mode only one copy separation sheet should be supplied to exit tray 14A for each depression of button 57 which coincides with either the end of a copy run or the beginning of a copy run. To this end, the GET ONE latch 70 of FIG. 2 disables AND circuits 72B preventing the signals from select register 72 from reaching compare circuits 87. Simultaneously, the GET ONE latch 70 signal goes to compare circuits 87 forcing a one copy selected signal. Accordingly, when copy counter 72A equals one, compare circuit 87 then emits a complete signal over line 88 for stopping the copy run as aforestated for a single copy run indicated by select register 72.

The selection of the source of paper from supply 35 or supply 54 (FIG. 1) is achieved from panel 52 as shown in FIG. 2. AND circuit 115 supplies an actuating signal over line 116 to paper supply 35 for supplying paper in response to a panel 52 selection supplied over line 117. When the separation mode is incorporated into the document production machine 10, the OR circuit 77 signal is inverted by inverter 118 to inhibit AND circuit 115 during the separation mode. Simultaneously, the OR circuit 77 signal is supplied through OR circuit 119 to activate second supply 54. Panel 52 also includes a switch (not shown) for supplying a second paper supply 54 selection signal over line 120A through OR circuit 119. Accordingly, when copies are produced on paper supplied from supply 35, copy separation sheets are supplied automatically from second supply 54. However, when copies are being produced from second supply 54, the separation sheets are also supplied from second supply 54. It can be easily envisioned that other combinations and controls can be effected for selected copy separation sheet sources while successfully practicing the present invention.

If the separation mode is selected, the CE mode depression of the MRS button as signified by the signal on line 111 of FIG. 2 will also activate the separation mode circuits. The line 53S (FIG. 1) signal is supplied from OR circuit 77A of FIG. 2 which sets start latch 76 to the active condition. An AND circuit (not shown) can be interleaved in line 53S which would be inhibited during the CE mode or upon a setting of latch 76 not initiated by the start button as received over line 76E. In the alternative, line 53S may receive signals only from line 76E. In a SADF 11 machine, the start signals on line 76E will be either from insertion of the document to be copied in SADF 11 or from actuation of a start button (not shown) on panel 52.

Prior to institution of a separation mode, copies stored in ISU 40 are automatically transported to the output portion 14 as completed copies. In this regard, the empty interim latch 84 is set to the active condition when a separation mode has been requested as indicated by AO59 over line 62 and copies are in the interim storage unit 40. Copies in unit 40 are indicated by switch 41 being closed which enables AND circuit 86 via line 45'. Additionally, empty interim latch 84 is set to the active condition when copies are in the interim storage unit 40 and selection switch 93 either selects or deselects the duplex mode. Such mode change is signaled through OR circuit 85 to AND circuit 86.

Figure 3:
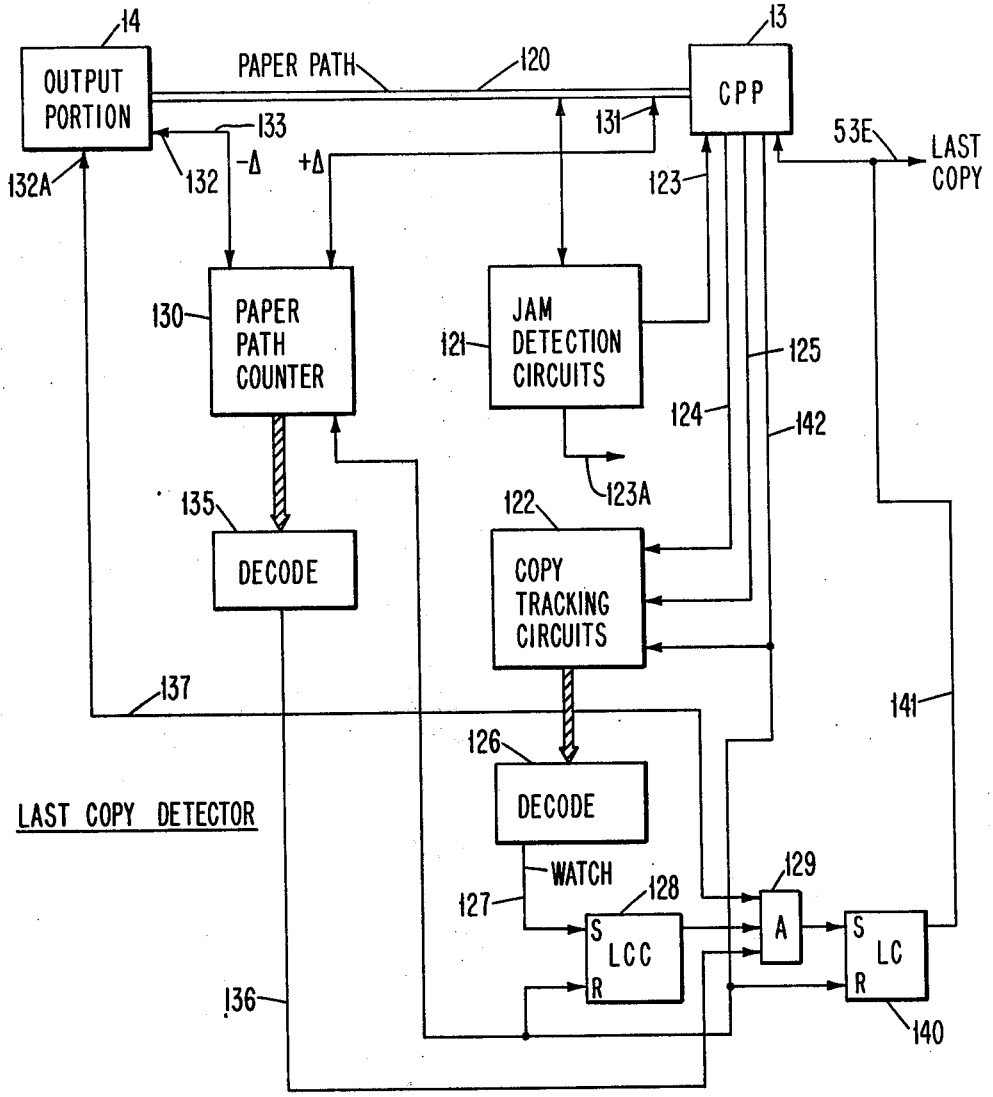
FIG. 3 is a block diagram of a last copy detector usable with the present invention for indicating a change between copy producing and standby machine modes.

When set to the active condition, empty interim latch 84 output active signal passes through AND circuit 89 during a "not-jam" condition as indicated by the circuits illustrated in FIG. 3 over iine 123A. From AND circuit 89, the empty interim signal goes to sequence control circuits 53 which then select the interim storage unit 40 as a source of copy sheets, control other portions 78, as described later with respect to FIG. 2, for preventing image transfer, and transfer copy sheets from interim storage unit 40 to output portion 14. Switch 41 opening, i.e., when interim storage unit 40 is empty, resets empty interim latch 84. This action removes the empty interim signal from AND circuit 89 which in turn removes the signal being supplied to sequence control circuits 53. At this time, sequence control circuits 53 initiate the separation mode. This condition is signaled by the same line from sequence control circuits 53 that actuates the line 45', which line goes to AND circuit 62A for passing the line 62 separation mode signals to the pair of AND circuits 63, 64, as previously described, for actuating the separation mode.

Separation mode trigger (SM) 58 is reset to the inactive condition by signals passing through OR circuit 65B. A first reset occurs when comparator 60 in a "B4" type machine signals that copy sheets in second paper supply 54 are incompatible with the copy sheets in first paper supply 35. This signal inhibits the separation mode. The second reset signal for SM 58 comes at the end of a separation mode run. AND circuit 65A responds to the output of OR circuit 65, as previously described, and an "end of run" indication from sequence control circuits 53 to supply the second reset signal.

The last copy signal on line 53E is generated by the circuits illustrated in FIG. 3. Detection of last copy is based on monitoring the copy sheet path 120. Path 120 is also monitored for jamming by jam detection circuits 121 in combination with the copy tracking circuits 122. Details and interconnections of these circuits are omitted for brevity. Jam detection circuits 121 normally indicate a nonjam condition on line 123 to CPP 13 permitting document reproduction machine 10 to operate. Upon detecting a jam, the signal on line 123 is changed by circuits 122 to stop machine 10 interrupting copy production, thereby inhibiting detection of a last copy. When stopped, all circuits remain static. In a preferred embodiment, copy tracking circuits 122 include a shift register which receives a copy cycle signal over line 125 from CPP 13. The line 124 copy cycle signal sets a stage of the shift register (not shown) in circuits 122 to the active condition. The active condition is then shifted by a shift signal received over line 125 from CPP 13. If copy tracking circuits 122 include an eight-stage shift register and five copies or copy separation sheets are being transported from CPP 13, then five stages will have the active condition with the five active conditions being shifted synchronously with the actual transport of the copies in copy separation sheets in paper path 120 toward the indicated exits in output portion 14. The active conditions of the shift register (not shown) of copy tracking circuits 122 signify a desired paper copy transport status within path 120. Near the end of a multiple copy run, only those stages of the shift register (not shown) in copy tracking circuit 122 at the terminal end of the shift register (not shown) will be in the active state. For example, in an eight-stage shift register, when the last two stages are in the active state and the preceding six stages are in the inactive state, decode circuit 126 supplies an active or watch signal over line 127 signifying that the last copy of a multiple copy run should be checked to ensure an early starting time of the next succeeding copy run (or a separation mode run). The line 127 signal sets last-copy detector condition (LCC) latch 128 to the active condition staring the watch signal for the remainder of the immediate copy run. Latch 128 being in the active condition partially enables the last-copy detector AND circuit 129.

The paper path monitor, comprising up/down counter 130, is incremented in the positive count direction by signals from paper path detecting switch 131. As the copies or copy separation sheets are transferred along paper path 120, exit switch 132 responds to trailing edges of exiting copies to supply a signal over line 133 for decrementing paper path counter 130. Accordingly, the count at any time within counter 130 signifies the number of copies being transferred at that instant through paper path 120. Decode circuit 135 responds to paper path counter 130 having a zero count, or any other reference count, to supply an active signal over line 136 signifying that paper path 120 is clear of copies. The line 136 active signal additionally provides an enabling signal to last-copy detector AND circuit 129.

The last copy or copy separation sheet is transferred along one of the paper path branches toward one of the exits 14A, 14B, 14C, each branch having a switch 132 and 132A. Since only one exit is used at a given time, any copy exiting will indicate the last copy has left the machine 10. To this end, the respective copy exit sensing switch 132A detects the trailing edge of the exiting copy. The trailing edge indicating output signals from switch 132A on line 137 actuates AND circuit 129 to the active condition. If the signals on line 136 and latch 128 are inactive, AND circuit 129 does not respond. When actuated, AND circuit 129 immediately sets last-copy latch 140 which, in turn, supplies the stored last-copy signal over line 141 or a "go" signal to CPP 13 and over line 53E to the separation circuit 59 of FIG. 1. In the collators 14B, 14C, a switch (not shown) in the sheet distributing carriages 14D, 14E signals last copy.

Job Segment Connections

Using the above-described separation mode in conjunction with the now to be described control circuits, greater facility for collating sets of copies are provided. For example, the number of copies to be produced as selected via panel 52 may exceed the collating capacity of output portion 14. Nevertheless, the total number of copies may still be selected and produced by segmenting the production job. On the first run of set production, a number of copy sets equal to collator capacity is produced. After the last sheet is produced of the last page of the first group of collated copy sets, the separation button 57 is actuated. Then, upon completing the last copy run, copy production machine 10 automatically provides a separation run as above described. If only five more additional sets are needed, then the number of separator sheets supplied by copy production machine 10 is five sheets, i.e., the number of copies to be produced in the next succeeding runs. Furthermore, the automatic control circuits provide for selecting the number of copies to be produced. This is achieved by a subtractive accumulator 112 in the circuits illustrated in FIG. 2. The panel 52 selections are supplied over cable 114 to the subtractive accumulator. In the collate mode, a collate signal supplied over line 61 from panel 52 to select register 72 limits the selection to the collating capacity of copy production machine 10. Accordingly, without operator intervention, copy production machine 10 produces the first forty copies of a forty-five copy set. Then, during the production of the last sheet of the first group of 40 collated copy sets, the operator actuates button 57 for selecting the separate mode. Since collate has been selected, the GET SELECT latch 71 is set. At the end of the last copy production run of the first group of collated sets, the GET SELECT latch 71 actuates copy counter memory CCM 112A to store the previous copy count of forty and also to indicate that latch 71 had been set to the active condition. Furthermore, subtractive accumulator 112 is actuated by the GET SELECT latch 71 to subtract forty from the initial selection of forty-five and to transmit a value of five over cable 117A to select register 72. Then the operator inserts the originals in SADF 11 to produce the last five copies as a second group of collated copy sets. The last five sets will be separated from the previous sets by separator sheets with a minimal number of separator sheets used. Furthermore, memory CCM 112A indicates the forty sets had been collated. AND circuits 102 respond to the start signal from latch 76 to display on a panel 52 the contents of CCM plus the count of counter 72A. In this way, the operator sees copies 41–45 being produced during the second group of collated sets. Alternatively, subtractive accumulator 112 may supply signals to panel 52 for indicating the number of sets yet to be produced.

In the above-described manner, all counting and figuring is automatically performed by the copy production machine adding to operator convenience. By limiting the number of separator sheets to the number of copies in a next succeeding run or runs, collator efficiency is enhanced. That is, if the number of copies produced in the preceding run were used to indicate the number of separator sheets, then twenty separator sheets will be used. This means the traveling vane in the collator would have to travel the entire height of each collator bin. On the other hand, if less than collator capacity is to be produced, for example, five, then only five bins will be traversed. On the next succeeding run, the traveling vane is already at the fifth bin. It then can start collating upwardly without having any wasted travel to the desired collating position. Furthermore, the number of separator sheets being keyed to the succeeding run will indicate to the operator the number of sets that will be produced in the next copy production run.

Copy production machine 10 may have several original document sources which can be automatically, semiautomatically, or manually processed for copy production. In the automatic and semiautomatic feed, the signal on line 141 (FIG. 3) activates the feeding mechanism (not shown) for moving the original to a copy-making position which then institutes the next succeeding copy reproduction run. CPP 13, in receiving the signal on line 141, begins its next run by preparing the detection circuit illustrated in FIG. 3 for detecting the end of that next run. In this regard, an active signal from CPP 13 travels over line 142 resetting counter 130, copy tracking circuits 122, and latches 128 and 140.

Copy tracking circuits 122 may include an up/down counter in a manner similar to paper path counter 130. It is preferred that the methodology of last copy detection, rather than being carried out by the illustrated circuits, be carried out by a microprogrammable processor as later described wherein the paper path counter 130 is a programmed up/down count field, copy tracking circuits 122 constitute a computer program, and the latches 128 and 140 are stages either in memory (local store) or special registers within a register group (not shown).

All of the above-described circuits show a relatively simple application of the present invention. The more productive and valuable aspects are best achieved in a copy production machine 10 by a programmable controller wherein all logic decisions are performed by a computer program rather than by hardware logic circuits. Before describing the programmable controller embodiment of the present invention, a processor control system usable as a programmable controller for sequence control circuits 53 is first described. It is understood that the above-described circuits are replaced by a computer program, as will become apparent.

Processor Control System

Sequence control circuits 53 preferably include a programmable computer control system as shown in FIG. 4. The programmable control 53A includes a programmable single chip microprocessor CMP 170 operating based upon a set of control programs contained in ROS control store 171 and uses working store or memory 172 as a main or working store. CMP 170 communicates with the other units of circuits 53A as well as CPP 13, SADF 11, output portion 14 and control panel 52, as later discussed, via the input registers 173 and output registers 174. In a preferred constructed embodiment, IO bus is eight bits wide (one character) plus parity. Address signals selecting which units are to send or receive signals with respect to CMP 170, as well as the other units, are provided by CMP 170 over sixteen-bit address bus ADF. A nonvolatile store CMOS 175 is a battery 175B powered semiconductor memory using CMOS construction. A clock 176 supplies later described timing signals to units 170–175.

In FIG. 5, the logical interconnections between microprocessor 170 and controlled units 171–175 are shown. All of the signals on the busses and individual control lines go to all units with the ADC signals selecting which controlled unit 171–175 is to respond for either receiving data signals or supplying data signals, respectively, over bus IO. Control line I/O indicates whether CMP 170 is supplying or receiving signals in bus IO. When the I/O line has a binary one signal, data or instruction signals are to be transferred to the microprocessor 170 over IO and when it is a binary zero, microprocessor 170 supplies data signals over IO. Write line WRT indicates to memory 172 that signals are to be recorded in the memory. The signal IIP indicates interrupt in process, i.e., the microprocessor 170 program has been interrupted and is handling that interrupt. SDL (data latch) is received from system clock 176, indicating data signals from IO are to be latched in microprocessor 170. The line SK (silver-Killer) is a control signal for eliminating extraneous signals commonly referred to as slivers. These signals result in interaction between successively actuated bistable circuits termed latches. Other timing signals for coordinating operation of all of the units 171–175 are received from system clock 176. Additionally, power on reset circuit POR activates system clock 75 to send out timing signals and control signals for resetting all of the units 170–175 to a reference state as is well known in the computer arts.

The Microprocessor 170

Figure 6:
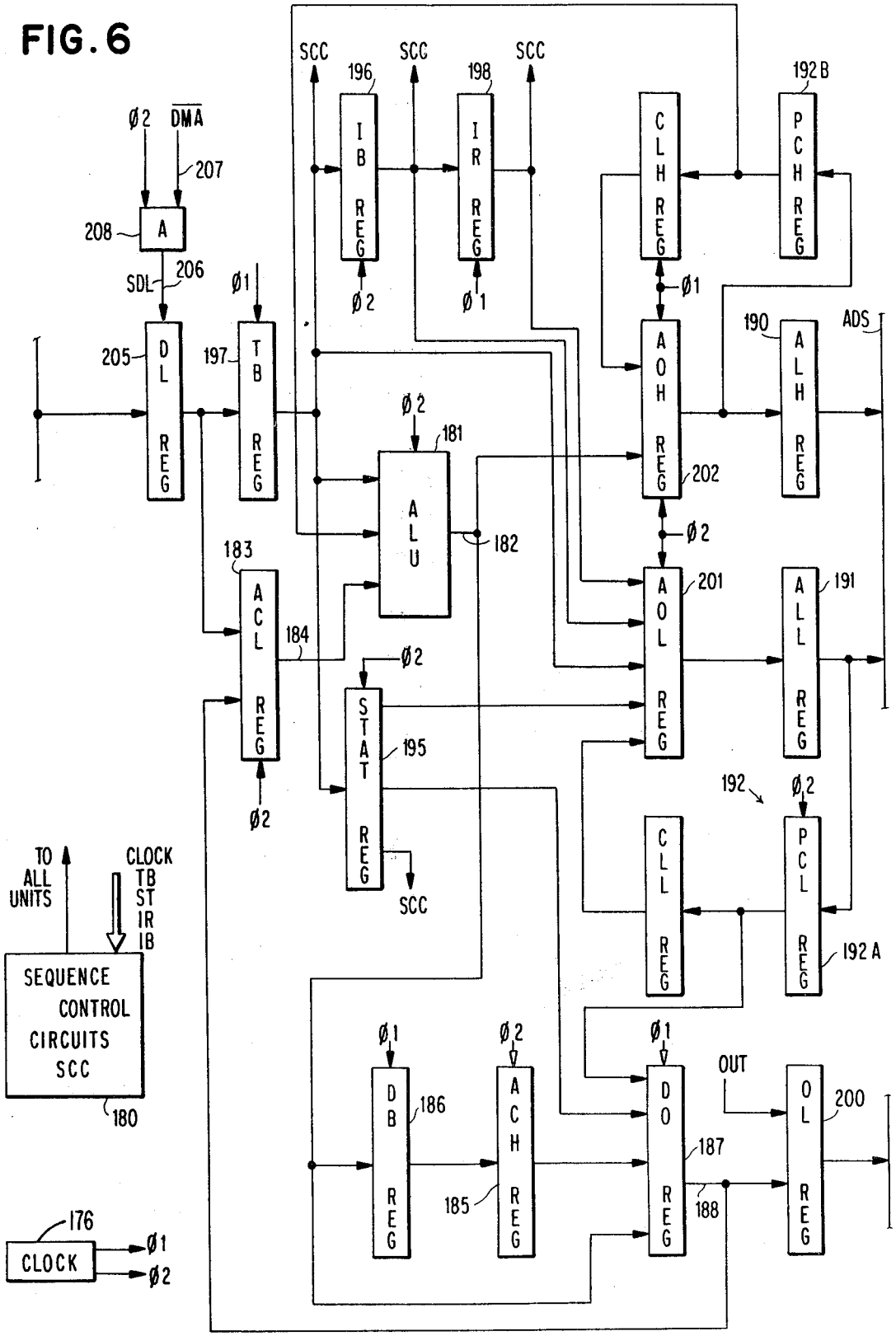
FIG. 6 is a block diagram of the register connections in the processor of FIG. 4.

In FIG. 6, the data flow of microprocessor 170 is detailed. The sequence control circuits 180 are those logic circuits designed to implement the functions to be described performable in the timing context of the following description. The sequence control circuits SSC 180 include instruction decoders, memory latches, and the like, for sequencing the operation of the illustrated data-flow circuits of FIG. 6 using a two-phase clock, $\phi$ and $\phi$s from clock 176. The processor contains an eight-bit wide (one-character wide) arithmetic and logic unit ALU 181. ALU 181 receives signals to be combined during a $\phi 2$ and supplies static output signals over ALU output bus 182 during each $\phi 1$. Operatively associated with ALU 181 is a sixteen-bit accumulator consisting of two registers, a low register ACL 183 which has its output connections over eight-bit wide bus 184 as one input to ALU 181. The second register of the accumulator is ACH register 185. When the microprocessor 170 operates with a two-character wide (two-byte) word, the functions of ACL 183 and ACH 185 alternate. That is, in a first portion of the operation, which requires two complete microprocessor 170 cycles, as later described, ACL 183 contains the lower order eight bits of a sixteen bit wide word, while ACH 185 contains the upper eight bits of the sixteen-bit wide word. ALU 181 first operates on the lower eight bits received over ACL bus 184 and supplies the result signals over ALU output bus 182 to DB register 186. During this same transferring action, ACH 185 is supplying the upper eight bits through DO register 187, thence over DO bus 188 to ACL 183. During the next ALU cycle, the upper eight bits are operated upon. In the preferred and constructed embodiment, ALU 181 operates with two's- complement notation and can perform either eight-bit wide or sixteen bit-wide arithmetic as above described. Eight-bit wide logical operations are also performed.

ALU 181 contains three indicating latches (not shown) which store the results of arithmetic and logical functions for use in later processor cycles, such as conditional jumps or branches, and input carry instructions. These three indicators are low, equal (EQ), and carry. Utilization of these indicators will be better understood by continued reading of the specification. Processor sequence control circuits 180 can control a single level of interrupt and includes an internal interrupt mask register (not shown) for disabling interrupts as is well known in the computer arts. The low order bits of the address signals supplied to bus ADS by the ALH register 190 (high order bits of the address) and ALL register 191 (the low order eight bits of the address) are designated as work registers. These registers are divided into sixteen groups of sixteen two-byte wide logical registers. A portion of ALL register 191 supplies GP signals for selecting which groups of registers are accessible by microprocessor 170.

As will be later detailed, microprocessor 170 requires two processor cycles for processing an I/O instruction. The first cycle is a set-up cycle and the second cycle is a data transfer cycle. When an I/O operation requires a transfer of a succession of bytes, the first cycle sets up a unit 171–175 for transferring a plurality of bytes such that the I/O operation appears as a set-up cycle followed by a plurality of data transfer cycles. The microprocessor 170 is designed to operate with a plurality of relatively slow acting devices, i.e., copy production machine 10. The time required for the microprocessor 170 to perform its functions is relatively short compared to the time required by the controlled devices. Accordingly, under clock 176 control, the microprocessor 170 can be effectively turned off to allow a controlled device to have exclusive use of the IO bus.

From examination of FIG. 6, it can be seen that all of the registers, being latches, will maintain their respective signal states whenever the clock phases, $\phi$ and $\phi 2$, are not supplied. Therefore, upon an interruption of the micprocessor 170 functioning by a controlled device 171–175, the signal state of the processor 170 enables it to begin operating again as if there had been no interruption.

The other registers in the microprocessor 170 are described with the instructions set for facilitating a better understanding of the interaction of these registers. The microprocessor employs instructions of variable length, one, two or three bytes. The first byte of any instruction always includes the operation code, succeeding bytes, numbered two or three, containing address data or operand data, the latter referred to as immediate data.

The fastest instruction execution requires one microprocessor cycle and the longest instruction requires six processor cycles. An interrupt requires ten cycles to process. In all designations, bit 0 is the least significant bit.

The detailed operation of a microprocessor suitable for use in the invention is described in U.S. Pat. No. 4,086,658.

DETAILED DESCRIPTION OF THE PREFERRED EMBODIMENT

Figure 11:
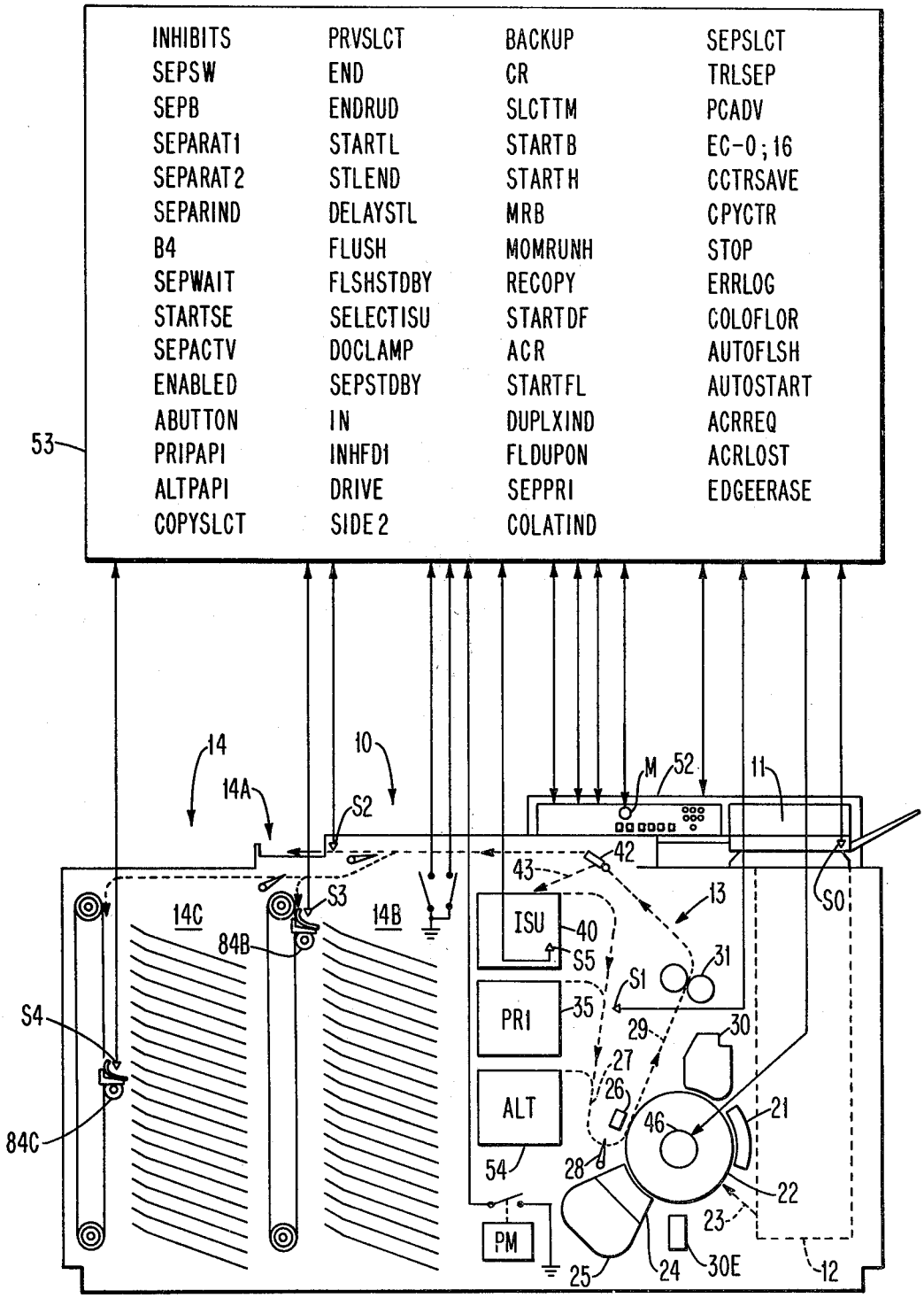
FIG. 11 is a diagram which shows a preferred embodiment of the present invention.

In FIGS. 11 et seq,. a microprocessor controlled embodiment of the invention is shown and described below. In FIG. 11 control 53 is shown as a box containing a plurality of indicators which are used, as will become apparent, in the program control. The program control operates in the computer system shown in FIGS. 4–10, inclusive. The tables in the description of the preferred embodiment contain source code operable on the described computer and the FIG. 11 indicators to illustrate the invention. FIGS. 12–29 are flow charts to make it easier to follow the description.

In FIG. 11, it is seen that copy production machine 10 is as shown in FIG. 1. In addition, sensing switches S2, S3, S4 are shown at exit positions of output portion 14. Such sensing switches indicate a copy is leaving the copy production machine at its designated output port (termed a billing port) and is suitable or not to be billed, depending upon the status of copy production, i.e., whether copies are actually being produced or an auxiliary mode such as flush or separate runs is being performed. Switch S1 adjacent copy path 27 senses copy sheets entering CPP 13. It should be noted that FIG. 11 is diagrammatic in that the position of S1 and of alternate paper supply 54 appear not to coincide; however, the copy sheets selected from supply 54 actually proceed past S1 before reaching aligner gate 28. All of the status indicators listed in FIG. 11 are described in the ensuing discussion. A pluggable billing meter PM may be installed in machine 10. It has a switch which signals to control 53 that the PM meter is plugged in, allowing the machine to operate. If the PM meter is removed, machine 10 cannot operate.

Figure 12:
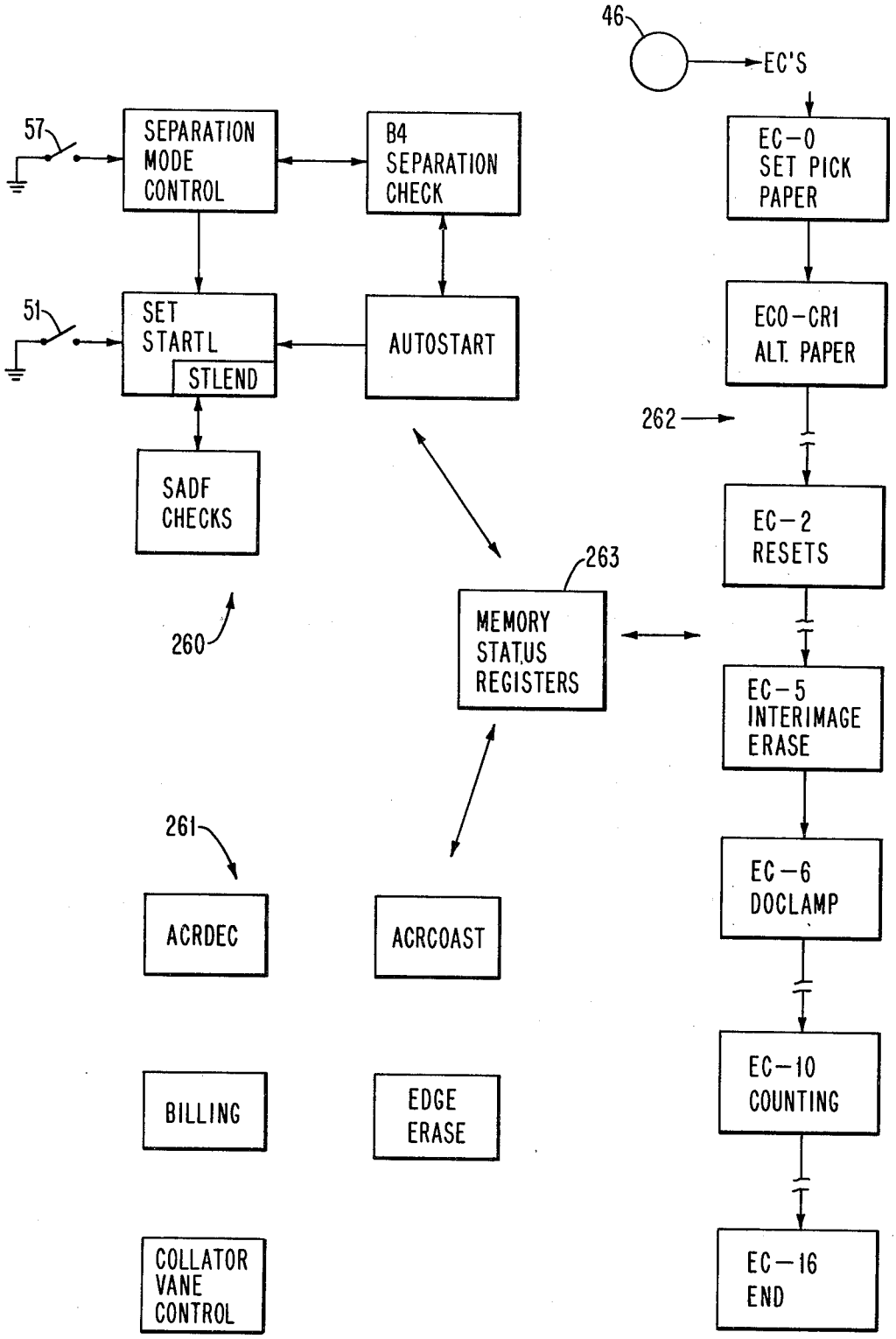
FIG. 12 is a block diagram which illustrates program segment calls for implementing the present invention in a best mode.

FIG. 12 is a simplified diagrammatic showing of the various computer programs for the preferred embodiment. In general, the programs are divided into two general categories, asynchronous and synchronous. This division eliminates the need for a master control program or an executive program as is usually required in the data processing and machine controller arts. In contrast to that type of control, the program control of the present invention is slaved to the timing and operation of copy production machine 10 such that the electromechanical portions of copy production machine 10 synchronize the operation of program control 53. In particular, power line zero crossovers are detected by means not shown and are used to invoke the programs indicated generally by numerals 260 and 261, i.e., the programs asynchronous to the copy production process. Even when copies are being actively produced, the asynchronous programs 260, 261 are executed on a power line frequency periodic basis for monitoring the operation of copy production machine 10 including operator control panel 52. There are, of course, many more programs resident for the asynchronous programs, FIG. 12 being limited to those computer programs having a direct bearing on practicing the present invention.

The second set of programs is termed synchronous programs and are timed and instigated by timing signals from emitter wheel 46 of photoconductor drum 20 (FIG. 11). Emitter wheel 46 emits periodic pulses called emitter control pulses, ECs 0–16, for each image area. The photoconductor drum 20 preferably has two image areas, so that there will be two sets of EC0-EC16 pulses for each drum rotation. The computer receives and counts the ECs using software techniques. A fiducial pulse (not shown), also termed a "sync" pulse, defines the image areas on the photoconductor drum 20. A computer is programmed by programs (not shown or described) to reset the EC count upon the receipt of each fiducial pulse. For each image area being processed by CPP 13, the computer in control 53 responds to its own software counting to invoke one of the synchronous programs to be executed by the computer. For example, when EC0 is received, a plurality of programs are invoked because EC0 relates to a preparatory portion of each image cycle. Some of the EC0 programs are not shown for purposes of brevity. At EC2, certain resets are employed in connection with practicing the separation mode. At EC5, the inner image erase controls are illustrated and EC6 controls the document lamp. Then, at EC10, certain counts are effected for controlling the copy production machine 10 using software architecture. Finally, the last EC, EC16, resets the separation mode at the end of a separation mode run as well as performing other functions not pertinent to the practice of the present invention. Communication between the synchronous programs, the EC0-EC16 signals, and the asynchronous programs 260, 261 are via the memory status registers or indicators listed in FIG. 11 in box 53 and designated in FIG. 12 as registers 263. That is, when a separation button 57 is closed, separation mode control enables control 53 to sense closure and to store the closure in a given location of the memory status registers 263. The computer also then invokes the B4 separation check program to ensure compatability of separation sheets with copy sheets. Closure of the start button 51 is sensed by the computer by executing set STARTL. (STARTL means start latch program). In connection with starting copy production machine 10, SADF 11 is checked for an original document at the preentry station. Finally, if the copy production had been interrupted or the separation mode had been interrupted, the autostart program enables the computer to restart automatically as will become apparent.

The asynchronous programs 261 enable the computer to logically extend the capability of the collator 14B, 14C by allowing more than one collated set per collator bin. Furthermore, other functions are performed by the computer in response to these stored programs for maximizing the efficiency of copy production machine 10. All of these will become apparent from a continued reading of the specification.

In FIGS. 13–29, the flow chart step designation corresponds to the "LOC" designation of the source code in the corresponding tables included in this description. The flow chart is first described and then the table included in the specification. For example, in FIG. 13 step 5468 corresponds to an instruction of Table I at LOC 5468.

Figures 13, 21:
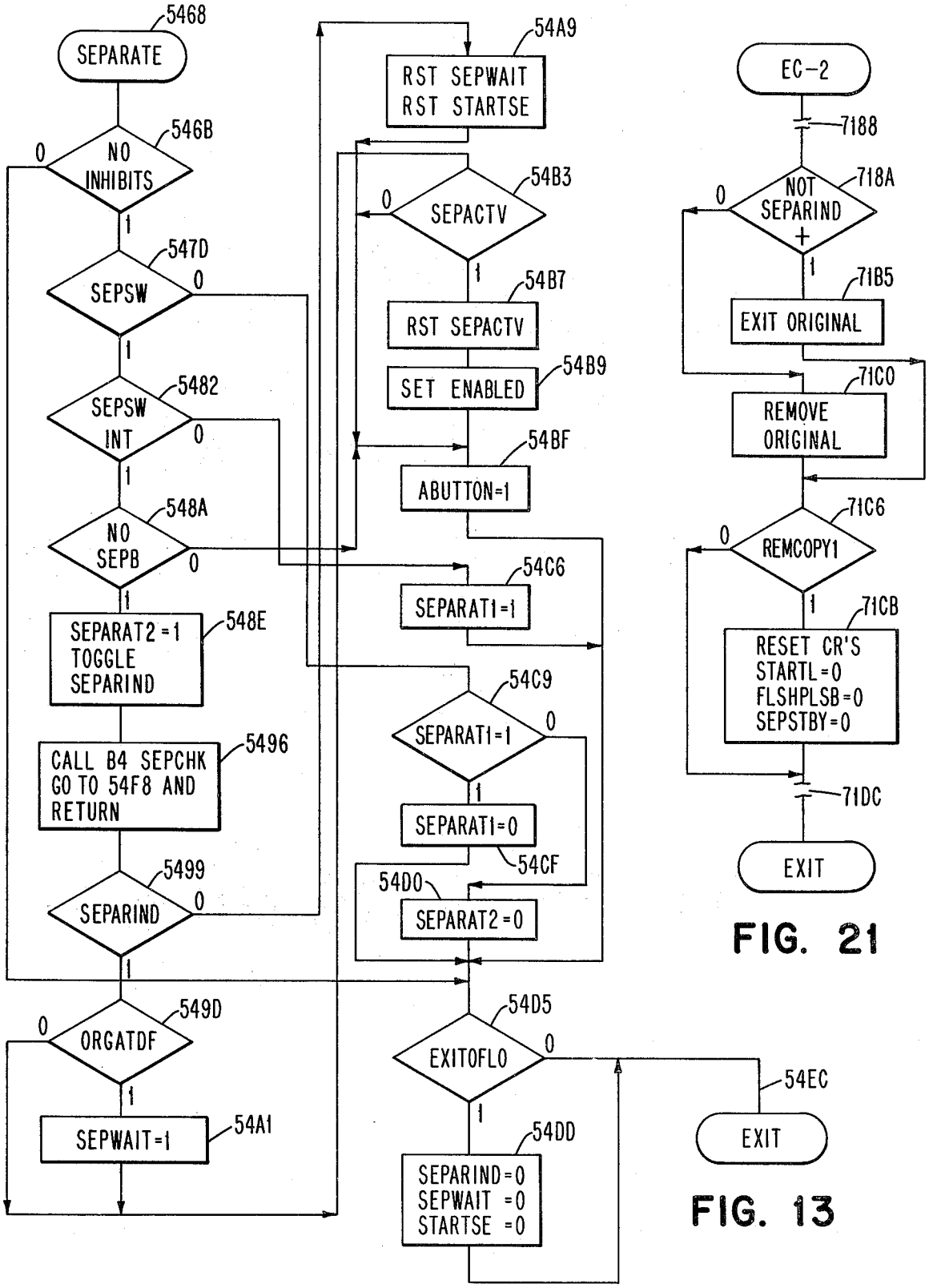

In FIG. 13, the separate mode controls are entered at 5468. First the computer checks for inhibits at 546B, such as check paper path (CPPIND) and the like. If any Table I listed inhibits are present, the separation mode should not be performed.

With no such inhibits, at 547D the computer checks whether the separation switch 57 (SEPSW) has been actuated. If so, the computer checks whether a switch closure integration (software type) indicates actuation is a true actuation or noise. Then at 548A the computer checks to see whether or not the separate switch or button 57 had been previously successfully integrated. If not, then at 548E separate indicator SEPARIND is toggled to its opposite signal state and SEPARAT2 flag is set to a 1. SEPARIND is one bit of memory 172 and is listed in FIG. 11. Then at 5496 the computer calls the B4 separation check code shown in FIG. 14 and later described. At 5499 the computer checks the separate indicator. If the separate indicator is off, i.e., the toggling of the separate switch deselected the separate indicator, then the computer at 54A9 resets the separate wait flag and resets the start separate flag STARTSE. If the separate indicator was on at 5499 then the computer checks at 549D whether an original is at the document feed (ORAGTDF). If there is an original at the document feed then the separate run must wait until after the copy production run for such original document, i.e., one more copy run. The operator, by putting originals in SADF 11, inhibits the separation mode until the end of a set to be collated or produced. As implemented, the choice is delay of one copy production run, no limitation thereto intended. In any event, an original at the document feed, the separate wait (SEPWAIT) flag or indicator may be set at 54A1. SEPWAIT inhibits the separation mode. From 54A1 the computer steps the program to 54B3 to determine whether a separation mode is now active (SEPACTV). If separation mode is active, then the computer resets SEPACTV at 54B7 and sets ENABLED at 54B9. The flag enabled in status registers 263 allows the computer to sense the operator parameter selection switches on control panel 52 and indicates all zeros in the numerical display indicating copies made/copies selected. Finally, at 54BF the computer senses whether any button was activated and sensed being pushed on panel 52. It should be noted that the computer branches from several points in the separate control program to 54BF. Next, the computer at 54D5 checks for exit overflow. Exit overflow means that the number of copies being made exceeds the capacity of collator 14B, 14C and excess copies are being directed to the exit tray 14A. In the preferred embodiment, this action occurs only when collate mode is selected after side 1 of a duplex job has occurred. Under other circumstances separation mode of this invention is employed. If there is no exit overflow, the computer exits the program at 54EC to execute the next asynchronous program in the line of executions.

In the event of exit overflow, the instruction at 54DD enables the computer to reset the separate indicator (no separation is required or desired), separate wait and STARTSE flags. The computer then exits at 54EC.

At 546B, if there are inhibits then the instruction at 54D5 is executed and all of the above described intermediate instructions omitted. If the separation switch 57 is sensed as not being pushed at 547D then at 54C9 SEPARAT1 is set to a one. This flag indicates that the separate button had been previously pushed and is not now being pushed. If the SEPARAT1 is equal to zero, this means that the separate switch has not recently been pushed. Therefore, at 54D0 SEPART2 is equal to zero, i.e., separation mode will not be honored. On the other hand, if SEPARAT1 is equal to a one at 54C9, SEPARAT1 is reset at 54CF with SEPARAT2 equal to a one to enable separation mode. At 5482 if the separation switch integration is still a zero, then at 54C6 the above-mentioned SEPART1 is set to one.

With regard to the above description, it should be noted that the program was executed at every power line crossover. Therefore, in setting up the separation mode in the computerized embodiment of the invention, asynchronous programs will be executed many times during each set-up. Each pass through the program by the computer will sense the immediate status of the machine for enabling the machine to be set up in the separation mode as originally described for the hardware representation of machine functions. The source code for the separate mode control program is set forth below in Table I. LOC means memory location, OBJ means object, OP1 is operand 1, OP2 is operand 2. The abbreviations in the source statements are as used in the flow charts or elsewhere. The symbols are those symbols used for logic except a logical "not" is " ¬ ". The "PSBs" are program status bits not pertinent to an understanding of the invention, and SEP indicates separation mode checkpoint.

TABLE I

SEPARATION MODE CONTROL

| LOC | OBJ | OP1 | OP2 | SOURCE STATEMENT |
|---|---|---|---|---|
| | | | | 1. CALL CHKINH CHECK FOR (¬CPPIND & ¬CKCOLTRI & ¬REMCOPYI & ¬PLSTNDBY) Check Inhibits |
| 5468 | 31583A | 0001 | 3A58 | BAL R1,CHKORG |
| | | | | 1. IF (NO INHIBITS FROM ABOVE) & ¬ADDPAPER & ¬ACRREQ & ¬(CEMODE>5) |
| 546B | 3CD3 | 54D3 | | BNZ SEP06 |
| | | | | TPB PSB07,ADDPAPER |
| 546D | A647 | 0047 | | |
| 546F | 94 | 0004 | | |
| 5470 | 3CD3 | 54D3 | | BNZ SEP06 *GO IF ACTIVE |
| | | | | TPB PSB01,ACRREQ |
| 5472 | A641 | 0041 | | |
| 5474 | 91 | 0001 | | |
| 5475 | 3CD3 | 54D3 | | BNZ SEP06 *GO IF SET |
| 5477 | A662 | 0062 | | LB CEMODE GET CE MODE BYTE |
| 5479 | A805 | 0005 | | CI 5 |
| 547B | 3ED3 | 54D3 | | BH SEP06 *GO IF GREATER THAN 5 |
| | | | | 1. THEN |
| | | | | 2. . IF SEPARATE (SEPARATION DEPRESSED) |
| | | | | RIN CSB05 GET STATUS |
| 547D | A6C4 | 00C4 | | |
| 547F | 97 | 07 | | TP SEPARATE TEST IF BEING PUSHED |
| 5480 | 3DC9 | 54C9 | | BZ SEP03 *GO IF NO |
| | | | | 2. . THEN |
| | | | | 3, . . IF SEPARAT1 SEPARATION BEING INTEGRATED |
| 5482 | A9A0 | 00A0 | | GI INTOFF |
| 5484 | A641 | 0041 | | LB PSB01 GET STATUS |
| 5486 | AF80 | 0007 | | TS SEPARAT1 TEST IF SET |
| 5488 | 3DC6 | 54C6 | | BZ SEP02 *GO IF NO |
| | | | | 3. . . THEN |
| | | | | 4. . . . IF ¬SEPARAT2 SEPARATION NOT HONORED |
| 548A | AF40 | 0006 | | TS SEPARAT2 |
| 548C | 3CBF | 54BF | | BNZ SEP01A *GO IF YES - Separate Pushed |
| | | | | 4. . . . THEN |
| | | | | 5. . . . . SEPARAT2=1 |
| 548E | A141 | 0041 | | STB PSB01 UPDATE |
| | | | | 5. . . . . TOGGLE SEPIND - Memorize |
| 5490 | A677 | 0077 | | LB PCB06 GET STATUS |
| 5492 | AD04 | 0004 | | XI P1(SEPARIND) |
| 5494 | A177 | 0077 | | STB PCB06 UPDATE |
| | | | | 5. . . . . CALL B4SEPCHK GO CHECK B4 SEPARATION |
| 5496 | 33F854 | 0003 | 54F8 | BAL R3,B4SEPCHK |
| | | | | 5. . . . . IF SEPARIND |
| | | | | TPB PCB06,SEPARIND |
| 5499 | A677 | 0077 | | |
| 549B | 92 | 0002 | | |
| 549C | 49 | 5489 | | JZ SEP01 *GO IF NO |
| | | | | 5. . . . . THEN |
| | | | | 6. . . . . IF ORGATDF |
| | | | | RIN CSB09 GET STATUS |
| 549D | A6D0 | 00D0 | | |
| 549F | 94 | 0004 | | TP ORGATDF TEST IF DOC AT SADF |
| 54A0 | 49 | 54A9 | | JZ SEP01 *GO IF NO |
| | | | | 6. . . . . THEN |
| | | | | 7. . . . . SEPWAIT=1 |

TABLE I-continued

SEPARATION MODE CONTROL

| LOC | OBJ | OP1 | OP2 | SOURCE STATEMENT |
|---|---|---|---|---|
| | | | | TSB PCB01,SEPWAIT |
| 54A1 | A641 | 0041 | — | Separate waits for |
| 54A3 | AF20 | 0005 | | next run. |
| 54A5 | A141 | 0041 | | |
| | | | | 6. . . . . ENDIF |
| 54A7 | 2CBF | 54BF | | B SEP01A *GO |
| | | | | 5. . . . . ELSE |
| | | 54A9 | | SEP01 DC * |
| | | | | 6. . . . . RESET SEPWAIT,STARTSE |
| | | | | TRB PSB01,SEPWAIT |
| 54A9 | A641 | 0041 | | |
| 54AB | B5 | 0005 | | |
| 54AC | A141 | 0041 | | |
| | | | | TRB PSB07,STARTSE |
| 54AE | A647 | 0047 | | |
| 54B0 | B7 | 0007 | | |
| 54B1 | A147 | 0047 | | |
| | | | | 6. . . . . IF SEPACTV |
| 54B3 | A647 | 0047 | | LB PSB07 |
| 54B5 | B3 | 0003 | | TR SEPACTV |
| 54B6 | 4F | 54BF | | JZ SEP01A |
| | | | | 6. . . . . THEN |
| | | | | 7. . . . . RESET SEPACTV |
| 54B7 | A147 | 0047 | | STB PSB07 |
| | | | | 7. . . . . SET ENABLED |
| | | | | TSB PSB42,ENABLED |
| 54B9 | A66A | 006A | | |
| 54BB | AF80 | 0007 | | |
| 54BD | A16A | 006A | | |
| | | | | 6. . . . . ENDIF |
| | | | | 5. . . . . ENDIF |
| | | | | 4. . . . ENDIF |
| | | 54BF | | SEP01A DC * |
| | | | | 4. . . . ABUTTON=1 |
| | | | | TSB PSB28,ABUTTON |
| 54BF | A65C | 005C | | |
| 54C1 | AF02 | 0001 | | |
| 54C3 | A15C | 005C | | |
| 54C5 | 03 | 54D3 | | J SEP06 |
| | | | | 3. . . ELSE |
| | | 54C6 | | SEP02 DC * |
| | | | | 4. . . . SEPARAT1=1 |
| 54C6 | A141 | 0041 | | STB PSB01 UPDATE |
| | | | | 3. . . ENDIF |
| 54C8 | 03 | 54D3 | | J SEP06 |
| | | | | 2. . ELSE |
| | | 54C9 | | SEP03 DC * |
| | | | | DEINTEGRATION OF SEPARATION SWITCH |
| | | | | 3. . . IF SEPARAT1 |
| 54C9 | A9A0 | 00A0 | | GI INTOFF |
| 54CB | A641 | 0041 | | LB PSB01 GET STATUS |
| 54CD | B7 | 0007 | | TR SEPARAT1 TEST IF SET |
| 54CE | 40 | 54D0 | | JZ SEP04 *GO IF NO |
| | | | | 3. . . THEN |
| | | | | 4. . . . SEPARAT1=0 |
| 54CF | 01 | 54D1 | | J SEP05 |
| | | | | 3. . . ELSE |
| | | 54D0 | | SEP04 DC * |
| | | | | 4. . . . SEPARAT2=0 |
| 54D0 | B6 | 0006 | | TR SEPARAT2 |
| | | | | 3. . . ENDIF |
| | | 54D1 | | SEP05 DC * |
| 54D1 | A141 | 0041 | | STB PSB01 UPDATE |
| | | | | 2. . ENDIF |
| | | | | 1. ENDIF |
| | | 54D3 | | SEP06 DC * |
| 54D3 | A920 | 0020 | | GI INTON UNMASK INTERRUPTS |
| | | | | 1. IF EXITOFLO |
| | | | | SRG COLRG |
| 54D5 | A9D0 | 00D0 | | |
| | | | | TPB CPSB05,EXITOFLO |
| 54D7 | A616 | 0016 | | |
| 54D9 | 95 | 0005 | | |
| 54DA | A989 | 0089 | | GI INTOFFCG+BASERG |
| 54DC | 4C | 54BC | | JZ SEP10 |
| | | | | 1. THEN |
| | | | | 2. . SEPARIND=0 |
| | | | | TRB PCB06,SEPARIND |
| 54DD | A677 | 0077 | | |
| 54DF | B2 | 0002 | | |

TABLE I-continued

SEPARATION MODE CONTROL

| LOC | OBJ | OP1 | OP2 | SOURCE STATEMENT |
|---|---|---|---|---|
| 54E0 | A177 | 0077 | | |
| | | | | 2. . SEPWAIT,STARTSE |
| | | | | TRB PSB01,SEPWAIT |
| 54E2 | A641 | 0041 | | |
| 54E4 | B5 | 0005 | | |
| 54E5 | A141 | 0041 | | |
| | | | | TRB PSB07,STARTSE |
| 54E7 | A647 | 0047 | | |
| 54E9 | B7 | 0007 | | |
| 54EA | A147 | 0047 | | |
| | | | | 1. ENDIF |
| | | 54E2 | | DC * |
| 54EC | A920 | 0020 | | GI INTON |
| | | | | ENDBEGIN SEPARATE |

Figure 14:
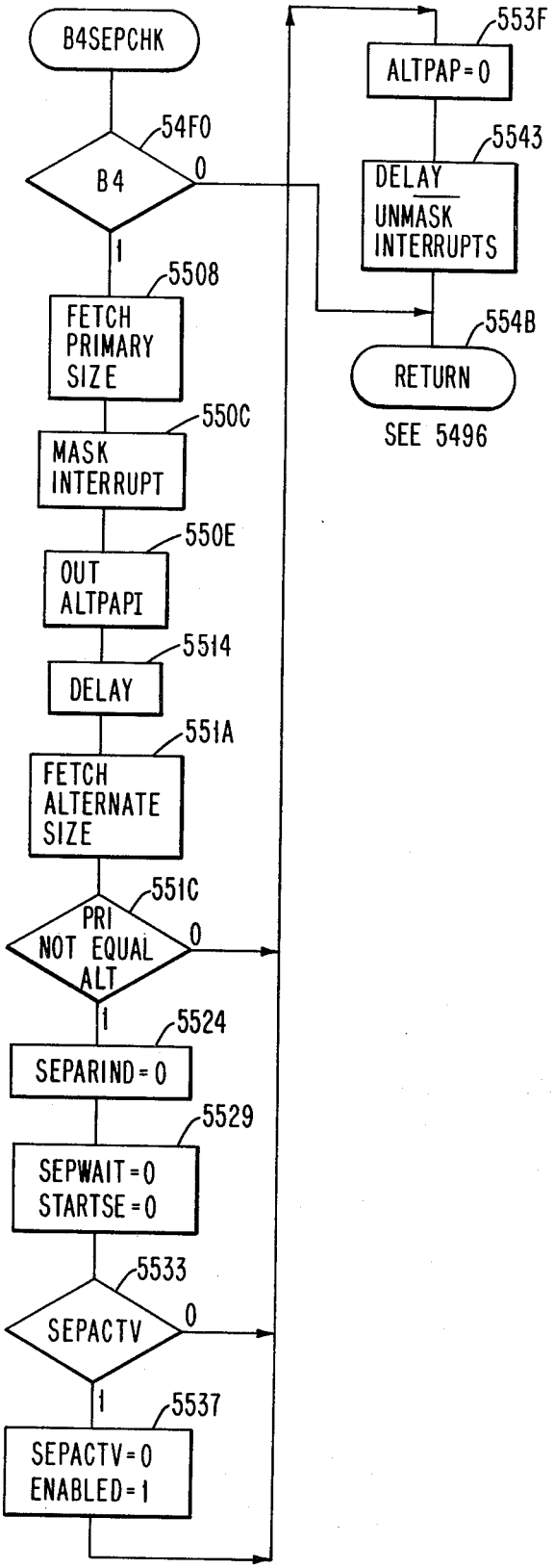
FIG. 14 is a flow chart showing checking paper sizes for copy production and separation.

In FIG. 14, the computer execution of a program for checking proper separation sheet size is described. At 54F8 the computer checks whether the copy production machine is designed to handle so-called B4 sizes. If not, there is no need to inhibit any size of separation sheet and the computer exits the program at 554B, returing to the FIG. 13 illustrated program.

When checking for proper sheet sizes for certain nations, the computer at 5508 fetches the primary size, i.e., the size of copy sheets on which images are being produced. During this checking interrupts are masked beginning at 550C. At 550E the second paper supply or alternate paper bin 54 is selected. The delay at 5514 allows the selection to be completed. At 551A the alternate size, i.e., the size of copy sheets in the second paper supply 54, is determined. If the size of copy sheets indicated for the primary bin 35 is not the same as that indicated for second paper supply 54, then the separation indicator is reset at 5524, i.e., separation mode will not be allowed. Then at 5529 SEPWAIT and STARTSE are also reset. Then at 5533 SEPACTV is checked. If it is active it is reset at 5537 and ENABLED is activated. Finally, at 553F alternate paper is reset with a deselection delay at 5543 and the interrupts being unmasked. The computer then returns to the FIG. 13 illustrated program as a preparatory step for executing a separation mode run.

TABLE II

PAPER SIZE CHECK

| LOC | OBJ | OP1 | OP2 | SOURCE STATEMENT |
|---|---|---|---|---|
| | | 54F8 | | ORG B4SEPCHK |
| | | | | BEGIN B4SEPCHK |
| | | | | 1. TEXT |
| | | | | THIS SUBROUTINE GUARANTEES THAT THE LARGEST, SMALLEST |
| | | | | AND INTERMEDIATE B4 PAPER SIZES WILL NOT BE MIXED BY |
| | | | | SEPARATION MODE ON B4 MACHINES WHILE COLLATE IS SELECTED. |
| | | | | REGISTERS USED: |
| | | | | R0 LOW |
| | | | | R3 LINKAGE |
| | | | | R8 ALL |
| | | | | 1. ENDTEXT |
| | | | | 1. IF (B4 &COLATIND &SEPARIND & ALTPAPI) |
| 54F8 | A6A1 | 01A1 | | LBL COUNTRY |
| 54FA | 92 | 0002 | | TP B4 |
| 54FB | 46 | 5506 | | JZ SEPCHK10 |
| 54FC | A677 | 0077 | | LB PCB06 |
| 54FE | 91 | 0001 | | TP COLATIND |
| 54FF | 46 | 5506 | | JZ SEPCHK10 |
| 5500 | 92 | 0002 | | TP SEPARIND |
| 5501 | 46 | 5506 | | JZ SEPCHK10 |
| | | | | TPB PCB05,ALTPAPI |
| 5502 | A676 | 0076 | | |
| 5504 | 91 | 0001 | | |
| 5505 | 48 | 5508 | | JZ SEPCHK20 |
| | | 5506 | | SEPCHK10 DC * |
| 5506 | 3C4B | 554B | | B SEPCHK45 |
| | | | | 1. THEN |
| | | 5508 | | SEPCHK20 DC * |
| | | | | 2. . INPUT PRIMARY BIN SIZE AND SAVE |
| | | | | RIN CSB13 |
| 5508 | A6D4 | 00D4 | | |
| 550A | A120 | 0120 | | STBL BASER0LO |
| | | | | 2. . MASK INTERRUPTS |
| 550C | A9A0 | 00A0 | | GI INTOFF |
| | | | | 2. . OUTPUT ALTPAPI=1 |
| 550E | A676 | 0076 | | LB PCB05 |
| 5510 | AF02 | 0001 | | TS ALTPAPI |
| | | | | ROUT CCB05 |
| 5512 | A1C4 | 00C4 | | |
| | | | | 2. . DELAY 115 MICROSECS |
| | | | | ZLI 4 |
| 5514 | 25 | | | |

TABLE II-continued

PAPER SIZE CHECK

```
LOC  OBJ    OP1   OP2  SOURCE STATEMENT
5515 AE04   0004
5517 88     0008                STR    R8
            5518          SEPCHK25 DC   *
5518 F8     0008                LRD    R8
5519 78     5518                JNZ    SEPCHK25
                          2.. INPUT ALTERNATE BIN SIZE
                                RIN    CSB13
551A A6D4   00D4
                          2.. IF (ALTERNATE CONTAINS B5 OR PRIMARY SELPAPE   = ALTERNATE
                                 SELPAPE)
551C AB1E   001E                 NI    P(SELPAPE,SELPAPD,SELPAPC,SELPAPB)
551E 44     5524                 JZ    SEPCHK30 * GO IF B5
551F A520   0120                XBL    BASER0LO
5521 94     0004                 TP    SELPAPE
5522 3D3F   553F                 BZ    SEPCHK35 * GO IF THEY AGREE
                          2.. THEN
            5524          SEPCHK30 DC   *
                          3... SEPARIND=0
                                TRB    PCB06,SEPARIND
5524 A677   0077
5526 B2     0002
5527 A177   0077
                          3... SEPWAIT,STARTSE=0
                                TRB    PSB01,SEPWAIT
5529 A641   0041
552B B5     0005
552C A141   0041
                                TRB    PSB07,STARTSE
552E A647   0047
5530 B7     0007
5531 A147   0047
                          3... IF SEPACTV
5533 A647   0047                 LB    PSB07
5535 B3     0003                 TR    SEPACTV
5536 4F     553F                 JZ    SEPCHK35
                          3... THEN
                          4.... RESET SEPACTV
5537 A147   0047                STB    PSB07
                          4.... SET ENABLED
                                TSB    PSB42,ENABLED
5539 A66A   006A
553B AF80   0007
553D A16A   006A
                          3... ENDIF
                          2.. ENDIF
            553F          SEPCHK35 DC   *
                          2.. OUTPUT ALTPAPI=0
553F A676   0076                 LB    PCB05
                               ROUT    CCB05
5541 A1C4   00C4
                          2.. DELAY 115 MICROSECS
                                ZLI    4
5543 25
5544 AE04   0004
5546 88     0008                STR    R8
            5547          SEPCHK40 DC   *
5547 F8     0008                LRD    R8
5548 77     5547                JNZ    SEPCHK40
                          2.. UNMASK INTERRUPTS
5549 A920   0020                 GI    INTON
                          1. ENDIF
            554B          SEPCHK45 DC   *
                          1. RETURN TO CALLER
554B 23     0003                 RTN    R3
                                 ENDBEGIN B4SEPCHK
```

Figures 15, 18:
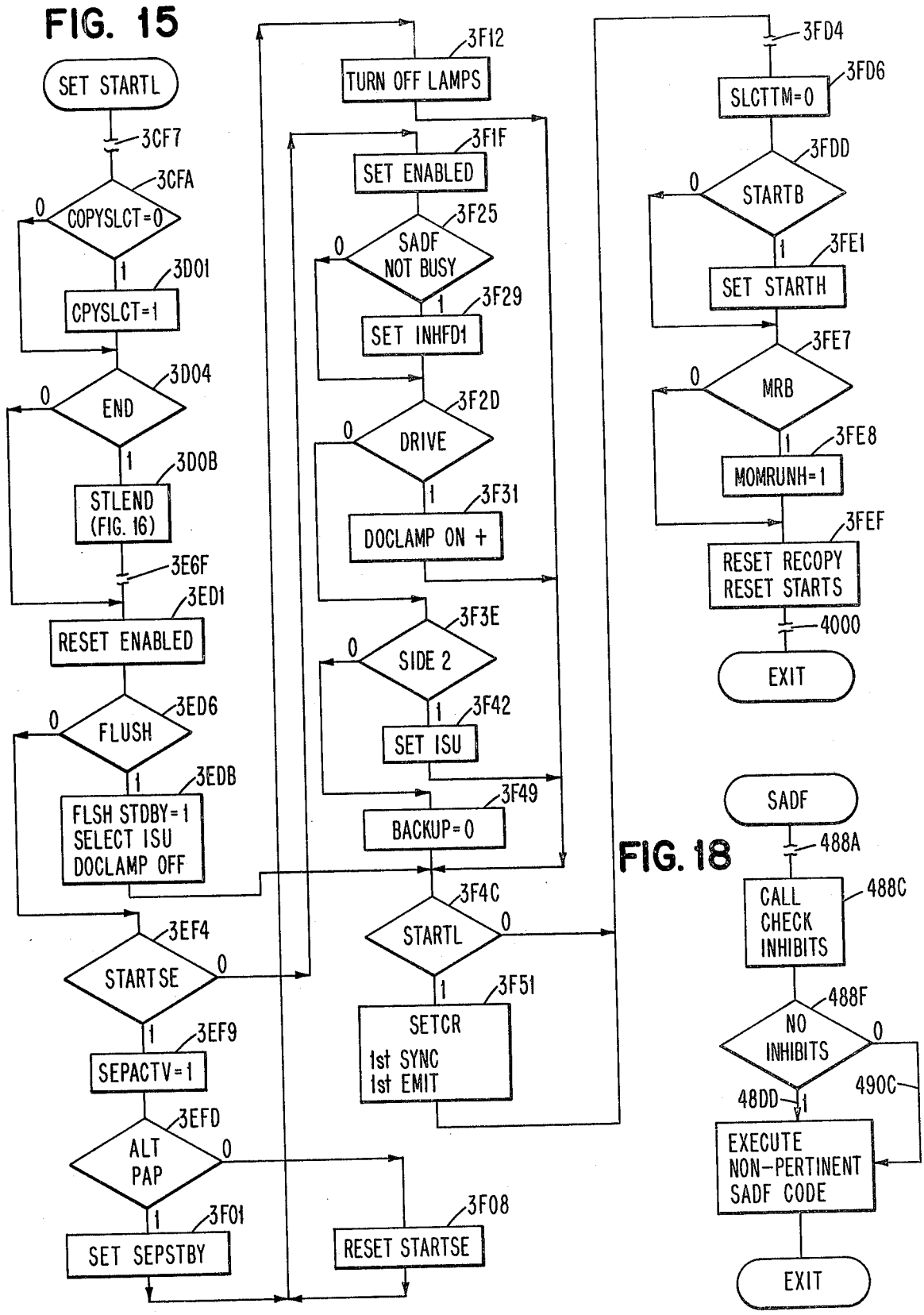
FIGS. 15, 16 and 18 are flow charts showing certain start procedures related to the separation mode.
Figure 16:
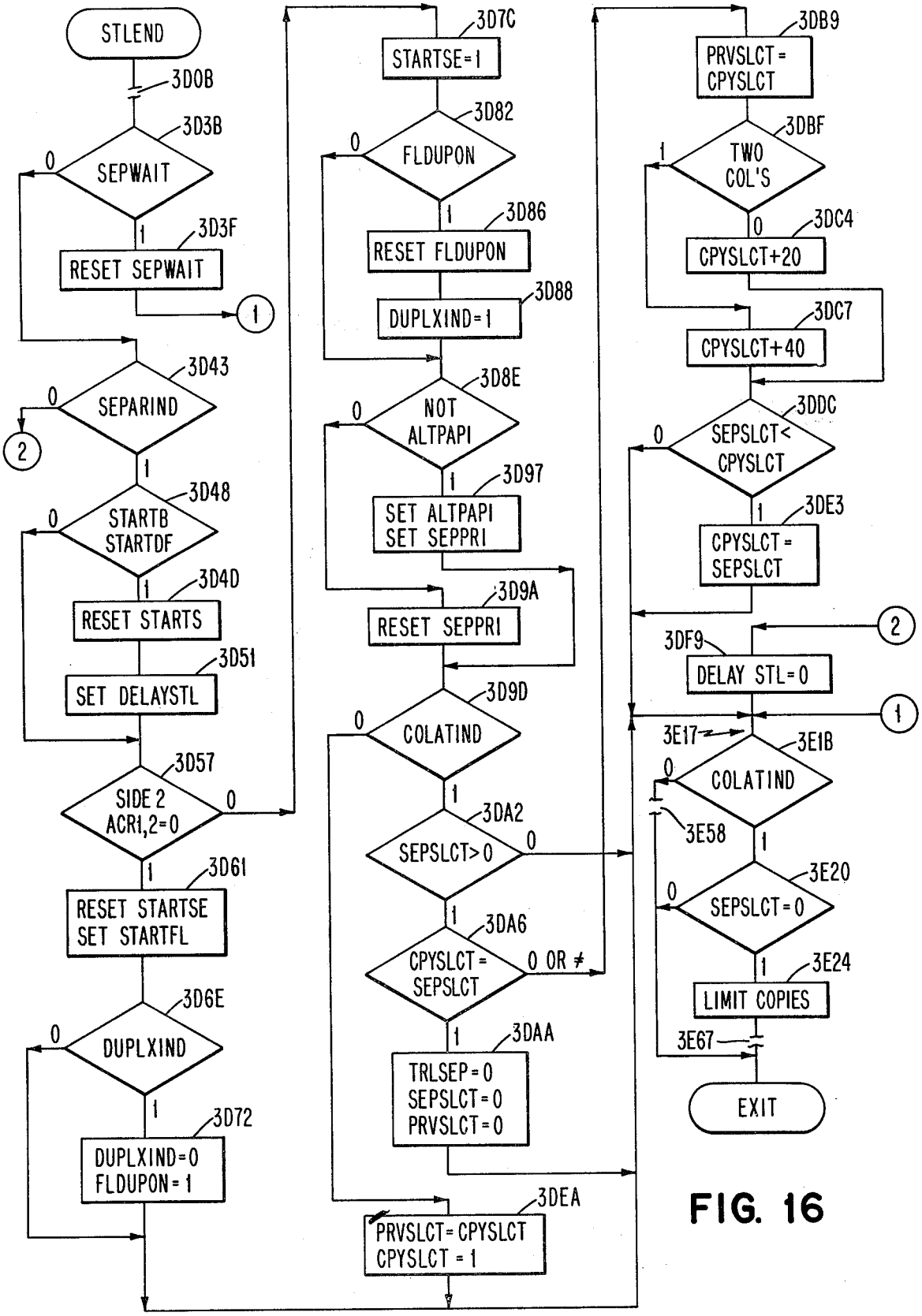

How the computer sets start latch (STARTL) is flow charted in FIG. 15 with the source code being shown in Table III. The program is invoked in response to the actuation of the start button on panel 52 or the insertion of an original document into SADF 11. It is to be understood that before a start latch in a copy production machine is activated, several things must be performed and achieved that are not pertinent to the separation mode. For example, nonpertinent code is included at diverse memory locations, such as at 3CF7, 3E6F, 3FD4 and 4000. As to the pertinent code, the computer checks at 3CFA for whether the copy selection is equal to zero. If it is zero, then the minimum run for copy production should be unity; therefore, the computer sets the copy select to one at 3D01. The end flag, (signal stored in store 172), i.e., signifying the end of a copy producing run, is checked at 3D04. This indicates whether a normal end was achieved by the previous run. If so, the FIG. 16 illustrated program STLEND identified as 3D0B is executed as later described.

Before permitting copy production to ensue, the computer resets the enable flag at 3ED1. The enable flag being reset tells the computer not to honor any selections from pane 52, the sole exception being the stop button for stopping copy production machine 10. Then the computer checks for previous status at 3ED6, i.e., whether the flush flag is on. If the flush flag is on this means copies in ISU 40 must be transported to the output portion 14 without receiving any images. If this flag is active then the computer at 3EDB sets the flush standby flag to unity, selects the ISU as the source of copy sheets for being transported to output portion 14 and turns the document lamp off. The document lamp (not shown) scans the original document on the platen (not shown) of SADF 11 for transferring an optical image to photoconductor drum 20. After this step, the computer proceeds to sense at 3F4C whether the start latch is active. If the start latch is already set, then at 3F51 the computer sets the so-called copy register CR (not shown) within the working memory 172 and looks for a first so-called sync and a first emit pulse from emitter wheel 46. These pulses are timing pulses servoing control 53 to drum 20 rotation. The status of the CR register is not pertinent to the operation of the separation mode but it is important in copy production. Since machine state registers are so well known in copy production machines, further discussion is dispensed with.

After the above steps and executing nonpertinent code at 3FD4, the computer sets the button select time indicator SLCTTM to zero, i.e., the time is reset such that a button depression timeout can be initiated. Then at 3FDD the start button is sensed to whether it is active. If so, the STARTH flag in memory 172 is set at 3FE1. Then the momentary run button MRB is sensed at 3FE7 (MRB is not shown in the drawing). If MRB is active then the flag MOMRUNH is set indicating that the momentary run button has been actuated. Then at 3FEF the computer resets all the recopy lights (not shown) which indicate to the operator the number of documents to be recopied for error recovery and then resets the latch STARTS in memory 172. The various start latches are "program flags" for synchronizing the startup procedure and each occupies one bit position (latch) in a register within memory 172. Then the computer can exit the program via the nonpertinent code at 4000.

By the instruction at 3ED6, if no flush operation is to be performed, then the instruction at 3EF4 determines whether a separation mode is to be started (STARTSE). If not, the instruction 3F1F sets the enable flag for allowing the operator to insert operator parameters via panel 52. Then at 3F25 the computer checks to see whether SADF 11 is busy. If it is not busy then the flag INHFD1 is set at 3F29. INHFD1 indicates that an operator has lifted the lid (not shown) of SADF 11 and can manually place an original to be copied on the platen (not shown) of SADF 11, i.e., the SADF 11 is not used for transporting an original document in the ensuing copy production run. Otherwise, the SADF is being used. In either case the status of the main drive motor (not shown) for machine 10 is sensed at 3F2D. If the motor has been turned on, then the document lamp (not shown) is turned on at 3F31 for scanning the original document which is in copying position within SADF 11, whether manually inserted or semiautomatically inserted.

If the drive is still off at 3F2D, then the computer checks for a side 2 indicator at 3F3E. If the side 2 is to be produced, i.e., ISU 40 is to be the source of the copy sheets for duplex copy production, then the computer at 3F42 selects ISU 40 as a source of copy sheets. If it is not side 2, then it must be side 1. The copies to be produced in an ensuing copy production run will either be the first portion of a simplex run or be directed to the interim storage unit 40 as partially completed duplex copies. In either event, the backup register of memory 172 is reset to all zeros at 3F49 for indicating that the original document in SADF 11 to be scanned by the document lamp turned on at 3F31 is the first image in a possible series of images being copied. From 3F49 the computer executes the code beginning at 3F4C as previously described.

When separation mode flag indicates a separation run is to be performed, then at 3EF9 the computer sets SEPACTV to "1" for indicating separation mode is active. The computer then checks at 3EFD to see whether the alternate paper supply 54 has been selected. If it has already been selected, then separation standby flag SEPSDBY is set at 3F01. On the other hand, if the alternate paper has not yet been selected, STARTSE is reset at 3F08 requiring the alternate paper supply 54 to be selected before the separation mode can ensue. At 3F12 the computer turns off the document lamp (not shown) since no copy images are to be transferred. Then the computer finally reaches 3F4C in the program as above described.

All of the above program instructions are is shown below in Table III.

TABLE III

SET START LATCH

| LOC | OBJ | OP1 | OP2 | SOURCE STATEMENT | | |
|---|---|---|---|---|---|---|
| | | | | - NONPERTINENT CODE - | | |
| | | | | 2. . IF | COPY SELECT =0 | |
| 3CFA | 24 | | | CLA | | |
| CFB | A009 | 0009 | | CB | CPYSLLO | |
| 3CFD | 64 | 3D)4 | | JNZ | STAR025 | |
| 3CFE | A019 | 0019 | | CB | CPYSLHI | |
| 3D00 | 64 | 3D04 | | JNZ | STAR025 | |
| | | | | 2. . THEN | | |
| | | | | 3. . . | SET COPY SELECT =1 | |
| 3D01 | 2E | | | A1 | | |
| 3D02 | A109 | 0009 | | STB | CPYSLLO | |
| | | | | 2. . ENDIF | | |
| | | | | STAR025 EQU | * | |
| | | | | 2. . IF | END (PREVIOUS RUN COMPLETED NORMALLY) | |
| 3D04 | A643 | 0043 | | LB | PSB03 | |
| 3D06 | B7 | 0007 | | TR | END | |
| 3D07 | 6B | 3D0B | | JNZ | STAR031X | |
| 3D08 | 30D13E | 3ED1 | 0000 | BU | STAR031,R0 | |

TABLE III-continued

SET START LATCH

| LOC | OBJ | OP1 | OP2 | SOURCE STATEMENT |
|---|---|---|---|---|
| | | | | 2. . THEN |
| | | | | STAR031X EQU * |
| | | | | 3. . . PROCESS STEND PERFORMS CODE REQUIRED |
| | | | | WHEN STARTL IS SET & END IS ON |
| | | | | - SEE TABLE XX - |
| | | | | STAR031 EQU * |
| | | | | 2. . RESET ENABLED |
| | | | | TRB PSB42,ENABLED |
| 3ED1 | A66A | 006A | | |
| 3ED3 | B7 | 0007 | | |
| 3ED4 | A16A | 006A | | |
| | | | | 2. . IF FLUSH |
| | | | | TPB PSB07,FLUSH |
| 3ED6 | A647 | 0047 | | |
| 3ED8 | 91 | 0001 | | |
| 3ED9 | 3DF4 | 3EF4 | | BZ STAR034 |
| | | | | 2. . THEN |
| | | | | 3. . . SET FLUSH PLEASE STANDBY |
| | | | | TSB PSB19,FLSHPLSB |
| 3EDB | A653 | 0053 | | |
| 3EDD | AF04 | 0002 | | |
| 3EDF | A153 | 0053 | | |
| | | | | 3. . . PICK DUPLEX TRUCK |
| | | | | TSB PCB02,DPLXTRCK |
| 3EE1 | A673 | 0073 | | |
| 3EE3 | AF04 | 0002 | | |
| 3EE5 | A173 | 0073 | | |
| | | | | 3. . . TURN OFF DOCUMENT LAMP |
| | | | | TRB PCB12,DOCLAMP |
| 3EE7 | A67C | 007C | | |
| 3EE9 | B4 | 0004 | | |
| 3EEA | A17C | 007C | | |
| | | | | 3. . . TURN OFF ALL EDGE ERASE LAMPS (ERS0, ERS1, ERS2, ERS3, |
| | | | | B4ERS3, B4ERSR1, B4ERSR2) |
| | | | | TRMB PCB01,P(ERS0,ERS1,ERS2,ERS3,B4ERS3,BR34SR1,B4ERSR2) |
| 3EEC | A672 | 0072 | | |
| 3EEE | AB01 | 0001 | | |
| 3EF0 | A712 | 0072 | | |
| 3EF2 | 244C | 3F4C | | B STARC00 |
| | | | | 2. . ELSE |
| | | | | STAR034 EQU * |
| | | | | 3. . . IF STARTSE |
| | | | | TPB PSB07,STARTSE |
| 3EF4 | A647 | 0047 | | |
| 3EF6 | 97 | 0007 | | |
| 3EF7 | 351F | 3F1F | | BZ STAR034A |
| | | | | 3. . . THEN |
| | | | | 4. . . . SET SEPACTV |
| 3EF9 | AF08 | 0003 | | TS SEPACTV |
| 3EFB | A147 | 0047 | | STB PSB07 |
| | | | | 4. . . . IF PAPER PRESENT IN ALTERNATE BIN (CHECK PAPER PRESENT |
| | | | | SW DIRECTLY) |
| | | | | RIN CSB04 |
| 3EFD | A6C3 | 00C3 | | |
| 3EFF | 97 | 0007 | | TP ALTPRES |
| 3F00 | 48 | 3F08 | | JZ STARI01 |
| | | | | 4. . . . THEN |
| | | | | 5. . . . . SET SEPSTBY |
| | | | | TSB PLSTNDBY,SEPSTBY |
| 3F01 | A653 | 0053 | | |
| 3F03 | AF20 | 0005 | | |
| 3F05 | A153 | 0053 | | |
| 3F07 | 02 | 3F12 | | J STARI02 |
| | | | | 4. . . . ELSE |
| | | | | STARI01 EQU * |
| | | | | 5. . . . . RESET STARTSE, STARTL |
| | | | | TRB PSB22,STARTL |
| 3F08 | A656 | 0056 | | |
| 3F0A | B6 | 0006 | | |
| 3F0B | A156 | 0056 | | |
| | | | | TRB PSB07,STARTSE |
| 3F0D | A647 | 0047 | | |
| 3F0F | B7 | 0007 | | |
| 3F10 | A147 | 0047 | | |
| | | | | 4. . . . ENDIF |
| | | | | STARTI02 EQU * |
| | | | | 4. . . . TURN OFF DOCUMENT LAMP |
| | | | | TRB PCB12,DOCLAMP |
| 3F12 | A67C | 007C | | |
| 3F14 | B4 | 0004 | | |

TABLE III-continued

SET START LATCH

| LOC | OBJ | OP1 | OP2 | SOURCE STATEMENT |
|---|---|---|---|---|
| 3F15 | A17C | 007C | | |
| | | | | 4. . . . TURN OFF ALL EDGE ERASE LAMPS (ERS0, ERS1, ERS2, ERS3, B4ERS3, B4ERSR1, B4ERSR2) |
| | | | | TRMB PCB01,P(ERS1,ERS2,ERS3,B4ERS3,B4ERSR1,B4ERSR2) |
| 3F17 | A672 | 0072 | | |
| 3F19 | AB01 | 0001 | | |
| 3F1B | A172 | 0072 | | |
| 3F1D | 2C4C | 3F4C | | B STARC00 |
| | | | | 3. . . ELSE |
| | | | | STAR034A EQU * |
| | | | | 4. . . . SET ENABLED |
| | | | | TSB PSB42,ENABLED |
| 3F1F | A66A | 006A | | |
| 3F21 | AF80 | 0007 | | |
| 3F23 | A16A | 006A | | |
| | | | | 4. . . . IF .SADFBUSY |
| | | | | TPB PSB31,SADFBUSY |
| 3F25 | A65F | 005F | | |
| 3F27 | 93 | 0003 | | |
| 3F28 | 6D | 3F2D | | JNZ STAR034B |
| | | | | 4. . . . THEN |
| | | | | 5. . . . . SET INHFD1 |
| 3F29 | AF20 | 0005 | | TS INHFD1 |
| 3F2B | A15F | 005F | | STB PSB31 |
| | | | | 4. . . . ENDIF |
| | | | | STAR034B EQU * |
| | | | | 4. . . . IF DRIVE |
| | | | | TPB PSB21,DRIVE |
| 3F2D | A655 | 0055 | | |
| 3F2F | 90 | 0000 | | |
| 3F30 | 4E | 3F3E | | JZ STAR049 |
| | | | | 4. . . . THEN |
| | | | | 5. . . . . OUTPUT - TURN ON DOCUMENT LAMP |
| | | | | TSB PCB12,DOCLAMP |
| 3F31 | A67C | 007C | | |
| 3F33 | AF10 | 0004 | | |
| 3F35 | A17C | 007C | | |
| | | | | - NONPERTINENT INSTRUCTION - |
| 3F37 | A66F | 006F | | |
| 3F39 | AF10 | 0004 | | |
| 3F3B | A16F | 006F | | |
| 3F3D | 0C | 3F4C | | |
| | | | | 4. . . . ELSE |
| | | | | STAR049 EQU * |
| | | | | 5. . . . . IF SIDE-2 |
| | | | | TPB PSB20,DPXSIDE2 |
| 3F3E | A654 | 0054 | | |
| 3F40 | 95 | 0005 | | |
| 3F41 | 49 | 3F49 | | JZ STAR032A |
| | | | | 5. . . . . THEN |
| | | | | 6. . . . . PICK DUPLEX TRUCK |
| | | | | TSB PCB02,DPLXTRCK |
| 3F42 | A673 | 0073 | | |
| 3F44 | AF04 | 0002 | | |
| 3F46 | A173 | 0073 | | |
| 3F48 | 0C | 3F4C | | J STAR032B |
| | | | | 5. . . . . ELSE |
| | | | | STAR032A EQU * |
| | | | | 6. . . . . BACKUP=0 |
| 3F49 | 25 | | | CLA |
| 3F4A | A16C | 006C | | STB BACKUP |
| | | | | 5. . . . . ENDIF |
| | | | | STAR032B EQU * |
| | | | | 4. . . . ENDIF |
| | | | | STAR032 EQU * |
| | | | | 3. . . ENDIF |
| | | | | 2. . ENDIF |
| | | | | STARC00 EQU * |
| | | | | 1. ENDIF |
| | | | | STAR033 EQU * |
| | | | | 1. IF STARTL |
| | | | | TPB PSB22,STARTL |
| 3F4C | A656 | 0056 | | |
| 3F4E | 96 | 0006 | | |
| 3F4F | 3DD4 | 3FD4 | | BZ STARI00 |
| | | | | 1. THEN |
| | | | | 2. . PROCESS SETCR SETS APPROPRIATE CR BIT& 1ST SYNC & 1ST EMIT |
| | | | | - NONPERTINENT CODE - |
| | | | | 1. SLCTTM=0 -(PREVENTS NUMERIC SELECTION); NEWSLCT=1 |

TABLE III-continued

SET START LATCH

| LOC | OBJ | OP1 | OP2 | SOURCE STATEMENT |
|---|---|---|---|---|
| | | | | -(NEXT NUMERIC BUTTON IS 1ST) |
| 3FD6 | A66A | 006A | | LB PSB42 |
| 3FD8 | B1 | 0001 | | TR SLCTTM |
| 3FD9 | AF10 | 0004 | | TS NEWSLCT |
| 3FDB | A16A | 006A | | STB PSB42 |
| | | | | 1. IF STARTB |
| | | | | TPB PSB22,STARTB |
| 3FDD | A656 | 0056 | | |
| 3FDF | 95 | 0005 | | |
| 3FE0 | 47 | 3FE7 | | JZ STAR034C |
| | | | | 1. THEN |
| | | | | 2.. SETSTARTH (START BUTTON HONORED) |
| | | | | TSB PSB23,STARTH |
| 3FE1 | A657 | 0057 | | |
| 3FE3 | AF10 | 0004 | | |
| 3FE5 | A157 | 0057 | | |
| | | | | 1. ENDIF |
| | | | | STAR034C EQU * |
| | | | | 1. IF MOMRUNB |
| | | | | TPB PSB21,MOMRUNB |
| 3FE7 | A655 | 0055 | | |
| 3FE9 | 95 | 0005 | | |
| 3FEA | 4F | 3FEF | | JZ STAR024 |
| | | | | 1. THEN |
| | | | | 2.. MOMRUNH =1 (REQUIRES MOMRUN BUTTON TO BE RELEASED BEFORE STARTL CAN BE SET AGAIN) |
| 3FEB | AF08 | 0003 | | TS MOMRUNH |
| 3FED | A155 | 0055 | | STB PSB21 |
| | | | | 1. ENDIF |
| | | | | STAR024 EQU * |
| | | | | 1. RESET ALL RECOPY LIGHTS |
| | | | | TRMB PCB13,P(RECOPY1,RECOPY2,RECOPY3) |
| 3FEF | A67D | 007D | | |
| 3FF1 | AB7C | 007C | | |
| 3FF3 | A17D | 007D | | |
| | | | | 1. RESET STLREQ, STARTDF, STARTFL, STARTPC, STARTSE |
| | | | | TRMB PSB22,P(STLREQ,STARTDF,STARTFL,STARTPC) |
| 3FF3 | A656 | 0056 | | |
| 3FF7 | AB74 | 0074 | | |
| 3FF9 | A156 | 0056 | | |
| | | | | TRB PSB07,STARTSE |
| 3FFB | A647 | 0047 | | |
| 3FFD | B7 | 0007 | | |
| | | | | - NONPERTINENT CODE - |

FIG. 16 flow charts the start-up from normal end of a prior copy production run. As indicated at 3D0B, programming not pertinent to the function of the separation mode is executed in starting up from a normal end. Then the separate wait flag is checked at 3D3B. If it is active, it is reset at 3D3F, i.e., the computer now is conditioning copy production machine 10 to begin the separation mode. The SEPWAIT flag set at this point indicates that a trailing separator, that is, copies were being produced when the separate button 57 was actuated. From 3D3F the computer proceeds to instruction 3E1B for checking whether the collate mode is active. If not, some nonpertinent code is executed at 3E58 and the program exited. If collate had been selected, the computer checks at 3E20 whether the selection for the number of separation sheets is zero. If it is zero the program is exited. If not, then at 3E24 the number of separator sheets is limited to the selection of the next succeeding copy producing run provided the selection is not greater than forty for a two collator setup in the output portion 14 or greater than twenty for a single collator setup. If the copy selection is greater than 40 or 20, the selection for separate run is limited to the number of collator bins.

On the other hand, if SEPWAIT is not active the computer checks the separate indicator at 3D43. If SEPARIND=0, then at 3DF9 the computer resets the delay start latch, i.e., since there will be no separate run, copy production can ensue immediately. If SEPARIND=1 at 3D43, then the computer at 3D48 checks to see whether the start button had been actuated or whether or not a run had been initiated by starting SADF 11. If so, then at 3D4D all the start flags are reset and delay start is set at 3D51. At 3D57 the computer checks for side 2 of a duplex mode production and checks whether there are any copies in the paper path. This is achieved by checking the ACR 1 and 2 registers being equal to zero. ACR means automatic copy recovery and is essentially a software up/down count field for counting the transient copies in the copy path. If ACR1=ACR2=0, then the paper path is clear of copy sheets. If neither of these indicators is true, then at 3D7C separation mode start flag (STARTSE) is set to one. Then at 3D82 the computer checks to see whether the flush duplex light of panel 52 has been illuminated. At this point the computer knows that any flush was completed; therefore a separation run can be performed. The computer resets the FLDUPON indicator at 3D86 and sets the duplex indicator to one at 3D88. Then at 3D8E the computer checks whether alternate paper has been selected. If not, alternate paper is selected at 3D97. Furthermore, a flag SEPPRI indicates that copies were being made from the first paper supply or primary paper bin 35 and not from the alternate paper bin 54. At the end of separation mode the computer will sense for SEPPRI such that upon resumption of copy production the copy sheets will again be properly selected from first paper supply 35. If the alternate paper indicator had already been selected, then at 3D9A SEPPRI would be reset, i.e., the operator had selected the copies to be made from sheets residing in second paper supply 54. Then at 3D9D the computer checks for collator selection. If not selected, i.e., the separation mode is to run in a noncollate mode, then the copy select is equal to one such that one separator sheet will be supplied from the alternate paper bin supply 54 to output tray 14A. On the other hand, if the collator indicator is active then at 3DA2 the computer checks to see whether the separation mode selection is greater than zero. If not (SEPSLCT=0), no more needs to be done and the instructions beginning at 3E1B are executed as above described. On the other hand, if the separate select is greater than zero, then at 3DA6 the computer checks to see whether the copy select, i.e., the selection made by the operator, is equal to the separation select. If not, (CPYSLCT ≠ SEPSLCT) at 3DB9, the previous separation select for the separation mode, is made equal to the copy selection. Then at 3DBF the computer checks to see whether there are two collators. If not, the copy select is increased by twenty at 3DC4, if there are two collators then the copy select is increased by forty at 3DC7. This action enables control 53 to display cumulative copy production for a copy production job that is segmented via the separation mode. This cumulative copy count indicates to an operator how far job execution has progressed.

At 3DDC the computer checks to see whether the separation mode selection is less than the copy selection. If not, the instruction at 3E1B, as mentioned above, is executed. If so, the instruction at 3DE3 enables the computer to make the copy selection equal to the separation mode selection. This action indicates that the last job segment has not yet been reached.

On the other hand, at 3DA6 if the copy select was equal to the separation mode select, the instruction beginning at 3DAA enables the computer to reset the trailing separator flag to zero, sets the separate select to zero, and sets the previous selection for the separation mode to zero. This action indicates that the last segment of the copy job is to be performed next.

All of the above-described functions are set forth in detail in Table IV below.

TABLE IV

START LATCH AFTER END

| LOC | OBJ | OP1 | OP2 | SOURCE STATEMENT |
|---|---|---|---|---|
| | | | | - NONPERTINENT CODE - |
| | | | | 1. IF SEPWAIT |
| 3D3B | A641 | 0041 | | LB PSB01 |
| 3D3D | B5 | 0005 | | TR SEPWAIT |
| 3D3E | 43 | 3D43 | | JZ STAS01 |
| | | | | 1. THEN |
| | | | | 2. . RESET SEPWAIT |
| 3D3F | A141 | 0041 | | STB PSB01 |
| 3D41 | 2CFE | 3DFE | | B STAS02 |
| | | | | 1. ELSE |
| | | 3D43 | | STAS01 DC * |
| | | | | 2. . IF SEPARIND |
| | | | | TPB PCB06,SEPARIND |
| 3D43 | A677 | 0077 | | |
| 3D45 | 92 | 0002 | | |
| 3D46 | 3DF9 | 3DF9 | | BZ STAS03 |
| | | | | 2. . THEN |
| | | | | 3. . . IF STARTB \|STARTDF |
| 3D48 | A656 | 0056 | | LB PSB22 |
| | | | | TSM P(STARTB,STARTDF) |
| 3D4A | AF28 | 0028 | | |
| 3D4C | 47 | 3D57 | | JZ STAS04 |
| | | | | 3. . . THEN |
| | | | | 4. . . . RESET STARTA,STARTB,STARTDF,STLREG |
| | | | | TRM P(STARTA,STARTB,STARTDF,STLREQ) |
| 3D4D | AB47 | 0047 | | |
| 3D4F | A156 | 0056 | | STB PSB22 |
| | | | | 4. . . . SET DELAYSTL |
| | | | | TSB PSB03,DELAYSTL |
| 3D51 | A643 | 0043 | | |
| 3D53 | AF04 | 0002 | | |
| 3D55 | A143 | 0043 | | |
| | | | | 3. . . ENDIF |
| | | 3D57 | | STAS04 DC * |
| | | | | 3. . . IF SIDE 2 &(ACR1,ACR2=0) |
| | | | | TPB PSB20,DPXSIDE2 |
| 3D57 | A654 | 0054 | | |
| 3D59 | 95 | 0005 | | |
| 3D5A | 3D7C | 3D7C | | BZ STAS05 |
| 3D5C | 25 | | | CLA |
| 3D5D | A40E | 000E | | AB ACRREGLO |
| 3D5F | 3C7C | 3D7C | | BNZ STAS05 |
| | | | | 3. . . THEN |
| | | | | 4. . . . RESET STARTSE, SET FLUSH,STARTFL |
| 3D61 | A647 | 0047 | | LB PSB07 |
| 3D63 | B7 | 0007 | | TR STARTSE |
| 3D64 | AF02 | 0001 | | TS FLUSH |
| 3D66 | A147 | 0047 | | STB PSB07 |
| | | | | TSB PSB22,STARTFL |

TABLE IV-continued

| LOC | OBJ | OP1 | OP2 | START LATCH AFTER END<br>SOURCE STATEMENT |
|---|---|---|---|---|
| 3D68 | A656 | 0056 | | |
| 3D6A | AF01 | 0000 | | |
| 3D6C | A156 | 0056 | | |
| | | | | 4. . . . IF DUPLEX LIGHT |
| 3D6E | A676 | 0076 | | LB PCB05 |
| 3D70 | B2 | 0002 | | TR DPLXIND |
| 3D71 | 4A | 3D7A | | JZ STAS05L |
| | | | | 4. . . . THEN |
| | | | | 5. . . . . TURN DUPLEX LIGHT OFF |
| 3D72 | A176 | 0076 | | STB PCB05 |
| | | | | 5. . . . . SET FLDUPON |
| | | | | TSB PSB06,FLDUPON |
| 3D74 | A646 | 0046 | | |
| 3D76 | AF02 | 0001 | | |
| 3D78 | A146 | 0046 | | |
| | | | | 4. . . . ENDIF |
| | | | | STAS05L EQU * |
| 3D7A | 2CF8 | 3DF8 | | B STAS06 |
| | | | | 3. . . ELSE |
| | | 3D7C | | STAS05 DC * |
| | | | | 4. . . . SET STARTSE |
| | | | | TSB PSB07,STARTSE |
| 3D7C | A647 | 0047 | | |
| 3D7E | AF80 | 0007 | | |
| 3D80 | A147 | 0047 | | |
| | | | | 4. . . . IF FLDUPON |
| 3D82 | A646 | 0046 | | LB PSB06 |
| 3D84 | B1 | 0001 | | TR FLDUPON |
| 3D85 | 4E | 3D8E | | JZ STAS05M |
| | | | | 4. . . . THEN |
| | | | | 5. . . . . RESET FLDUPON |
| 3D86 | A146 | 0046 | | STB PSB06 |
| | | | | 5. . . . . TURN ON DUPLEX LIGHT |
| | | | | TSB PCB05,DPLXIND |
| 3D88 | A676 | 0076 | | |
| 3D8A | AF04 | 0002 | | |
| 3D8C | A176 | 0076 | | |
| | | | | 4. . . . ENDIF |
| | | | | STAS05M EQU * |
| | | | | 4. . . . IF ¬ALTBIN LIGHT |
| | | | | TSB PCB05,ALTPAPI |
| 3D8E | A676 | 0076 | | |
| 3D90 | AF02 | 0001 | | |
| 3D92 | A176 | 0076 | | |
| 3D94 | A645 | 0045 | | LB PSB05 |
| 3D96 | 6A | 3D9A | | JNZ STAS07 |
| | | | | 4. . . . THEN |
| | | | | 5. . . . . SET ALT BIN LIGHT |
| | | | | 5. . . . . SET SEPPRI |
| 3D97 | AF08 | 0003 | | TS SEPPRI |
| 3D99 | 0B | 3D9B | | J STAS08 |
| | | | | 4. . . . ELSE |
| | | 3D9A | | STAS07 DC * |
| | | | | 5. . . . . RESET SEPPRI |
| 3D9A | B3 | 0003 | | TR SEPPRI |
| | | 3D9B | | STAS08 DC * |
| 3D9B | A145 | 0045 | | STB PSB05 |
| | | | | 4. . . . ENDIF |
| | | | | 4. . . . IF COLLATOR LIGHT |
| | | | | TPB PCB06,COLATIND |
| 3D9D | A677 | 0077 | | |
| 3D9F | 91 | 0001 | | |
| 3DA0 | 3DEA | 3DEA | | BZ STX01 |
| | | | | 4. . . . THEN |
| | | | | 5. . . . . IF SEPSLCT>0 |
| 3DA2 | 25 | | | CLA |
| 3DA3 | D9 | 0009 | | AR SEPSLCT |
| 3DA4 | 3DE9 | 3DE9 | | BZ STX02 |
| | | | | 5. . . . . THEN |
| | | | | 6. . . . . IF CPYSLCT = SEPSLCT |
| | | | | SRG INTHRG |
| 3DA6 | A9C8 | 00C8 | | |
| 3DA8 | C9 | 0009 | | SR CPYSLCT |
| 3DA9 | 69 | 3DB9 | | JNZ STX03 |
| | | | | 6. . . . . THEN |
| | | | | 7. . . . . SET TRLSEP,SEPSLCT, PRVSLCT=0 |
| | | | | SRG COLRG |
| 3DAA | A9D0 | 00D0 | | |
| 3DAC | 8A | 000A | | STR PRVSLCT |
| | | | | SRG BASERG |

TABLE IV-continued

| LOC | OBJ | OP1 | OP2 | START LATCH AFTER END SOURCE STATEMENT |
|---|---|---|---|---|
| 3DAD | A9C9 | 00C9 | | |
| | | | | TSB PSB43,TRLSEP |
| 3DAF | A66B | 006B | | |
| 3DB1 | AF80 | 0007 | | |
| 3DB3 | A16B | 006B | | |
| 3DB5 | 25 | | | CLA |
| 3DB6 | 89 | 0009 | | STR SEPSLCT |
| 3DB7 | 2CE9 | 3DE9 | | B STX06 |
| | | | | 6..... ELSE |
| | | | | STX03 EQU * |
| | | | | 7..... PRVSLCT= CPYSLCT |
| 3DB9 | E9 | 0009 | | LR CPYSLCT |
| | | | | SRG C0LRG |
| 3DBA | A9D0 | 00D0 | | |
| 3DBC | 8A | 000A | | STR PRVSLCT |
| | | | | SRG INTHRG |
| 3DBD | A9C8 | 00C8 | | |
| | | | | 7..... IF ¬MD2PRES |
| | | | | RIN CSB14 |
| 3DBF | A6D5 | 00D5 | | |
| 3DC1 | 96 | 0006 | | TP MD2PRES |
| 3DC2 | 25 | | | CLA |
| 3DC3 | 67 | 3DC7 | | JNZ STXC2 |
| | | | | 7..... THEN |
| | | | | 8..... CPYSLCT=CPYSLCT+ 20 |
| 3DC4 | AE20 | 0020 | | LI X'20' |
| 3DC6 | 09 | 3DC9 | | J STXC3 |
| | | | | 7..... ELSE |
| | | 3DC7 | | STXC2 DC * |
| | | | | 8..... CPYSLCT=CPYSLCT+ 40 |
| 3DC7 | AE40 | 0040 | | LI X'40' |
| | | | | 7..... ENDIF |
| 3DC9 | D9 | 0009 | | STXC3 AR CPYSLCT |
| 3DCA | 89 | 0009 | | STR CPYSLCT |
| 3DCB | 25 | | | CLA |
| 3DCC | A609 | 0009 | | LB CPYSLLO |
| 3DCE | ABF0 | 00F0 | | NI X'F0' |
| 3DD0 | AAA0 | 00A0 | | SI X'A0' |
| | | | | JL STXC4 |
| 3DD2 | 3FD5 | 3DD5 | | |
| 3DD4 | 0C | 3DDC | | |
| 3DD5 | A109 | 0009 | | STB CPYSLLO |
| 3DD7 | A619 | 0019 | | LB CPYSLHI |
| 3DD9 | 2E | | | A1 |
| 3DDA | A119 | 0019 | | STB CPYSLHI |
| | | 3DDC | | STXC4 DC * |
| | | | | 7..... IF SEPSLCT<CPYSLCT |
| 3DDC | E9 | 0009 | | LR CPYSLCT |
| | | | | SRG BASERG |
| 3DDD | A9C9 | 00C9 | | |
| 3DDF | C9 | 0009 | | SR SEPSLCT |
| | | | | JL STXC7 |
| 3DE0 | 3FE3 | 3DE3 | | |
| 3DE2 | 09 | 3DE9 | | |
| | | | | 7..... THEN |
| | | | | 8..... CPYSLCT=SEPSLCT |
| 3DE3 | E9 | 0009 | | LR SEPSLCT |
| 3DE4 | A109 | 0009 | | STB CPYSLLO |
| 3DE6 | 29 | | | TRA |
| 3DE7 | A119 | 0019 | | STB CPYSLHI |
| | | | | 7..... ENDIF |
| | | | | STXC7 EQU * |
| | | | | 6..... ENDIF |
| | | | | STX06 EQU * |
| | | | | 5..... ENDIF |
| 3DE9 | 08 | 3DF8 | | STX02 J STX05 |
| | | | | 4.... ELSE |
| | | | | STX04 EQU * |
| | | | | 5..... PRVSLCT=CPYSLCT |
| | | | | SRG INTHRG |
| 3DEA | A9C8 | 00C8 | | |
| 3DEC | E9 | 0009 | | LR CPYSLCT |
| | | | | SRG COLRG |
| 3DED | A9D0 | 00D0 | | |
| 3DEF | 8A | 000A | | STR PRVSLCT |
| | | | | SRG BASERG |
| 3DF0 | A9C9 | 00C9 | | |
| | | | | 5..... CPYSLCT=1 |
| 3DF2 | 25 | | | CLA |
| 3DF3 | A119 | 0019 | | STB CPYSLHI |

TABLE IV-continued

START LATCH AFTER END

| LOC | OBJ | OP1 | OP2 | SOURCE STATEMENT |
|---|---|---|---|---|
| 3DF5 | 2E | | | A1 |
| 3DF6 | A109 | 0009 | | STB CPYSLLO |
| | | | | 4. . . . ENDIF |
| | | | | STX05 EQU * |
| | | | | 3. . . ENDIF |
| | | 3DF8 | | STAS06 DC * |
| 3DF8 | 0E | 3DFE | | J STAS09 |
| | | | | 2. . ELSE |
| | | 3DF9 | | STAS03 DC * |
| | | | | 3. . . RESET DELAYSTL |
| | | | | TRB PSB03,DELAYSTL |
| 3DF9 | A643 | 0043 | | |
| 3DFB | B2 | 0002 | | |
| 3DFC | A143 | 0043 | | |
| | | | | 2.. ENDIF |
| | | 3DFE | | STAS09 DC * |
| | | | | 1. ENDIF |
| | | | | - NONPERTINENT CODE - |
| | | | | 2. . IF COLLATE LIGHT |
| | | | | TPB PCB06,COLATIND |
| 3E1B | A677 | 0077 | | |
| 3E1D | 91 | 0001 | | |
| 3E1E | 3D58 | 3E58 | | BZ STARXX4 |
| | | | | 2. . THEN |
| | | | | 3. . . IF SEPSLCT=0 |
| 3E20 | 25 | | | CLA |
| 3E21 | D9 | 0009 | | AR SEPSLCT |
| 3E22 | 3C50 | 3E50 | | BNZ STARM01 |
| | | | | 3. . . THEN |
| | | | | 4. . . . IF CPYSLCT > 20 (40 IF MOD 2 PRESENT) |
| 3E24 | 25 | | | CLA |
| | | | | RIN CSB14 |
| 3E25 | A6D5 | 00D5 | | |
| 3E27 | 96 | 0006 | | TP MD2PRES |
| 3E28 | AE20 | 0020 | | LI X'20' |
| 3E2A | 4D | 3E2D | | JZ STARM02 |
| 3E2B | AE40 | 0040 | | LI X'40' |
| | | | | STARM02 SRG INTHRG |
| 3E2D | A9C8 | 00C8 | | |
| 3E2F | C9 | 0009 | | SR CPYSLCT |
| 3E30 | E9 | 0009 | | LR CPYSLCT |
| | | | | SRG BASERG |
| 3E31 | A9C9 | 00C9 | | |
| 3E33 | 3F37 | 3E37 | | BNL STARM03 |
| | | | | 4. . . . THEN |
| | | | | 5. . . . . SEPSLCT = CPYSLCT |
| 3E35 | 89 | 0009 | | STR SEPSLCT |
| 3E36 | 0C | 3E3C | | J STARM05 |
| | | | | 4. . . . ELSE |
| | | | | STARM03 EQU * |
| | | | | 5. . . . . PRVSLCT = CPYSLCT |
| | | | | SRG COLRG |
| 3E37 | A9D0 | 00D0 | | |
| 3E39 | 8A | 000A | | STR PRVSLCT |
| | | | | SRG BASERG |
| 3E3A | A9C9 | 00C9 | | |
| | | | | 4. . . . ENDIF |
| | | | | STARM05 EQU * |
| | | | | 4. . . . LIMIT SELECTION TO 40 OR 20 |
| | | | | (MOD2 PRESENT OR NOT PRESENT) |
| 3E3C | 25 | | | CLA |
| | | | | RIN CSB14 |
| 3E3D | A6D5 | 00D5 | | |
| 3E3F | 96 | 0006 | | TP MD2PRES |
| 3E40 | AE40 | 0040 | | LI X'40' |
| 3E42 | 65 | 3E45 | | JNZ STARC02 |
| 3E43 | AE20 | 0020 | | LI X'20' |
| 3E45 | 80 | 0000 | | STARC02 STR R0 |
| | | | | SRG INTHRG |
| 3E46 | A9C8 | 00C8 | | |
| 3E48 | C9 | 0009 | | SR CPYSLCT |
| 3E49 | 3F4F | 3E4F | | BNL STARM04 |
| 3E4B | 25 | | | CLA |
| 3E4C | A620 | 0120 | | LBL BASEROLD |
| 3E4E | 89 | 0009 | | STR CPYSLCT |
| 3E4F | 06 | 3E56 | | STARM04 J STARM10 |
| | | | | 3. . . ELSE |
| | | | | STARM01 EQU * |
| | | | | 4. . . . CPYCTR = PRVSLCT |
| | | | | SRG COLRG |

TABLE IV-continued

| LOC | OBJ | OP1 | OP2 | START LATCH AFTER END<br>SOURCE STATEMENT |
|---|---|---|---|---|
| 3E50 | A9D0 | 00D0 | | |
| 3E52 | EA | 000A | | LR PRVSLCT |
| | | | | SRG INTHRG |
| 3E53 | A9C8 | 00C8 | | |
| 3E55 | 87 | 0007 | | STR CPYCTR |
| | | | | 3. . . ENDIF |
| 3E56 | 2C67 | 3E67 | | STARM10 B STARC03 |
| | | | | 2. . ELSE |
| | | | | STARXX4 EQU * |
| | | | | 3. . . IF DUPLEX |
| | | | | TPB PCB05,DPLXIND |
| 3E58 | A676 | 0076 | | |
| 3E5A | 92 | 0002 | | |
| 3E5B | 47 | 3E67 | | JZ STARXX1 |
| | | | | 3. . . THEN |
| | | | | 4. . . . LIMIT COPY SELECT TO 100 |
| 3E5C | AE01 | 0001 | | LI 1 |
| 3E5E | A019 | 0019 | | CB CPYSLHI |
| 3E60 | 3E67 | 3E67 | | BH STARXX1 |
| 3E62 | A119 | 0019 | | STB CPYSLHI |
| 3E64 | 25 | | | CLA |
| 3E65 | A109 | 0009 | | STB CPYSLLO |
| | | | | 3. . . ENDIF |
| | | | | STARXX1 EQU * |
| | | | | 2. . ENDIF |
| | | | | STARC03 SRG BASERG |
| 3E67 | A9C9 | 00C9 | | |
| 3E69 | A647 | 0047 | | |
| | | | | - NONPERTINENT CODE - |

Figure 17:
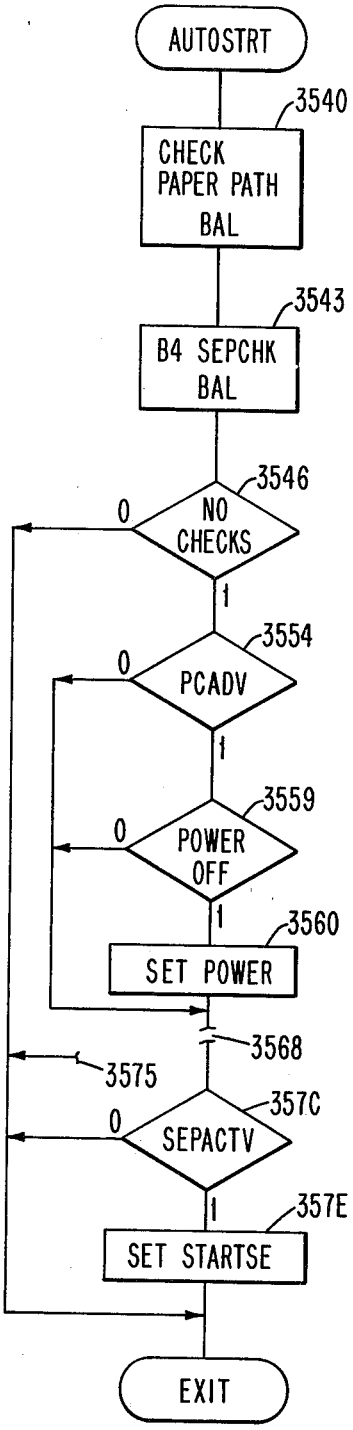
FIG. 17 is a flow chart showing SADF checking inhibits related to separation mode.

A start from a machine 10 interruption, such as by a copy sheet jam, is achieved through the autostart program shown in FIG. 17. The first step in this program is to check the paper path via a branch and link (BAL) instruction at 3540. The routine for checking the paper path is not shown for brevity. It consists of the control 53 computer scanning all of the sensing switches in the paper path of copy production machine 10 to ensure that all the paper has been removed from the paper path. Then a second branch and link at 3543 calls the B4 SEPCHK routine described with respect to FIG. 14. Upon return from the FIG. 14 illustrated code, the computer at 3546 determines whether there are any outstanding machine errors, such as check paper path, check collator, and the like. If there are no checks, the routine can be exited for entering SET STARTL of FIG. 16. If there are checks, the computer must then determine why copy production cannot resume. First the computer checks at 3554 to determine whether or not a photoconductor (PC) advance was interrupted. A photoconductor advance is an auxiliary operation moving new photoconductor into an imaging location such as shown in U.S. Pat. No. 3,588,242. If there was a PC advance, then at 3559 the computer checks to see whether a so-called secondary power relay (not shown) is off. Such secondary power relay provides power to the fuser 31 and the like. If it is off, a power indicator is set at 3560 for enabling the computer to turn power back on by another program (not shown). Then some nonpertinent code beginning at 3568 is executed. At 357C. SEPACTV is checked. If SEPACTV=1 when the abnormal end or interruption occurred, then the separation mode is restarted by setting the STARTSE flag at 357E. Other programs to be described sense for STARTSE for initiating separation mode. Techniques of ensuring that the right number of copies of separation sheets are to be produced and transferred through output portion 14 are not a part of the present invention and will not be described for that reason. Because of the diverse effects of starting from an abnormal end or interruption, it is to be understood that most of the code in the FIG. 7 illustrated program is nonpertinent to separation mode. This nonpertinent code is indicated by the arrow at 3575.

After the start latch has been set, the FIG. 18 illustrated asynchronous program relating to control of SADF 11 checks for SEPWAIT and the inhibits checked by a routine called by a branch and link at 488C. Such inhibits, in addition to separation wait, include some of the doors of copy production machine 10 being open, a flush occurring, copy recovery in progress, and the like. If SEPWAIT is not active (no inhibit), a branch instruction executed at 488F causes nonpertinent SADF code to be executed beginning either at 48DD; with SEPWAIT=1, nonpertinent SADF code beginning at 490D is executed. This code illustrates the close interaction of all the computer programs illustrated for executing the separation mode and the effect of status registers 263 in providing communications between asynchronous programs and synchronous programs 262. Table V below lists the pertinent STLEND source code instructions and Table VI lists the FIG. 18 code.

TABLE V

| LOC | OBJ | OP1 | OP2 | AUTOSTART<br>SOURCE STATEMENT |
|---|---|---|---|---|
| | | | | BEGIN AUTOSTRT ATTEMPT AN AUTO RESTART WHEN DOORS GO CLOSED |
| | | 3540 | | ORG AUTORG |
| | | | | 1. CALL PATHCHK GO CHECK PAPER PATH |
| 3540 | 32384D | 0002 | 4D38 | BAL R2,PATHCHK GO CHECK PAPER PATH |

TABLE V-continued

AUTOSTART

```
LOC   OBJ    OP1   OP2        SOURCE STATEMENT
                              1. CALL B4SEPCHK GO CHECK B4 SEPARATION
3543  33F854 0003  54F8          BAL   R3,B4SEPCHK
                                 1. IF ¬CPP & ¬CHKCOL
3546  25                         CLA
3547  A45D   005D                 AB   CPP
3549  3C82   3582               BNZ   MAC057
354B  A44D   004D                 AB   CPPE1
354D  3C82   3582               BNZ   MAC057
                                 TPB   PCB14,CKCOLTRI
354F  A67E   007E
3551  90     0000
3552  3C82   3582               BNZ   MAC057
                              1. THEN
                                2. . IF (PCADVNCE) ADVANCE WAS INTERRUPTED
                                 TPB   PCB02,PCADVNCE SEE IF ADVANCE
3554  A673   0073
3556  90     0000
3557  3D68   3568                 BZ   MAC053   * GO IF NO
                              2. . THEN
                                3. . . IF (¬RELAY2) SECONDARY RELAY IS OFF
3559  A9A0   00A0                 GI   INTOFF   MASK
355B  A67C   007C                 LB   PCB12   GET STATUS
355D  AF40   0006                 TS   RELAY2   SET RELAY2
355F  66     3566               JNZ   MAC052   * GO IF ALREADY ON
                              3. . . THEN
                                4. . . . OUTPUT RELAY2=1
3560  A17C   007C                 STB   PCB12   START RELAY
                                4. . . . SET MTRDLY=16 (130 MSEC)
3562  AE10   0010                 LI   16   SET DELAY
3564  A159   0059                 STB   MTRDLY   START TIMER
                                3. . . ENDIF
      3566                MAC052  DC   *
3566  A920   0020                 GI   INTON   UNMASK
                              2. . ENDIF
                              - NONPERTINENT CODE -
```

TABLE VI

SADF CODE

```
LOC   OBJ    OP1   OP2        SOURCE STATEMENT
                              - NONPERTINENT CODE -
                                4. . . . CALL CHKINH
                                 BAL   R1,CHKORG
                                4. . . . IF ¬(ANY INHIBITS FOUND ABOVE) & ¬(ACRREQ & (BACKUP>1
                                  | (BACKUP=1 & AUTOFLSH))) & INTLOCK & ¬INDF & ¬INHFD1
                                  & ¬INHFD2 & ¬INHFD3 & ¬COLL DOORS OPEN & PSBIND &
                                  ¬SADFBUSY & (¬ADDPAPER | CPYINDPI) & (¬SEPIND |
                                  SEPWAIT | ¬DRIVE) & ¬FLUSH & (¬SEPACTV | DRIVE)
488F  340C   490C                 BNZ   SADF27
                                 TPB   PSB01,ACRREQ
4891  A641   0041
4893  91     0001
4894  41     48A1                 JZ   SADF19B
4895  A66C   006C                 LB   BACKUP
4897  A801   0001                 CI   1
4899  360C   490C                 BH   SADF27
489B  61     48A1                 JNE   SADF19B
                                 TPB   PSB01,AUTOFLSH
489C  A641   0041
489E  92     0002
489F  340C   490C               BNZ   SADF27
      48A1                SADF19B DC   *
                                 RIN   CSB03   GET STATUS
48A1  A6C2   00C2
48A3  97     0007                 TP   INTLOCK   TEST FOR PLUGGABLE METER
48A4  350C   490C                 BZ   SADF27   *GO IF NO
48A6  A65F   005F                 LB   PSB31
48A8  ABF8   00F8                 NI   P1(INDF,INHFD1,INHFD2,SADFBUSY,INHFD3)
48AA  340C   490C               BNZ   SADF27
                                 SRG   COLRG
48AC  A9D0   00D0
48AE  A607   0007                 LB   CPSB02
                                 SRG   BASERG
48B0  A9C9   00C9
                                 TSM   P(COLDR12,COLDR22)
48B2  AF50   0050
48B4  340C   490C               BNZ   SADF27
                                 TPB   PCB13,PLSSTBY
```

TABLE VI-continued

SADF CODE

| LOC | OBJ | OP1 | OP2 | SOURCE STATEMENT |
|---|---|---|---|---|
| 48B6 | A67D | 007D | | |
| 48B8 | 96 | 0006 | | |
| 48B9 | 340C | 490C | | BNZ SADF27 |
| | | | | TPB PSB07,ADDPAPER |
| 48BB | A647 | 0047 | | |
| 48BD | 94 | 0004 | | |
| 48BE | 44 | 48C4 | | JZ SADF24A |
| | | | | TPB PCB13,CPYINDPI |
| 48BF | A67D | 007D | | |
| 48C1 | 93 | 0003 | | |
| 48C2 | 350C | 490C | | BZ SADF27 |
| | | 48C4 | | SADF24A DC * |
| | | | | TPB PCB06,SEPARIND |
| 48C4 | A677 | 0077 | | |
| 48C6 | 92 | 0002 | | |
| 48C7 | 41 | 48D1 | | JZ SADF24B *GO IF NOT SEPARATE INDICATOR |
| | | | | TPB PSB01,SEPWAIT |
| 48C8 | A641 | 0041 | | |
| 48CA | 95 | 0005 | | |
| 48CB | 61 | 48D1 | | JNZ SADF24B *GO IF YES |
| | | | | TPB JNZ |
| 48CC | A655 | 0055 | | |
| 48CE | 90 | 0000 | | |
| 48DF | 340C | 490C | | BNZ SADF27 *GO-CONDITIONS WERE NOT FAVORABLE |
| | | | | SADF24B EQU * |
| | | | | TPB PSB07,FLUSH |
| 48D1 | A647 | 0047 | | |
| 48D3 | 91 | 0001 | | |
| 48D4 | 340C | 490C | | BNZ SADF27 |
| 48D6 | 93 | 0003 | | TP SEPACTV |
| 48D7 | 4D | 48DD | | JZ SADF24C |
| | | | | TPB PSB21,DRIVE |
| 48D8 | A655 | 0055 | | |
| 48DA | 90 | 0000 | | |
| 48DB | 350C | 490C | | BZ SADF27 |
| | | | | 4. . . . THEN |
| | | | | - NONPERTINENT CODE - |
| | | | | (LOCATION 48DD) |
| | | | | 5. . . . . ELSE |
| | | | | - NONPERTINENT CODE - |
| | | | | (LOCATION 490C) |

The above-described programs illustrate the preparatory steps in the asynchronous programs necessary for starting a separation mode. Up to this point in time, the asynchronous programs have actually been executed several times, as conditions changed during separation mode preparation, different branches of the programs are correspondingly executed.

It should be noted that if a flush of interim storage unit 40 is required then any separation mode run waits until interim storage unit 40 is empty. When the start button has been pushed, sensed and honored, the photoconductor drum 20 rotates supplying emitter EC pulses from emitter wheel 46 as well as the fiducial or sync pulses. Such pulsing is detected via computer programming such that synchronous programs now are repetitively executed in synchronism with photoconductor drum 20 rotation. It should be remembered that for each rotation of photoconductor drum 20 each of the synchronous programs 262 will be executed twice. As a result of those repetitive executions the copy production machine 10 is synchronously operated while being simultaneoulsy asynchronously monitored and prepared for operation and stopping by the asynchronous programs 260, 261.

The synchronous programs 262 are executed in the priority over (interrupt) the asynchronous programs, i.e., when an EC pulse is received from emitter wheel 46 the respective synchronous program must be executed immediately for ensuring proper operation of copy production machine 10. The control exercised by the computer via the synchronous programs 262 is based upon a machine state field CR contained in status registers 263 and the timing pulses EC0–EC16 supplied by emitter wheel 46. In a constructed embodiment of the invention, the CR field contained eight bits, CR1 to CR8 plus some other bits not pertinent to understanding the operation of the synchronous program 262. Generally, the bit positions correspond to general functions of the copy production machine 10 with respect to transport of copy sheets through the paper. Other functions may be performed in accordance with the bit pattern; however, that is not important for the present discussion. In general, CR1 when active indicates a copy sheet should be picked from either the interim storage unit 40, first paper supply 35, or second paper supply 54. Machine functions indicated by bit CR2 are primarily preparatory steps to image transfer from photoconductor drum 20 to the copy sheet. Included in such preparatory steps are lamp control, magnetic brush checking, SADF 11 control, and the like. The bit position CR3, CR4 are primarily concerned with image transfer controls such as fuser opening and closing, early exit arrivals, detach of copy sheets from photoconductor drum 20 and the like. CR5 bit indicates certain post image-transfer housekeeping chores. Bits CR6, CR7 and CR8 are primarily related to collator controls. The computer is programmed to maintain machine status with respect to each copy sheet being transferred through the machine by inserting a binary one in the respective bit positions such that the associated machine functions can be appropriately performed. The meshing of the timing pulses EC0–EC16 with the CR fields follows the same timing control techniques used by prior relay control machines, such as the IBM Copier II manufactured by International Business Machines Corporation, Armonk, New York.

In the synchronous programs 262, the EC0 programming (FIG. 19) contains some the preparatory steps necessary for beginning an image cycle. As expected, many functions are performed during this particular synchronous program including nonpertinent code represented by 6DE9. Furthermore, because of the extremely high speed of program execution, the order of execution of synchronous programs 262 in some instances can be somewhat independent from the order in which the machine actually functions and the programs are executed several times for many individual functions of machine 10. For brevity and avoiding describing the program repetitions, the description will follow program execution rather than machine functions.

At 6E25 the computer checks to see whether the CR2 bit is one. If CR2=0, no pertinent action need be taken so the program is exited via the nonpertinent code at 6EBC. If CR2=1, certain pertinent preparatory steps have to be performed. Execution of this program assumes that a copy sheet has already been picked. After sensing CR2 active, the computer determines whether preconditioning is occurring at branch instruction 6E29. The term "preconditioning" is defined in copending, commonly assigned patent application Ser. No. 649,755, filed Jan. 15, 1976 and now U.S. Pat. No. 4,036,556. If preconditioning is occurring then no copy sheets will be transported and the EC0 code can be exited via the nonpertinent code at 6EBC. Otherwise the computer at 6E2E increments the copy-counter-save count field to be equal to the numerical contents of the copy counter field plus one. Then at 6E3F the computer checks to see whether there is a stop condition or an error condition. If there is, the program is exited via the nonpertinent code at 6EBC. If, on the other hand, the condition of the machine 10 is error-free, then the computer at 6E53 checks to see whether or not side 2 indicator is active, i.e., whether the next image transfer will be a side 2 of a duplex copy production run. If it is, then the computer must check at 6E58 to determine whether interim storage unit (ISU) 40 is not empty. If ISU 40 has copies in it, then the computer at 6E5D checks to see whether separation mode is present in the machine and whether the copy select (CNT) is greater than the collator capacity (COL). If those conditions are satisfied, then the collator overflow flag is set at 6E7A. This results in action that the copies being produced will be produced from the duplex tray with the excess copies not insertable into the collator being directed to copy output tray 14A. On the other hand, if the condition of branch 6E5D is not true, then bit CR1 is set to one at 6E7F in preparation for picking a copy sheet from a designated paper supply 35 or 54. On the other hand, if interim storage unit 40 is empty as detected at branch instruction 6E58, then the end flag is set at 6E89. Finally, nonpertinent code at 6E98 is executed before performing the branch at 6EA9 for detecting whether the copy-counter save-field is less than the copy select field. If it is less, this means copies are yet to be produced and CR1 is set to one at 6EAD. On the other hand, if counter save is not less than copy select the run is over and end flag is set at 6EB2. The program is exited via the nonpertinent code beginning with 6EBC.

The source code for the above flow chart is set forth below in Table VII.

TABLE VII

EC0 CODE

| LOC | OBJ | OP1 | OP2 | SOURCE STATEMENT |
|---|---|---|---|---|
| | | | | -NONPERTINENT CODE - |
| | | | | 2. . IF CR2 |
| 6E25 | E4 | 0004 | | LR CRREG CR REGISTERS' REGISTER |
| 6E26 | 96 | 0006 | | TP CR2 TEST IF CR2 IS ACTIVE |
| 6E27 | 3DB8 | 6EB8 | | BZ EC0E IF CR2 NOT ACTIVE BRANCH TO CR6 TEST |
| | | | | 2. . THEN |
| | | | | 3. . . IF ¬PRECOND |
| | | | | TPB PSB07,PRECOND |
| 6E29 | A647 | 0047 | | |
| 6E2B | 90 | 0000 | | |
| 6E2C | 3CB8 | 6EB8 | | BNZ EC0E |
| | | | | 3. . . THEN |
| | | | | 4. . . . CCTRSAVE=CPYCTR+ 1 |
| 6E2E | E7 | 0007 | | LR CPYCTR |
| 6E2F | 2E | | | A1 |
| 6E30 | 85 | 0005 | | STR CCTRSAVE |
| 6E31 | AB0F | 000F | | NI X'0F' |
| 6E33 | AB0A | 000A | | CI 10 |
| 6E35 | 6F | 6E3F | | JNE EC0D3A1 |
| 6E36 | E5 | 0005 | | LR CCTRSAVE |
| 6E37 | AC06 | 0006 | | AI 6 |
| 6E39 | A A0 | 00A0 | | CI X'A0' |
| 6E3B | 6E | 6E3E | | JNE EC0D3A |
| 6E3C | AC60 | 0060 | | AI X'60' |
| | | 6E3E | | EC0D3A DC * |
| 6E3E | 85 | 0005 | | STR CCTRSAVE |
| | | 6E3F | | EC0D3A1 DC * |
| | | | | 4. . . . IF ¬STOP2 &¬TNRFAIL &¬TNRCPP &¬COLSTOP |
| | | | | TPB PSB23,STOP2 |
| 6E3F | A657 | 0057 | | |
| 6E41 | 91 | 0001 | | |
| 6E42 | 3CB8 | 6EB8 | | BNZ EC0E |
| 6E44 | A65D | 005D | | LB CPP |
| | | | | TSM P(TNRFAIL,TNRCPP) |
| 6E46 | AF82 | 0082 | | |

TABLE VII-continued

EC0 CODE

| LOC | OBJ | OP1 | OP2 | SOURCE STATEMENT |
|---|---|---|---|---|
| 6E48 | 3CB8 | 6EB8 | | BNZ EC0E |
| | | | | SRG COLRG |
| 6E4A | A9D0 | 00D0 | | |
| | | | | TPB CPSB08,COLSTOP |
| 6E4C | A619 | 0019 | | |
| 6E4E | 97 | 0007 | | |
| | | | | SRG INTHRG |
| 6E4F | A9C8 | 00C8 | | |
| 6E51 | 3CB8 | 6EB8 | | BNZ EC0E |
| | | | | 4. . . . THEN |
| | | | | 5. . . . . IF SIDE 2 ACTIVE |
| | | | | TPB PSB20,DPXSIDE2 |
| 6E53 | A654 | 0054 | | |
| 6E55 | 95 | 0005 | | |
| 6E56 | 3DA9 | 6EA9 | | BZ EC0D3 |
| | | | | 5. . . . . THEN |
| | | 6E58 | | EC0D DC * |
| | | | | 6. . . . . IF COPIES IN DUPLEX |
| | | | | RIN CSB06 |
| 6E58 | A6C5 | 00C5 | | |
| 6E5A | 92 | 0002 | | TP CPYINDP |
| 6E5B | 3D89 | 6E89 | | BZ EC0D1 |
| | | | | 6. . . . . THEN |
| | | | | 7. . . . . IF COLLATE IND & (CCTRSAVE>19-39 IF MOD2 PRESENT) |
| | | | | & SEPSLCT=0 & ¬COLOFLO |
| | | | | TPB PCB06,COLATIND |
| 6E5D | A675 | 0075 | | |
| 6E5F | 91 | 0001 | | |
| 6E60 | 3D7F | 6E7F | | BZ EC0W01 |
| 6E62 | 25 | | | CLA |
| | | | | RIN CSB14 |
| 6E63 | A6D5 | 00D5 | | |
| 6E65 | 96 | 0006 | | TP MD2PRES |
| 6E66 | AE19 | 0019 | | LI X'19' 19 COPIES |
| 6E68 | 4B | 6E6B | | JZ EC0W02 |
| 6E69 | AE39 | 0039 | | LI X'39' 39 COPIES |
| 6E6B | C5 | 0005 | | EC0W02 SR CCTRSAVE |
| 6E6C | 3F7F | 6E7F | | BNL EC0W01 |
| | | | | SRG BASERG |
| 6E6E | A9C9 | 00C9 | | |
| 6E70 | 25 | | | CLA |
| 6E71 | D9 | 0009 | | AR SEPSLCT |
| 6E72 | 3C7F | 6E7F | | BNZ EC0W01 |
| | | | | SRG COLRG |
| 6E74 | A9D0 | 00D0 | | |
| | | | | TPB CPSBO4,COLOFLO |
| 6E76 | A609 | 0009 | | |
| 6E78 | 95 | 0005 | | |
| 6E79 | 6F | 6E7F | | JNZ EC0W01 |
| | | | | 7. . . . . THEN |
| | | | | 8. . . . . SET COLOFLOR |
| 6E7A | AF40 | 0006 | | TS COLOFLOR |
| 6E7C | A109 | 0009 | | STB CPSB04 |
| 6E7E | 05 | 6E85 | | J EC0W03 |
| | | | | 7. . . . . ELSE |
| | | | | EC0W01 EQU * |
| | | | | 8. . . . . SET CR1 |
| | | | | SRG INTHRG |
| 6E7F | A9C8 | 00C8 | | |
| 6E81 | E4 | 0004 | | LR CRREG |
| 6E82 | AF80 | 0007 | | TS CR1 |
| 6E84 | 84 | 0004 | | STR CRREG |
| | | | | 7. . . . . ENDIF |
| | | | | EC0W03 SRG INTHRG |
| 6E85 | A9C8 | 00C8 | | |
| 6E87 | 2CA8 | 6EA8 | | B EC0D2 |
| | | | | 6. . . . . ELSE |
| | | 6E89 | | EC0D1 DC * |
| | | | | 7. . . . . SET END=1 |
| | | | | TSB PSB03,END |
| 6E89 | A643 | 0043 | | |
| 6E8B | AF80 | 0007 | | |
| 6E8D | A143 | 0043 | | |
| | | | | - NONPERTINENT CODE - |
| | | | | 6. . . . . IF CCTRSAVE LESS THAN CPYSLCT |
| 6EA9 | E5 | 0005 | | LR CCTRSAVE |
| 6EAA | C9 | 0009 | | SR CPYSLCT |
| 6EAB | 3FB2 | 6EB2 | | BNL EC0D4 |
| | | | | 6. . . . . THEN |
| | | | | 7. . . . . SET CR1=1 |

TABLE VII-continued

EC0 CODE

| LOC | OBJ | OP1 | OP2 | SOURCE STATEMENT |
|---|---|---|---|---|
| 6EAD | E4 | 0004 | | LR CRREG |
| 6EAE | AF80 | 0007 | | TS CR1 |
| 6EB0 | 84 | 0004 | | STR CRREG |
| 6EB1 | 08 | 6EB8 | | J EC0E |
| | | | | 6..... ELSE |
| | | 6EB2 | | EC0D4 DC * |
| | | | | 7..... SET END=1 |
| | | | | TSB PSB03,END |
| 6EB2 | A643 | 0043 | | |
| 6EB4 | AF80 | 0007 | | |
| 6EB6 | A143 | 0043 | | |
| | | | | 6..... ENDIF |
| | | | | 5.... ENDIF |
| | | | | 4.... ENDIF |
| | | | | 3... ENDIF |
| | | | | 2.. ENDIF |
| | | | | - NONPERTINENT CODE - |

In FIG. 20, the code EC0 CR1 is next described. In the sequence of machine preparation for copy production, EC0-CR1 code has an effect before the FIG. 19 illustrated EC0 code, it being understood that several repetitions of code execution occur during each machine preparation. In EC0–CR1 the computer checks at 7006 whether there are no-paper modes, i.e., the machine operation will not require transport of copy sheets from any of the paper supplies. If it is a no-paper mode there is no need to pick paper; therefore the entire code element is bypassed. If, on the other hand, a paper mode is indicated, the computer checks for CR1 at 7011. If CR1 field bit is not set there is no need to pick paper and, the remaining code can be bypassed. If CR1=1, then the trucks are set to zero at 7015. Such trucks are those mechanisms in copy production machine 10 which reach into the paper supply bins for removing a copy sheet for copy production or for separation sheets. Such devices are shown in the IBM TECHNICAL DISCLOSURE BULLETIN, February 1974 on pages 2966 and 2967. With the trucks being reset to an out-of-supply bin, a no-pick position, the computer is in a better position to select from which of the supplies to pick a copy sheet.

At 701A the computer checks for the separate standby (SEPSTBY) flag. If it is active it means the separation mode is being performed; then the alternate truck for supply 54 is selected at 701E. Nonpertinent code is executed beginning at 7028 and this synchronous program is exited to other ECO codes (not shown) not pertinent to the present invention.

TABLE VIII

EC0 CR1 CODE

| LOC | OBJ | OP1 | OP2 | SOURCE STATEMENT |
|---|---|---|---|---|
| | | | | BEGIN EC0CR1 |
| | | | | 1. IF ¬PRECOND &¬CENOPAPR |
| | | | | TPB PSB07,PRECOND |
| 7006 | A647 | 0047 | | |
| 7008 | 90 | 0000 | | |
| 7009 | 3C7D | 707D | | BNZ EC0K5 |
| 700B | A662 | 0062 | | LB CEMODE |
| 700D | A803 | 0003 | | CI CENOPAPR |
| 700F | 3D7D | 707D | | BE EC0K5 |
| | | | | 1. THEN |
| | | | | 2.. IF CR1 |
| 7011 | E4 | 0004 | | LR CRREG |
| 7012 | 97 | 0007 | | TP CR1 |
| 7013 | 3D7D | 707D | | BZ EC0K5 |
| | | | | 2.. THEN |
| | | | | 3... RESET ALL TRUCKS |
| 7015 | A671 | 0071 | | LB PCB02 |
| | | | | TRM P(DPLXTRCK,ALTTRUCK,PRMTRCK) RESET ALL TRUCKS FIRST |
| 7017 | ABE3 | 00E3 | | |
| 7019 | 29 | | | TRA |
| | | | | 3... IF SEPSTBY |
| | | | | TPB PLSTNDBY,SEPSTBY |
| 701A | A653 | 0053 | | |
| 701C | 95 | 0005 | | |
| 701D | 43 | 7023 | | JZ EC0K1 *GO TO NEXT TEST IF NOT SEPARATION |
| | | | | 3... THEN |
| | | | | 4... SET ALTERNATE TRUCK |
| 701E | 29 | | | TRA RETURN TRUCK STATUS BYTE |
| 701F | AF08 | 0003 | | TS ALTTRUCK SET ALTERNATE TRUCK |
| 7021 | 2C61 | 7061 | | B EC0K4 |
| | | | | NONPERTINENT CODE |

The next synchronous program pertinent to practicing the present invention is the EC2 code shown in FIG. 21. Ignoring the nonpertinent code including code location 7188, the computer checks via the branch instruction at 718A whether the separate indicator (SEPARIND) is active plus other conditions as seen in Table IX. If the separate indicator is not active and the other conditions are met, the original on the platen of SADF 11 is exited via output instruction 71B5. Otherwise, the remove original light (not shown) on panel 52 is illuminated by the instruction at 71C0. Then at 71C6, the remove copy 1 flag is checked. If it is active then at 71CB the indicated flags are reset and the CR field is reset to all zeros. Nonpertinent code is executed at 71DC and this synchronous program is exited. The above code illustrates one intimate relationship between the synchronous programs and the asynchronous program control operations of SADF 11. The described code is shown below in source code form in Table IX.

TABLE IX

EC2 CODE

| LOC | OBJ | OP1 | OP2 | SOURCE STATEMENT | | |
|---|---|---|---|---|---|---|
| | | | | NONPERTINENT CODE | | |
| | | | | 5. . . . . IF | | (¬COLBNFL &¬SEPARATE & (¬B4 \| (¬BNLGTB4 & (SELPAPE \|SELPARD \| SELPAPC \| SELPAPB)) \| (SELPAPE & ¬IMPACTU) \| ((SELPAPD \| SELPAPC \| SELPAPB) &IMPACTU))) |
| | | | | RIN | | CSB 14 |
| 718A | A6D5 | 00D5 | | | | |
| 718C | 91 | 0001 | | TP | | COLBNFL |
| 718D | 3CC0 | 71C0 | | BNZ | | EC2COL3 |
| | | | | TPB | | PCB06,SEPARIND -- Separate mode. |
| 718F | A677 | 0077 | | | | |
| 7191 | 92 | 0002 | | | | |
| 7192 | 3CC0 | 71C0 | | BNZ | | EC2COL3 -- EC2 time. |
| 7194 | A6A1 | 01A1 | | LBL | | COUNTRY |
| 7196 | 92 | 0002 | | TP | | B4 |
| 7197 | 3DB5 | 71B5 | | BZ | | EC2COL2E |
| | | | | RIN | | CSB13 |
| 7199 | A6D4 | 00D4 | | | | |
| 719B | 29 | | | TRA | | |
| | | | | RIN | | CSB14 |
| 719C | A6D5 | 00D5 | | | | |
| 719E | 97 | 0007 | | TP | | BNLGTB4 |
| 719F | 29 | | | TRA | | |
| 71A0 | 65 | 71A5 | | JNZ | | EC2COL2A |
| 71A1 | AB1E | 001E | | NI | | P (SELPAPE,SELPAPD,SELPAPC,SELPAPB) |
| 71A3 | 3CB5 | 71B5 | | BNZ | | EC2COL2E |
| | | 71A5 | EC2COL2A | DC | | * |
| 71A5 | 94 | 0004 | | TP | | SELPAPE |
| 71A6 | 4C | 71AC | | JZ | | EC2COL2B |
| 71A7 | A681 | 0181 | | LBL | | PSB65 |
| 71A9 | 90 | 0000 | | TP | | IMPACTU |
| 71AA | 45 | 71B5 | | JZ | | EC2COL2E |
| 71AB | 03 | 71B3 | | J | | EC2COL2C |
| | | 71AC | EC2COL2B | DC | | * |
| 71AC | AB0E | 000E | | NI | | P(SELPAPD,SELPAPC,SELPAPB) |
| 71AE | 43 | 71B3 | | JZ | EC2COL2C | |
| 71AF | A681 | 0181 | | LBL | | PSB65 |
| 71B1 | 90 | 0000 | | TP | | IMPACTU |
| 71B2 | 65 | 71B5 | | JNZ | | EC2COL2E |
| | | 71B3 | EC2COL2C | DC | | * |
| 71B3 | 2CC0 | | | B | | EC2COL3 |
| | | | | 5. . . . . THEN | | |
| | | 71B5 | EC2COL2E | DC | | * |
| | | | | 6. . . . . EXITOFLO=1 -- Exit original from SADF. | | |
| | | | | SRG | | COLRG |
| 71B5 | A9D0 | 00D0 | | | | |
| | | | | TSB | | CPSB05,EXITOFLO |
| 71B7 | A616 | 0016 | | | | |
| 71B9 | AF20 | 0005 | | | | |
| 71BB | A116 | 0016 | | | | |
| | | | | SRG | | INTHRG |
| 71BD | A9C8 | 00C8 | | | | |
| 71BF | 06 | 71C6 | | J | | EC2COL4 |
| | | | | 5. . . . . ELSE | | |
| | | 71C0 | EC2COL3 | DC | | * |
| | | | | 6. . . . . REMCOPYI=1 | | |
| | | | | TSB | | PCB05,REMCOPYI |
| 71C0 | A676 | 0076 | | | | |
| 71C2 | AF01 | 0000 | | | | |
| 71C4 | A176 | 0076 | | | | |
| | | | | 5. . . . . ENDIF | | |
| | | | | 4. . . . ENDIF | | |
| | | | | 3. . . ENDIF | | |
| | | 71C6 | EC2COL4 | DC | | * |
| | | | | 3. . . IF REMCOPYI | | |
| | | | | TPB | | PCB05,REMPCOPYI |
| 71C6 | A676 | 0076 | | | | |
| 71C8 | 90 | 0000 | | | | |
| 71C9 | 3DDC | 71DC | | BZ | | EC2A |
| | | | | 3. . . THEN | | |
| | | | | 4. . . . DEACTIVATE CR1 &RESET | | |
| | | | | | | (CRB,CRA,CRA0,CRA1,CRA3,CRA3,CRA4,CRA5) |

TABLE IX-continued

EC2 CODE

| LOC | OBJ | OP1 | OP2 | SOURCE STATEMENT | | | |
|---|---|---|---|---|---|---|---|
| | | | | NONPERTINENT CODE | | | |
| 71CB | E4 | 0004 | | LR | CRREG | LOAD OR REGISTERS' REGISTER | |
| 71CC | B7 | 0007 | | TR | CR1 | DEACTIVATE CR1 | |
| 71CD | 84 | 0004 | | STR | CRREG | STORE OR REGISTERS' REGISTER | |
| 71CE | 25 | | | CLA | CLEAR ACCUM | | |
| 71CF | A114 | 0014 | | STB | CRHI | RESET HIGH BYTE OF CR REGISTER | |
| | | | | 4. . . . RESET STARTL | | | |
| | | | | TRB | PSB22,STARTL | | |
| 71D1 | A656 | 0056 | | | | | |
| 71D3 | B6 | 0006 | | | | | |
| 71D4 | A156 | 0056 | | | | | |
| | | | | 4. . . . RESET FLUSH PLEASE STANDBY (FLSHPLSB) AND SEPARATION PLEASE STANDBY (SEPSTBY) | | | |
| | | | | TRMB | PLSTNDBY,P(FLSHPLSB,SEPSTBY) | | |
| 71D6 | A653 | 0053 | | | | | |
| 71D8 | ABDB | 00DB | | | | | |
| 71DA | A153 | 0053 | | | | | |
| | | | | 3. . . ENDIF | | | |
| | | | | 2. . ENDIF | | | |
| | | | | 1. ENDIF | | | |
| | | | | -- NONPERTINENT CODE -- | | | |

The computer responds to the EC5 code with respect to the separation mode as shown in FIG. 22. First CR2 is checked at 7367 to determine whether the inner image erase lamp should be turned off as the image area is just beginning to pass the interimage erase lamp 30E. Branch instruction at 736C checks to see if the next operation is not auxiliary to copy production. During auxiliary operations (copies not produced) such as the separation mode, the inner image erase lamp 30E is left on to erase the image area. A flush, separate mode, a preconditioning or other auxiliary functions of a copy production machine require no image transfers. If copy production is to ensue (not auxiliary) then the inner image erase lamp 30E is turned off at 737F to allow an image to be imposed upon the image area of photoconductor drum 20. Nonpertinent code 7386 completes the EC5 code. Source code is in Table X.

Similarly, the EC6 code shown in FIG. 23 enables the computer to control the document lamp. Again, nonpertinent code is omitted at 73E5. The branch at 73E9 checks for CR2 and end, i.e., whether this is the last time CR2 will be used in the particular copy production run. If so, then at 73F2 the computer checks for separation mode (SEPSTBY) and a delay start, i.e., is this a leading separation mode run (a separation mode run) followed by copy production run. If so, then the document lamp is turned on at 73FA. Otherwise, nonpertinent code at 7402 is executed.

Tables X and XI respectively for the EC5 and EC6 code are included below.

TABLE X

EC5 CODE

| LOC | OBJ | OP1 | OP2 | SOURCE STATEMENT | | |
|---|---|---|---|---|---|---|
| | | | | BEGIN | EC5 CODE | |
| | | 7367 | | DC | * | |
| | | | | 1. IF CR2 | | |
| 7367 | A604 | 0004 | | LB | CRREG | LOAD CR REGISTERS' REGISTER |
| 7369 | 96 | 0006 | | TP | CR2 | TEST FOR CR2 |
| 736A | 3D86 | 7386 | | BZ | EC5A | IF CR2 NOT ACTIVE JUMP TO CR3 TEST |
| | | | | 1. THEN | | |
| | | | | 2. . IF ¬FLUSH &¬FUSER BYPASS &¬PRECOND & (¬SEPSTBY) | | |
| | | | | TP | PLSTNDBY,FSRPLSB | |
| 736C | A653 | 0053 | | | | |
| 736E | 91 | 0001 | | | | |
| 736F | 3C86 | 7386 | | BNZ | EC5A | |
| 7371 | A647 | 0047 | | LB | PSB07 | GET STATUS |
| | | | | TSM | P (PRECOND,FLUSH) | |
| 7373 | AF03 | 0003 | | | | |
| 7375 | 3C86 | 7386 | | BNZ | EC5A | |
| | | | | TPB | PLSTNDBY,SEPSTBY | |
| 7377 | A653 | 0053 | | | | |
| 7379 | 95 | 0005 | | | | |
| 737A | 4F | 737F | | JZ | EC5S1 | |
| 737B | EE | 000E | | LR | ACRREG | |
| 737C | ABF0 | 00F0 | | NI | X'F0' | |
| 737E | 46 | 7386 | | JZ | EC5A | |
| | | | | 2. . THEN | | |
| | | 7376F | | DC | EC551 * | |
| | | | | 3. . . INTERIMAGE ERASE OFF | | |
| 737F | A67D | 007D | | LB | PCB15 | |
| 7381 | B4 | 0004 | | TR | INTIMGER | |
| | | | | STOUT | 15 | |
| 7382 | A17D | 007D | | STB | PCB15 | |
| 7384 | A1D6 | 00D6 | | STB | CCB15 | |
| | | | | 2. . ENDIF | | |
| | | | | 1. ENDIF | | |

TABLE X-continued

| LOC | OBJ | OP1 | OP2 | EC5 CODE SOURCE STATEMENT |
|---|---|---|---|---|
| | | | | --NONPERTINENT CODE-- |

TABLE XI

| LOC | OBJ | OP1 | OP2 | EC6 CODE SOURCE STATEMENT | | |
|---|---|---|---|---|---|---|
| | | | | 1. IF CR2 &END | | |
| 73E9 | E4 | 0004 | | LR | CRREG | GET CR REG |
| 73EA | 96 | 0006 | | TP | CR2 | SEE IF CR2 |
| 73EB | 3512 | 7412 | | BZ | EC6B | * GO IF YES |
| | | | | TPB | PSB03,END | |
| 73ED | A643 | 0043 | | | | |
| 73EF | 97 | 0007 | | | | |
| 73F0 | 3512 | 7412 | | BZ | EC6B | |
| | | | | 1. THEN | | |
| | | | | 2. . IF SEPSTBY &DELAYSTL | | |
| | | | | TPB | PLSTNDBY,SEPSTBY | |
| 73F2 | A653 | 0053 | | | | |
| 73F4 | 95 | 0005 | | | | |
| 73F5 | 42 | 7402 | | JZ | EC6A | |
| | | | | TPB | PSB03,DELAYSTL | |
| 73F6 | A643 | 0043 | | | | |
| 73F8 | 92 | 0002 | | | | |
| 73F9 | 42 | 7402 | | JZ | EC6A | |
| | | | | 2. . THEN | | |
| | | | | 3. . . DOCLAMP ON | | |
| | | | | TSB | PCB12,DOCLAMP | |
| 73FA | A67A | 007A | | | | |
| 73FC | AF10 | 0004 | | | | |
| 73FE | A17A | 0007A | | | | |
| 7400 | 2C12 | 7412 | | B | EC6B | |
| | | | | --NONPERTINENT CODE-- | | |

Figure 24:
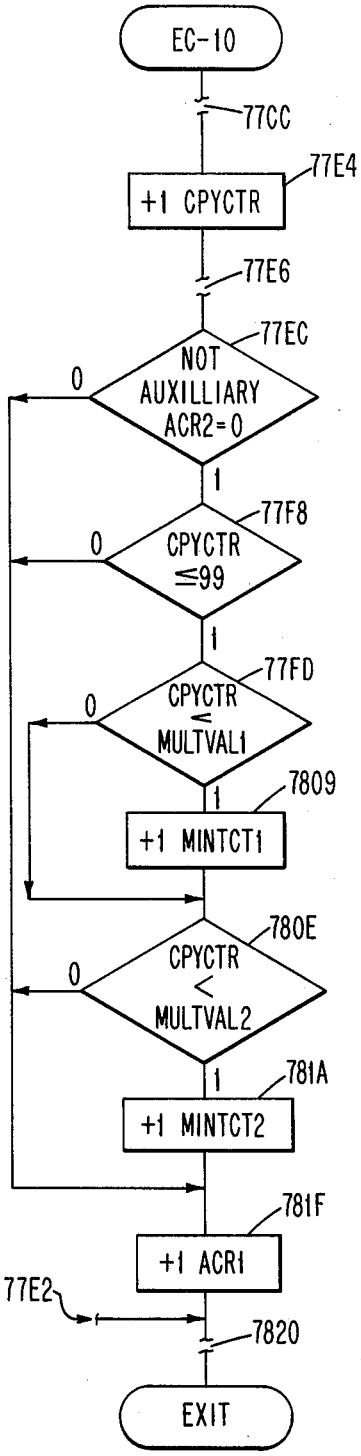
FIG. 24 is a flow chart showing certain counting actions related to the separation mode at EC10 time of the copy production machine.

The EC10 code, among other things, provides for incrementing certain counters. As seen in FIG. 24, after executing the nonpertinent code 77CC which verifies that the state of CR2 is one and that paper has been picked satisfactorily, the copy counter field (CPYCTR) is incremented at 77E4. This field is used in counting the number of separation sheets used during the separation mode as well as counting copies in copy production runs. Following more nonpertinent code at 77E6 which includes a series of branches and counting steps that are not directly pertinent to the separation mode. The branch at 77EC senses whether an auxiliary function is being performed, i.e., separation, flush, etc. If an auxiliary function is not being performed (copies are being produced), the ACR1 register is incremented at 781F. The ACR register contains a count indicating the number of copies produced from a given image and is used primarily for copy error recovery. However, ACR1 is also a count field which keeps a tally of the number of copies in the paper path when one image is being produced or if no images are being transferred, i.e., counts separation sheets. The code at 77F8 through 781A concerns counting steps pertinent to copy production. Then more nonpertinent code at 7820 or from a branch of nonpertinent code at 77E2 is executed before the program is exited. The Table XII below shows source code associated with the FIG. 24 flow chart.

TABLE XII

| LOC | OBJ | OP1 | OP2 | EC10 COUNT CONTROL CODE SOURCE STATEMENT | | |
|---|---|---|---|---|---|---|
| | | | | 4. . . . INCREMENT COPY COUNTER- CPYCTR=CCTRSAVE | | |
| 77E4 | E5 | 0005 | | LR | CCTRSAVE | |
| 77E5 | B7 | 0007 | | STR | CPYCTR | |
| | | | | 4. . . . IF | ¬CENOPAPR | |
| 77E6 | A662 | 0062 | | LB | CEMODE | GET CEMODE |
| 77E8 | A803 | 0003 | | CI | CENOPAPR | SEE IF CE NO PAPER MODE |
| 77EA | 3520 | 7820 | | BE | EC10B | *GO IF YES |
| | | | | 4. . . . THEN | | |
| | | | | 5. . . . . IF | ¬FLUSH &¬(SEPACTV &ACR2=0) | |
| 77EC | A647 | 0047 | | LB | PSB07 | GET STATUS |
| 77EE | 91 | 0001 | | TP | FLUSH | TEST FOR FLUSH |
| 77EF | 341F | 781F | | BNZ | EC10D3 | |
| 77F1 | 93 | 0003 | | TP | SEPACTV | TEST FOR SEPARATION MODE |
| 77F2 | 48 | 77F8 | | JZ | EC10Z | *GO IF NO |
| 77F3 | EE | 000E | | LR | ACRREG | LOAD ACR REGISTER |
| 77F4 | ABF0 | 00F0 | | NI | X'F0' | TEST VALUE OF ACR2 |
| 77F6 | 351F | 781F | | BZ | EC10D3 | *GO IF 0 |
| | | | | 5. . . . . THEN | | |
| | | 77F8 | | EC10Z DC | * | |
| | | | | 6. . . . . IF CPYCTR<=99 | | |
| 77F8 | 25 | | | CLA | CLEAR ACCUM | |
| 77F9 | A417 | 0017 | | AB | CPYCTHI | |

TABLE XII-continued

EC10 COUNT CONTROL CODE

| LOC | OBJ | OP1 | OP2 | SOURCE STATEMENT |
|---|---|---|---|---|
| 77FB | 341F | 781F | | BNE EC10D3 |
| | | | | 6. . . . . THEN |
| | | | | 7. . . . . IF CPYCTR<MULTVAL1 |
| 77FD | A6B6 | 01B6 | | LBL MULTVAL1 |
| | | | | SHLM 4 |
| 77FF | 2B | | | |
| 7800 | 2B | | | |
| 7801 | 2B | | | |
| 7802 | 2B | | | |
| 7803 | A7B7 | 01B7 | | OBL MULTVAL1+1 |
| 7805 | A207 | 0007 | | SB CPYCTLU |
| | | | | JNC EC10D2 |
| 7807 | 2D | | | |
| 7808 | 4E | 780E | | |
| | | | | 7. . . . . THEN |
| | | | | 8. . . . . INCREMENT MINTCT1 |
| 7809 | A644 | 0044 | | LB PSB04 |
| 780B | 2E | | | A1 |
| 780C | A144 | 0044 | | STB PSB04 |
| | | | | 7. . . . . ENDIF |
| | | 780E | EC10D2 | DC * |
| | | | | 7. . . . . IF CPYCTR<MULTVAL2 |
| 780E | A6BE | 01BE | | LBL MULTVAL2 |
| | | | | SHLM 4 |
| 7810 | 2B | | | |
| 7811 | 2B | | | |
| 7812 | 2B | | | |
| 7813 | 2B | | | |
| 7814 | A7BF | 01BF | | OBL MULTVAL2+1 |
| 7816 | A207 | 0007 | | SB CPYCTLO |
| | | | | JNC EC10D3 |
| 7818 | 2D | | | |
| 7819 | 4F | 781F | | |
| | | | | 7. . . . . THEN |
| | | | | 8. . . . . INCREMENT MINTCT2 |
| 781A | A651 | 0051 | | LB PSB17 |
| 781C | 2E | | | A1 |
| 781D | A151 | 0051 | | STB PSB17 |
| | | | | 7. . . . . ENDIF |
| | | | | 6. . . . . ENDIF |
| | | | | 5. . . . . ENDIF |
| | | 781F | EC10D3 | DC * |
| | | | | 5. . . . . INCREMENT ACR1 |
| 781F | FE | 000E | | LRB ACRREG |
| | | | | 4. . . . ENDIF |
| | | | | 3. . . ENDIF |

Figure 25:
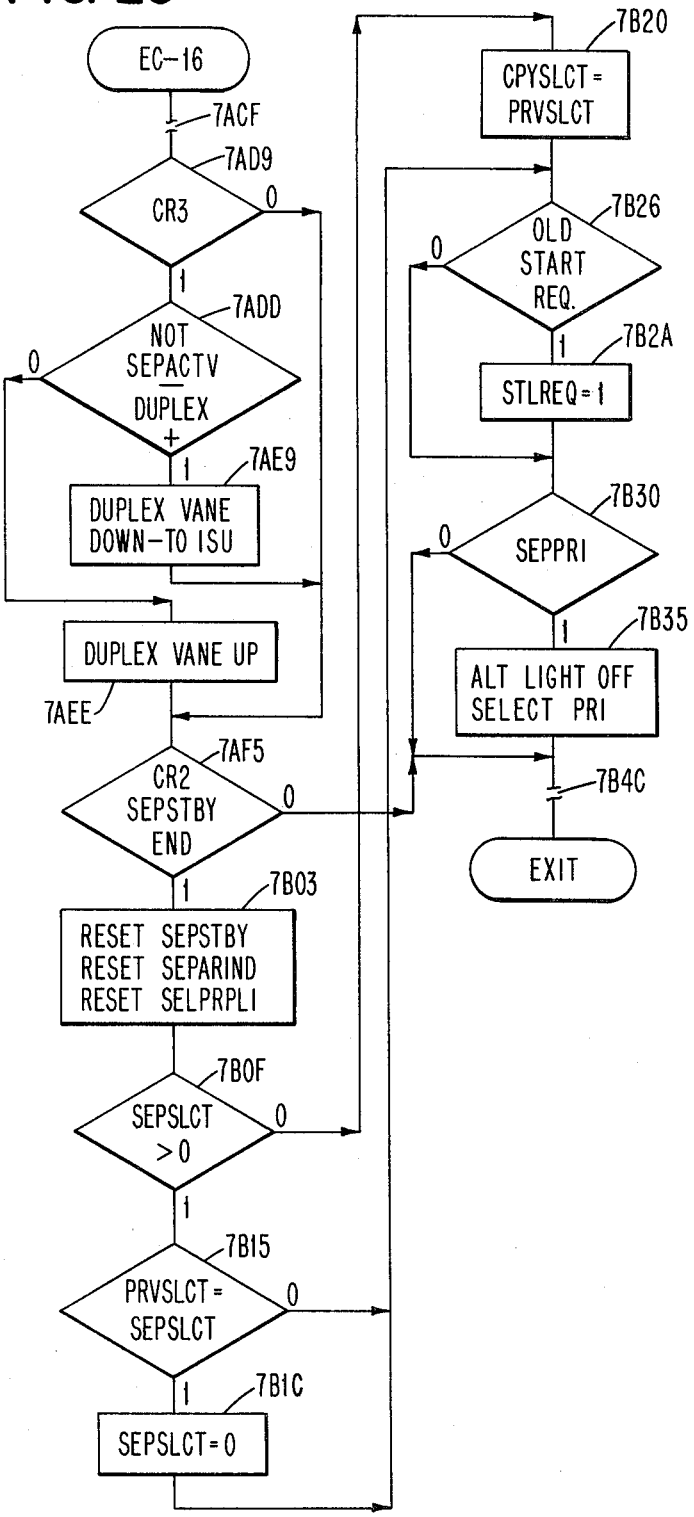
FIG. 25 is a flow chart showing certain copy count controls related to the separation mode implemented at EC16 time of the copy production machine.

The last synchronous program portion to be described is EC16 shown in FIG. 25. After executing nonpertinent code at 7ACF, the status of the CR3 bit is sensed at 7AD9. If it is active (CR3=1) then the branch at 7ADD enables the computer to sense whether separation mode is not active or if there is a duplex mode. If either, the instruction at 7AE9 moves the duplex vane down so that copies will go to the interim storage unit 40. On the other hand, if separate mode is active or it is not duplex then the instruction at 7AEE enables the computer to move the duplex vane up for directing copy sheets to output portion 14.

At 7AF5 the computer checks CR2, separate standby, and end, i.e., whether the last separation sheet has been already picked from the alternate paper bin 54. If so, then the instruction at 7BO3 enables the computer to reset separate standby, separate indicator and the select primary paper bin memory indicator.

Following 7B03 the computer checks at 7B03 whether the separation selection is greater than zero. If it is, then at 7B15 the previous separation select (PRVSLCT) is checked for equality with the present separation select. The previous select is a memory field for indicating to other programs the number of separation sheets transported during the last previous separation mode run. Upon equality, the computer at 7B1C makes separation select equal to zero (end of the separation run).

If, on the other hand, the separation select at 7B0F was not greater than zero, i.e., equal to zero, then at 7B20 the copy select field is made equal to the previous separation select count. Then at 7B26 the program paths join where the computer senses whether there is an outstanding start request. If so, the start latch request is set at 7B2A. Then at 7B30 the computer checks whether the copies previously made used copy sheets from the primary paper bin 35. If the copies were made from the primary bin, which is the usual case, the alternate light is turned off and the primary bin is selected at 7B35. After executing nonpertinent code at 7B4C the program is exited. Note that if the branch at 7AF5 indicates that the end of the separation run has not occurred or other conditions outside of separation runs have occurred, the program is then exited via the nonpertinent code 7B4C. The source code for the above-described flow chart is shown below in Table XIII.

TABLE XIII

EC16 SEPARATION MODE CODE

```
LOC   OBJ    OP1   OP2  SOURCE STATEMENT
                        1. IF CR3
7AD9  E4     0004            LR        CRREG     GET CR REGISTER
7ADA  95     0005            TP        CR3       TEST FOR CR3
7ADB  3DF5   7AF5            BZ        EC16C     *GO IF NO
                        1. THEN
                        2. . IF   SEPACTV &DUPLEX IND &   SIDE2
                                 TPB       PSB07,SEPACTV
7ADD  A647   0047
7ADF  93     0003
7AE0  6E     7AEE            JNZ       EC16B     *GO IF YES
                             TPB       PCB05,DPLXIND
7AE1  A676   0076
7AE3  92     0002
7AE4  4E     7AEE            JZ        EC16B     *GO IF NO
                             TPB       PSB20,DPXSIDE2
7AE5  A654   0054
7AE7  95     0005
7AE8  6E     7AEE            JNZ       EC16B     *GO IF YES
                        2. . THEN
                        3. . . DUPLEX VANE DOWN
7AE9  A673   0073            LB        PCB02     GET STATUS
7AEB  AF40   0006            TS        DPLXVANE
7AED  01     7AF1            J         EC16B1    * CONTINUE
                        2. . ELSE
              7AEE   EC16B   DC        *
                        3. . . DUPLEX VANE UP
7AEE    A673 0073            LB        PCB02     GET STATUS
7AF0    B6   0006            TR        DPLXVANE
              7AF1   EC16B1  DC        *
                             STOUT     02
7AF1    A173 0073            STB   PCB02
7AF3    A1C1 00C1            STB   CCB02
                        2. . ENDIF
              7AF5   EC16C   DC        *
                        1. ENDIF
                        1. IF CR2 &END &SEPSTBY
7AF5  E4     0004            LR        CRREG     GET CR REGISTER
7AF6  96     0006            TP        CR2       TEST FOR CR2
7AF7  354C   7B4C            BZ        EC16E     *GO IF NO
                             TPB       PSB03,END
7AF9  A643   0043
7AFB  97     0007
7AFC  354C   7B4C            BZ        EC16E     *GO IF END NOT SET
7AFE  A653   0053            LB        FLSTNDBY
7B00  B5     0005            TR        SEPSTBY
7B01  3D4C   7B4C            BZ        EC16E     *GO IF NOT SEPARATE
                        1. THEN
                        2. . RESET SEPSTBY,SEPARATION LIGHT,SELPRPLI
7B03  A153   0053            STB       PLSTNDBY
                             TRB       PCB06,SEPARIND
7B05  A677   0077
7B07  B2     0002
7B08  A177   0077
                             TRB       PCB13,SELPRPLI
7B0A  A67D   007D
7B0C  B4     0004
7B0D  A17D   007D
                        2. . IF SEPSLCT>0
7B0F  25                     CLA
                             SRG       BASERG
7B10  A9C9   00C9
7B12  D9     0009            AR        SEPSLCT
7B13  3D20   7B20            BZ        EC16C5
                        2. . THEN
                        3. . . IF PRVSLCT=SEPSLCT
                             SRG       COLRG
7B15  A9D0   00D0
7B17  EA     000A            LR        PRVSLCT
                             SRG       BASERG
7B18  A9C9   00C9
7B1A  C9     0009            SR        SEPSLCT
7B1B  6D     7B1D            JNZ       EC16C1
                        3. . . THEN
                        4. . . . SEPSLCT=0
7B1C  89     0009            STR       SEPSLCT
                        3. . . ENDIF
              EC16C1         SRG       INTHRG
7B1D  A9CB   00C8
7B1F  06     7B26            J         EC16C7
                        2. . ELSE
```

TABLE XIII-continued

EC16 SEPARATION MODE CODE

```
LOC   OBJ   OP1   OP2  SOURCE STATEMENT
                       EC16C5  DC          *
                          3. . . CPYSLCT=PRVSLCT
                                 SRG       COLRG
7B20  A9D0  00D0
7B22  EA    000A               LR          PRVSLCT
                               SRG         INTHRG
7B23  A9C8  00C8
7B25  89    0009               STR         CPYSLCT
                          2. . ENDIF
      .
            7B26       EC16C7  DC          *
                          2. . IF DELAYSTL
                                 TPB       PSB03,DELAYSTL
7B26  A643  0043
7B28  92    0002
7B29  40    7B30               JZ          EC16D
                          2. . THEN
                          3. . . SET STLREQ
                                 TSB       PSB22,STLREQ
7B2A  A656  0056
7B2C  AF80  0007
7B2E  A156  0056
                          2. . ENDIF
            7B30       EC16D   DC          *
                          2. . IF SEPPRI
                                 TPB       PSB05,SEPPRI
7B30  A645  0045
7B32  93    0003
7B33  3D4C  7B4C               BZ          EC16E
                          2. . THEN
                          3. . . TURN OFF ALTERNATE BIN LIGHT
                                 TRB       PCB05,ALTPAPI
7B35  A676  0076
7B37  B1    0001
7B38  A176  0076
                          3. . . PICK PRIMARY TRUCK (RESET OTHERS)
7B3A  A673  0073               LB          PCB02
                               TRM         P (ALTTRUCK,DPLXTRCK)
7B3C  ABF3  00F3
7B3E  AF10  0004               TS          PRMTRCK
7B40  A173  0073               STB         PCB02
                          3. . . SET PRIMPICK (RESET OTHERS)
7B42  A670  0070               LB          PCB16
7B44  AF08  0003               TS          PRIMPICK
                               TRM         P (ALTPICK,DUPPICK)
7B46  ABCF  00CF
                               STOUT       16
7B48  A170  0070               STB    PCB16
7B4A  A1DA  00DA               STB         CCB16
                          2. . ENDIF
                          1. ENDIF
```

Figure 26:
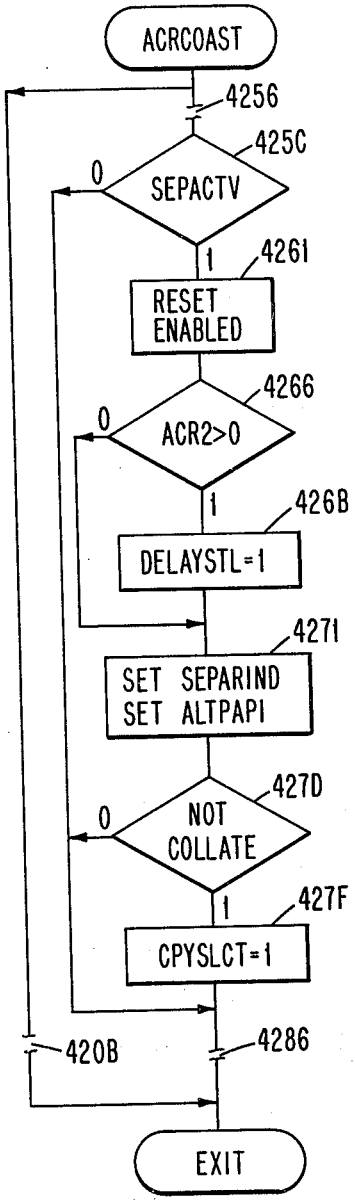
FIG. 26 is a flow chart showing certain separation mode related functions performed after an end of a copy production run.

Interleaved with execution of the synchronous programs are the asynchronous programs 260, 261. The asynchronous programs 261 are directed toward job control of copy production machine 10. That is, these programs 261 tie the various copy production runs and separation runs and flush runs together for completing a job, particularly as to logically extending the storage capacity of the collators in output portion 14. A first of these job control asynchronous programs is shown in FIG. 26 which is executed each time the machine 10 stops, that is, photoconductor drum 20 has stopped rotating. At this time many chores have to be performed by the computer relating to the next startup of copy production machine 10 so that job continuity can be preserved or a job can be terminated. As can be expected programming at the end of such a run is quite complex, having an effect on all operational features of the copy production machine. Accordingly, nonpertinent code indicated at 4256, 420B and 4286 is substantial. That portion of ACRCOAST that pertains to the separation mode includes instruction 425C wherein the computer senses whether the copy production machine is in a separation mode run (SEPACTV). If it is in a separation mode run, then at 4261 the computer resets the enable flag thereby disabling the computer from sensing inputted operator parameters. Then at 4266 the computer determines whether a copy recovery register termed ACR2 is greater than zero. It if is greater than zero then an ensuing copy production run will be overlapped with the present separation run. This overlap is indicated by delaying the start at 426B (DELAYSTL=1). This delayed start memorizes that a start has been requested and will be used by other programs executed by the computer. Then at 4271 the computer sets the separate indicate flag SEPARIND which turns on the separate indicator associated within switch 57 of panel 52. Also, the alternate paper supply 54 is selected. Then at 427D the computer determines whether the collate mode has been selected by the operator. If so, the nonpertinent code at 4286 is executed. On the other hand, if collate was not selected then the copy select is equal to one at 427F. That is, only one separation sheet will be supplied in a noncollate mode to exit tray 14A. The source code associated with the FIG. 26 illustrated flow chart is listed in Table XIV below.

TABLE XIV

ACR COAST

```
LOC  OBJ    OP1  OP2      SOURCE STATEMENT
                          2. . IF   SEPACTV
                            TPB     PSB07,SEPACTV
425C A647   0047
425E 93     0003
425F 3D86   4286            BZ      ACRCP02
                          2. . THEN
                          3. . . RESET ENABLED
                            TRB     PSB42,ENABLED
4261 A66A   006A
4263 B7     0007
4264 A16A   006A
                          3. . . IF ACR2] 0
4266 A60E   000E            LB      ACRREGLO
4268 ABF0   00F0            NI      X'F0'
426A 41     4271            JZ      ACRCPX1
                          3. . . THEN
                          4. . . . SET DELAYSTL - IMPLIES SEPARATION OVERLAPPED BY COPY
                            TSB     PSB03,DELAYSTL
426B A643   0043
426D AF04   0002
426F A143   0043
                          3. . . ENDIF
                     ACRCPX1 EQU    *
                          3. . . SET ALTPAPI, SEPARIND
                            TSB     PCB05,ALTPAPI
4271 A676   0076
4273 AF02   0001
4275 A176   0076
                            TSB     PCBO6,SEPARIND     PCB06 LEFT IN ACCUM FOR NEXT INSTR.
4277 A677   0077
4279 AF04   0002
427B A177   0077
                          3. . . IF .COLATIND
427D 91     0001            TP      COLATIND           PCB06 STILL IN ACCUM FROM PRV. INSTR
427E 66     4286            JNZ     ACRCP02
                          3. . . THEN
                          4. . . . CPYSLCT=1
427F 25                     CLA
4280 2E                     A1
                            SRG     INTHRG
4281 A9C8   00C8
4283 89     0009            STR     CPYSLCT
                            SRG     BASERG
4284 A9C9   00C9
                          3. . . ENDIF
                          2. . ENDIF
                          -- NONPERTINENT CODE --
```

Figure 27:
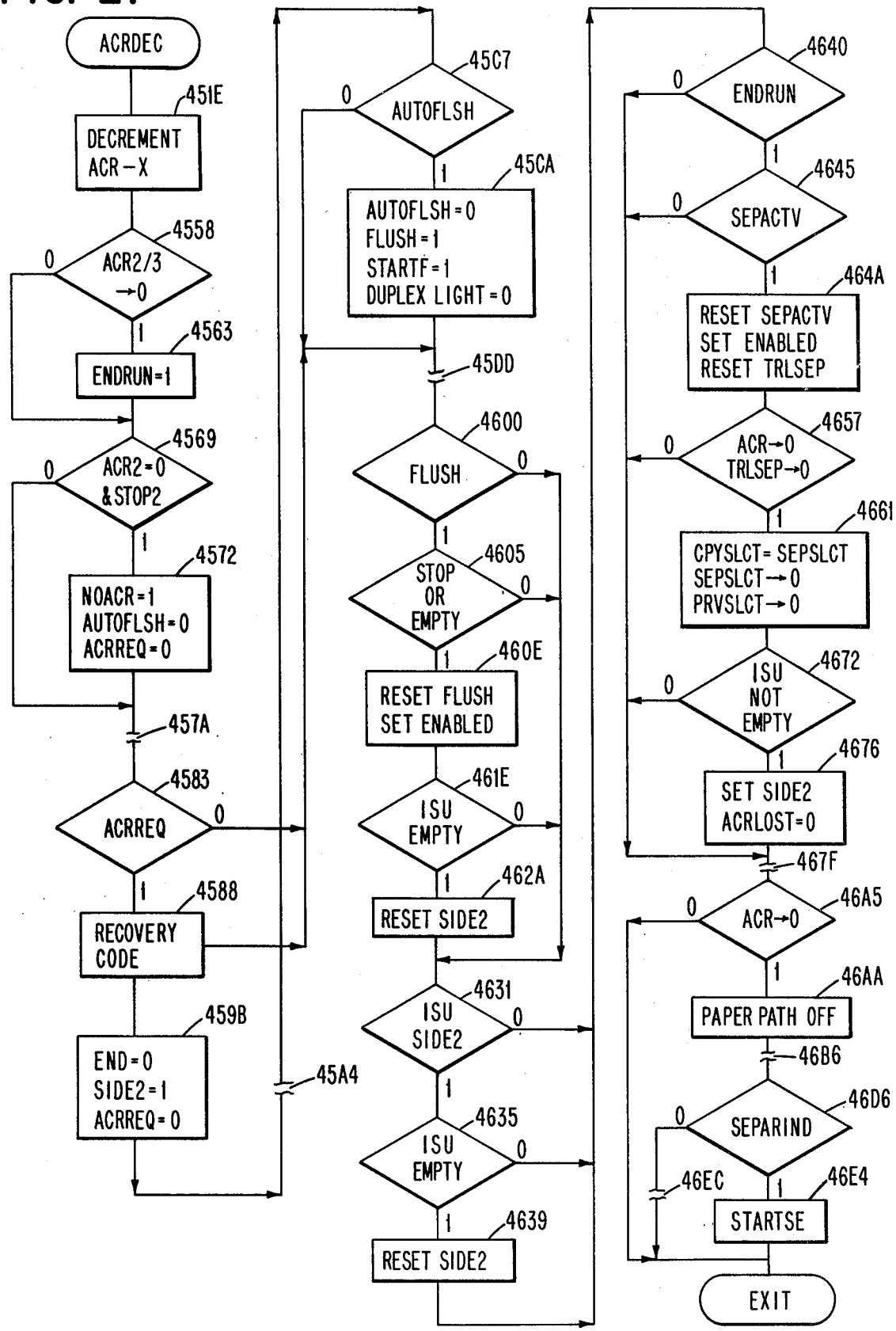
FIG. 27 is a flow chart showing functions which in combination with other functions shown in other figures relate to a complete separation mode job by logically extending the collator capacity.

An important job control asynchronous program ACRDEC is shown in FIG. 27. Before proceeding with the details of the program, it is noted that the ACR count fields are divided into a plurality of subfields. For example, ACR1 is a count field indicating a number of copies of a given image just entering a copy path of copy production machine 10. ACR2 is a count field of copies of a single image different from the ACR1 indicated image which copies entered the copy path just prior to the ACR1 counted copies. Similarly, ACR3, 4, 5 and so forth indicate the number of copies of respective images. As copies leave the copy path, as sensed and indicated by switches S2 through S4 (FIG. 1), the ACR count field of the first inserted image, i.e., a nonzero ACR count field having the highest numeral, is decremented. This ACR is designated as ACRX. Accordingly, as each copy leaves the copy path, the computer follows the instruction of 451E to decrement ACRX. Accordingly, the numerical content of the various ACR count fields indicate the number of copies of each respective image currently in the copy production routine copy path.

After decrementing ACRX, the computer at 4558 determines whether ACR2 or 3 has just gone to zero. If either of these have gone to zero, the endrun bit is set at 4563. This bit indicates that the copy path now contains the copies of the last image to be reproduced. By way of explanation, when more than one ACR count field is nonzero, the number of copies made from each image is less than that necessary to completely fill the copy path. Accordingly, when the higher numbered ACRs have all gone to zero, including ACR2 or 3, then the computer knows that all of the copies of the last image are the only ones remaining in the copy path. The ENDRUN bit is a cautioning bit indicating the end of a run is imminent.

Then at 4569, the computer looks to see whether ACR2 is equal to zero and whether the STOP2 bit is active. If so, then at 4572 the computer can indicate that no copy recovery (NOACR and ACRREQ=0) is required and that there is no requirement for emptying interim storage unit 40 (AUTOFLSH=0). Then some nonpertinent code 457A is executed.

The branch at 4583 determines whether an error recovery request has been made. If not, nonpertinent code beginning at 45DE is executed. On the other hand, if there is an error recovery request certain recovery code indicated by 4588 is executed. After the recovery code which can cause a branch also to 45DD, the computer resets the end indicator, sets SIDE2 equal to one and resets the error recovery request. Then after executing nonpertinent code 45A4, at 45C7 the computer checks whether the interim storage unit 40 is to be emptied (AUTOFLSH). If it is to be emptied, AUTOFLSH is reset, flush is set to one indicating that the interim storage unit 40 will be emptied, a start latch F is set to one, and the duplex light on panel 52 is extinguished. After the nonpertinent code 45DD, the computer checks at 4600 whether the flush indicator is active. If it is active, then at 4605 the computer checks whether the stop indicator is on or the interim storage unit 40 is empty. If either one of those occur, then at 460E the flush bit is reset and enabled is set indicating operator selections are permitted as copy production machine 10 is stopping. At branch instruction 461E the computer checks whether interim storage unit 40 is empty. If unit 40 is empty, at 461E the computer resets the SIDE 2 indicator at 462H. The program paths join again at 4631 where the computer checks for the SIDE 2 indicator. If it is active, then at 4635 the computer again checks to see whether interim storage unit 40 is empty. If it is empty, SIDE 2 is reset at 4639. Then at 4640 and 4645 the computer checks for the ENDRUN flag, i.e., the end of the run is in sight, and whether separate is active. If both conditions occur, then at 464A, the computer resets separate active, sets the enabled flag for enabling operator input, and resets the trailing separator flag. From an operator view, when the separate indicator at button 57 goes off, additional parameters can be entered. When SEPTACTV is reset, other programs, as described, reset SEPARIND.

At 4657 the computer checks to see when any ACR has gone to zero and whether the trailing separator has been set to zero. If the conditions are met, then at 4661 the copy select field is made equal to the separate select field, i.e., the number of copies to be produced will equal the number of separator sheets provided. Also, the two fields, separate select and previous separate select, are set to zero. At 4672 the computer checks whether interim storage unit 40 is empty. If not, it sets SIDE 2 and sets ACRLOST equal to zero at instruction 4676. ACRLOST is a register in area 263 indicating the number of copies lost from ISU 40 in a copy transport error. Then nonpertinent code is executed at 467F.

At 46A5 the computer checks to see whether any ACR has gone to zero. If so, at 46AA the paper pick trucks are reset, i.e., returned to their inactive position. Nonpertinent code is executed at 46B6. The separate indicator is checked at 4606 to determine whether a separation mode should be started at 46E4. Otherwise, nonpertinent code is executed at 46EC. Source code for implementing the above-described flow chart is shown below in Table XV.

TABLE XV

ACRDEC

```
LOC   OBJ     OP1   OP2     SOURCE STATEMENT
                                BEGIN ACRDEC SUBROUTINE
                                      DECREMENTS THE APPROPRIATE NON-0 ACR_X
                4518
                                NOTE: DO NOT USE ACRBILL2, IT WILL BE USED TO DENOTE THAT ACR2
                                      HAS GONE TO 0, IT CAN BE USED A LITTLE LATER, SEE NEXT NOTE.
                                  -- NONPERTINENT CODE --
                                    1. DECREMENT ACR_X (WHERE X = 4,3,2OR 1: THE FIRST NON-O
                                          COUNTER). (IF ACR2 GOES TO O, RESET ACRBILL2)
451E  25                            CLA
451F  A41E    001E                  AB    ACRREGHI
4521  3D39    4539                  BZ    ACRD008     J MEANS ACR3,4 BOTH 0
4523  ABF0    00F0                  NI    X'FO'
4525  A61E    001E                  LB    ACRREGHI
4527  6F      452F                  JNZ   ACRD009     J MEANS ACR4 = 0
4528  2A                            S1                DECREMENT ACR3
4529  A11E    001E                  STB   ACRREGHI
452B  3D58    4558                  BZ    ACRD008C    J MEANS ACR3 DID GO TO 0
452D  2C55    4555                  B     ACRD007
452F  AA10    0010        ACRD009   SI    X'10'       DECREMENT ACR4
4531  A11E    001E                  STB   ACCREGHI
4533  ABF0    00F0                  NI    X'F0'
4535  3D58    4558                  BZ    ACRD008C    J MEANS ACR4 DID GO TO 0
4537  2C55    4555                  B     ACRD007
4539  A40E    000E        ACRD008   AB    ACRREGLO
453B  3D55    4555                  BZ    ACRD007     J MEANS ACR1,2 BOTH 0
453D  ABF0    00F0                  NI    X'F0'
453F  A60E    000E                  LB    ACRREGLO
4541  68      4548                  JNZ   ACRD009A    J MEANS ACR2 =¬0
4542  2A                            S1                DECREMENT ACR1
4543  A10E    000E                  STB   ACRREGLO
4545  3D58    4558                  BZ    ACRD008C    J MEANS ACR1 DID GO TO 0
4547  05      4555                  J     ACRD007
4548  AA10    0010        ACRD009A  SI    X'10'       DECREMENT ACR2
454A  A10E    000E                  STB   ACRREGLO
454C  ABF0    00F0                  NI    X'F0'
454E  65      4555                  JNZ   ACRD007     J MEANS ACR2 DID NOT GO TO 0
                                    TRB   PSB43,ACRBILL2
454F  A66B    006B
4551  B4      0004
4552  A16B    006B
4554  08      4558                  J     ACRD00BC
                                    1. IF THAT ACR_X JUST WENT TO 0
4555  30FE46  46FE  0000  ACRD007   BU    ACRD003,R0 ACRD007 MEANS SOME ACR DID NOT GOTO 0
                           ACRD008C EQU   *           ACRD008C MEANS SOME ACR DID GOTO 0
                                    1. THEN
                                    2. . IF (ACR2 |ACR3 WENT TO 0) |END
```

TABLE XV-continued

ACRDEC

| LOC | OBJ | OP1 | OP2 | SOURCE STATEMENT |
|---|---|---|---|---|
| | | | | TPB PSB43,ACRBILL2 |
| 4558 | A66B | 006B | | |
| 455A | 94 | 0004 | | |
| 455B | 43 | 4563 | | JZ ACRDY1 |
| 455C | 25 | | | CLA |
| 455D | DE | 000E | | AR ACRREG |
| 455E | 63 | 4563 | | JNZ ACRDY1 |
| | | | | TPB PSB03,END |
| 455F | A643 | 0043 | | |
| 4561 | 97 | 0007 | | |
| 4562 | 49 | 4569 | | JZ ACRDY2 |
| | | | | 2. . THEN |
| | | 4563 | ACRDY1 | DC * |
| | | | | 3. . . SET ENDRUN |
| | | | | TSB PSB43,ENDRUN |
| 4563 | A66B | 006B | | |
| 4565 | AF40 | 0006 | | |
| 4567 | A16B | 006B | | |
| | | | | 2. . ENDIF |
| | | 4569 | ACRDY2 | DC * |
| | | | | 2. . IF ACR2 =0& STOP2 |
| 4569 | A60E | 000E | | LB ACRREGLO |
| 456B | ABF0 | 00F0 | | NI X'F0' |
| 456D | 6A | 457A | | JNZ ACRD01 |
| | | | | TPB PSB23,STOP2 |
| 456E | A657 | 0057 | | |
| 4570 | 91 | 0001 | | |
| 4571 | 4A | 457A | | JZ ACRD01 |
| | | | | 2. . THEN |
| | | | | 3. . . NOACR=1, AUTOFLSH=0, ACRREQ=0 |
| 4572 | A641 | 0041 | | LB PSB01 |
| 4574 | AF01 | 0000 | | TS NOACR |
| | | | | TRM P (AUTOFLSH,ACRREQ) |
| 4576 | ABF9 | 00F9 | | |
| 4578 | A141 | 0041 | | STB PSB01 |
| | | | | 2. . ENDIF |
| | | | | -- NONPERTINENT CODE -- |
| | | | | 3. . . IF ACRREQ |
| | | | | TPB PSB01,ACRREQ |
| 4583 | A641 | 0041 | | |
| 4585 | 91 | 0001 | | |
| 4586 | 3DDD | 45DD | | BZ ACRD02 |
| | | | | 3. . . THEN |
| | | | | -- RECOVERY CODE 4588 -- |
| | | | | 5. . . . . THEN |
| | | | | 6. . . . . RESET END,ENDRUN |
| | | | | TSB PSB43,ENDRUN |
| 459B | A66B | 006B | | |
| 459D | AF40 | 0006 | | |
| 459F | A16B | 006B | | |
| | | | | -- NONPERTINENT CODE -- |
| | | | | 6. . . . . IF AUTOFLSH |
| 45C7 | B2 | 0002 | | TR AUTOFLSH |
| 45C8 | 3DDD | 45DD | | BZ ACRD05 |
| | | | | 6. . . . . THEN |
| | | | | 7. . . . . RESET AUTOFLSH |
| 45CA | A141 | 0041 | | STB PSB01 |
| | | | | 7. . . . . FLUSH, STARTFL =1 |
| | | | | TSB PSB07,FLUSH |
| 45CC | A647 | 0047 | | |
| 45CE | AF02 | 0001 | | |
| 45D0 | A147 | 0047 | | |
| | | | | TSB PSB22,STARTFL |
| 45D2 | A656 | 0056 | | |
| 45D4 | AF01 | 0000 | | |
| 45D6 | A156 | 0056 | | |
| | | | | 7. . . . . TURN OFF DUPLEX LIGHT |
| | | | | TRB PCB05,DPLXIND |
| 45D8 | A676 | 0076 | | |
| 45DA | B2 | 0002 | | |
| 45DB | A176 | 0076 | | |
| | | | | 6. . . . . ENDIF |
| | | | | 5. . . . . ENDIF |
| | | | ACRD05 | EQU * |
| | | | | 4. . . . ENDIF |
| | | | | 3. . . ENDIF |
| | | | | -- NONPERTINENT CODE |
| | | | | 2. . IF FLUSH |
| | | | | TPB PSB07,FLUSH |
| 4600 | A647 | 0047 | | |

TABLE XV-continued

ACRDEC

| LOC | OBJ | OP1 | OP2 | SOURCE STATEMENT |
|---|---|---|---|---|
| 4602 | 91 | 0001 | | |
| 4603 | 3D31 | 4631 | | BZ ACRL01 |
| | | | | 2. . THEN |
| | | | | 3. . . IF STOP\|¬COPIES_IN_DUPLEX_SW |
| | | | | TPB PSB23,STOP2 |
| 4605 | A657 | 0057 | | |
| 4607 | 91 | 0001 | | |
| 4608 | 6E | 460E | | JNZ ACRL05 |
| | | | | RIN CSB06 |
| 4609 | A6C5 | 00C5 | | |
| 460B | 92 | 0002 | | TP CPYINDP |
| 460C | 3C2F | 462F | | BNZ ACRL03 |
| | | | | 3. . . THEN |
| | | | ACRL05 | EQU * |
| | | | | 4. . . . RESET FLUSH, FLSHPLSTBY |
| | | | | TRB PSB07,FLUSH |
| 460E | A647 | 0047 | | |
| 4610 | B1 | 0001 | | |
| 4611 | A147 | 0047 | | |
| | | | | TRB PLSTNDBY,FLSHPLSB |
| 4613 | A653 | 0053 | | |
| 4615 | B2 | 0002 | | |
| 4616 | A153 | 0053 | | |
| | | | | 4. . . . SET ENABLED |
| | | | | TSB PSB42,ENABLED |
| 4618 | A66A | 006A | | |
| 461A | AF80 | 0007 | | |
| 461C | A16A | 006A | | |
| | | | | 4. . . . IF ¬(DUPLEX_LIGHT & STOP & COPIES_IN_DUPLEX_SW) |
| | | | | TPB PCB05,DPLXIND |
| 461E | A676 | 0076 | | |
| 4620 | 92 | 0002 | | |
| 4621 | 4A | 462A | | JZ ACRL06 |
| | | | | TPB PSB23,STOP2 |
| 4622 | A657 | 0057 | | |
| 4624 | 91 | 0001 | | |
| 4625 | 4A | 462A | | JZ ACRL06 |
| | | | | RIN CSB06 |
| 4626 | A6C5 | 00C5 | | |
| 4628 | 92 | 0002 | | TP CPYINDP |
| 4629 | 6F | 462F | | JNZ ACRL04 |
| | | | | 4. . . . THEN |
| | | | ACRL06 | EQU * |
| | | | | 5. . . . . RESET SIDE-2 |
| | | | | TRB PSB20,DPXSIDE2 |
| 462A | A654 | 0054 | | |
| 462C | B5 | 0005 | | |
| 462D | A154 | 0054 | | |
| | | | | 4. . . . ENDIF |
| | | | ACRL04 | EQU * |
| | | | | 3. . . ENDIF |
| 462F | 2C7F | 467F | ACRL03 | B ACRL02 |
| | | | | 2. . . ELSE |
| | | | ACRL01 | EQU * |
| | | | | 3. . . IF SIDE-2 |
| | | | | TPB PSB20,DPXSIDE2 |
| 4631 | A654 | 0054 | | |
| 4633 | 95 | 0005 | | |
| 4634 | 40 | 4640 | | JZ ACRL09 |
| | | | | 3. . . THEN |
| | | | | 4. . . . IF ¬COPIES_IN_DUPLEX_SW |
| | | | | RIN CSB06 |
| 4634 | A6C5 | 00C5 | | |
| 4637 | 92 | 0002 | | TP CPYINDP |
| 4638 | 6E | 463E | | JNZ ACRL08 |
| | | | | 4. . . . THEN |
| | | | | 5. . . . . RESET SIDE-2 |
| | | | | TRB PSB20,DPXSIDE2 |
| 4639 | A654 | 0054 | | |
| 463B | B5 | 0005 | | |
| 463C | A154 | 0054 | | |
| | | | | 4. . . . ENDIF |
| 463E | 2C7F | 467F | ACRL08 | B ACRL07 |
| | | | | 3. . . ELSE |
| | | | ACRL09 | EQU |
| | | | | 4. . . . IF ENDRUN |
| | | | | TPB PSB43,ENDRUN |
| 4640 | A66B | 006B | | |
| 4642 | 96 | 0006 | | |
| 4643 | 3D7F | 467F | | BZ ACRL11 |

TABLE XV-continued

ACRDEC

```
LOC   OBJ    OP1   OP2     SOURCE STATEMENT
                           4. . . THEN
                           5. . . . . IF SEPACTV
4645  A647   0047                LB      PSB07
4647  B3     0003                TR      SEPACTV
4648  3D72   4672                BZ      ACRL10
                           5. . . . . THEN
                           6. . . . . . RESET SEPACTV
464A  A147   0047                STB     PSB07
                           6. . . . . . SET ENABLED
                                TSB     PSB42,ENABLED
464C  A66A   006A
464E  AF80   0007
4650  A16A   006A
                           6. . . . . . RESET TRLSEP
                                TRB     PSB43,TRLSEP
4652  A66B   006B
4654  B7     0007
4655  A16B   006B
                           6. . . . . . IF TRLSEP WAS 1 &ACR1 WENT TO 0
4657  3D6E   A66E                BZ      ACRL11W
                                TPB     PSB43,ACRBILL2
4659  A66B   006B
465B  94     0004
465C  25                         CLA
465D  4E     466E                JZ      ACRL11W
465E  A40E   000E                AB      ACRREGLO
4660  6E     466E                JNZ     ACRL11W
                           6. . . . . . THEN
                           7. . . . . . . CPYSLCT = SEPSLCT
                                SRG     BASERG
4661  A9C9   00C9
4663  E9     0009                LR      SEPSLCT
                                SRG     INTHRG
4664  A9C8   00C8
4666  89     0009                STR     CPYSLCT
                           7. . . . . . . SEPSLCT, PRVSLCT = 0
4667  25                         CLA
                                SRG     BASERG
4668  A9C9   00C9
466A  89     0009                STR     SEPSLCT
                                SRG     COLRG
466B  A9D0   00D0
466D  8A     000A                STR     PRVSLCT
                           6. . . . . . ENDIF
                      ACRL11W   SRG     INTHRG
466E  A9C8   00C8
4670  2C7F   467F                B       ACRL11
                           5. . . . . ELSE
                      ACRL10    EQU     *
                           6. . . . . . IF COPIES_IN_DUPLEX_LIGHT
                                TPB     PCB13,CPYINDPI
4672  A67D   007D
4674  93     0003
4675  4F     467F                JZ      ACRL12
                           6. . . . . . THEN
                           7. . . . . . .SET SIDE-2
                                TSB     PSB20,DPXSIDE2
4676  A654   0054
4678  AF20   0005
467A  A154   0054
                           7. . . . . . . ACRLOST=0
467C  25                         CLA
467D  A15B   005B                STB     ACRLOST
                           6. . . . . . ENDIF
                      ACRL12    EQU     *
                           5. . . . . ENDIF
                           4. . . . ENDIF
                      ACRL11    EQU     *
                           3. . . ENDIF
                      ACRL07    EQU     *
                           2. . ENDIF
                           -- NONPERTINENT CODE --
                           2. . IF ACR1 WENT TO 0
46A5  25                         CLA
46A6  A40E   000E                AB      ACRREGLO
46A8  3CFE   46FE                BNZ     ACRL14
                           2. . THEN
                           3. . . TURN TRUCKS OFF
                                TRMB    PCB02,P(PRMTRCK,ALTTRUCK,DPLXTRCK)
46AA  A673   0073
```

TABLE XV-continued

ACRDEC

| LOC | OBJ | OP1 | OP2 | SOURCE STATEMENT |
|---|---|---|---|---|
| 46AC | ABE3 | 00E3 | | |
| 46AE | A173 | 0073 | | |
| 46B0 | A670 | 0070 | | |
| 46B2 | ABF8 | 00F8 | | |
| 46B4 | A170 | 0070 | | |
| | | | | -- NONPERTINENT CODE -- |
| | | | | 4. . . . IF SEPARIND & SEPWAIT & ACRREQ & DRIVE |
| | | | | TPB PCB06,SEPARIND |
| 46D6 | A677 | 0077 | | |
| 46D8 | 92 | 0002 | | |
| 46D9 | 3DEC | 46EC | | BZ ACRCD01 |
| 46DB | A641 | 0041 | | LB PSB01 |
| 46DD | AB22 | 0022 | | NI P1 (SEPWAIT,ACRREQ) |
| 46DF | 6C | 46EC | | JNZ ACRCD01 |
| | | | | TPB PSB21,DRIVE |
| 46E0 | A655 | 0055 | | |
| 46E2 | 90 | 0000 | | |
| 46E3 | 4C | 46EC | | JZ ACRCD01 |
| | | | | 4. . . . THEN |
| | | | | 5. . . . . SET STARTSE |
| | | | | TSB PSB07,STARTSE |
| 46E4 | A647 | 0047 | | |
| 46E6 | AF80 | 0007 | | |
| 46E8 | A147 | 0047 | | |
| 46EA | 2CFE | 46FE | | B ACRCD02 |
| | | | | 4. . . . ELSE |
| | | | | -- NONPERTINENT CODE -- |
| | | | | 5. . . . . ENDIF |
| | | 46FE | ACRCD02 | DC * |
| | | | | 4. . . . ENDIF |
| | | | ACRL 15 | EQU * |
| | | | | 3. . . ENDIF |
| | | | ACRL 14 | EQU * |
| | | | | 2. . ENDIF |
| | | | | 1. ENDIF |
| | | | | -- NONPERTINENT CODE -- |

Figure 28:
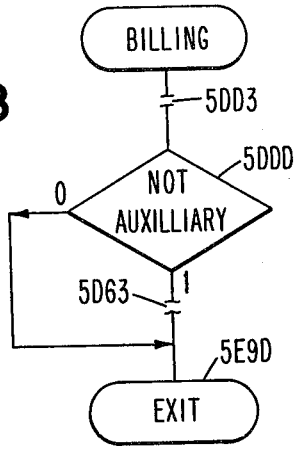
FIG. 28 is a flow chart showing inhibiting billing for separation and flush copy operations.
Figure 29:
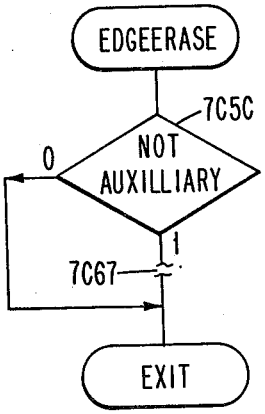
FIG. 29 is a flow chart showing inhibiting edge controls during an auxiliary operation.

Finally, in FIGS. 28 and 29 the billing and edge erase programs are shown as they relate to the separation mode. Only one instruction in each of the programs is pertinent; in FIG. 28 instruction 5DDD and in FIG. 29 instruction 7C5C are pertinent. Both are identical in that the computer branches on whether or not an auxiliary operation (separate, flush, etc.) is being performed. These two instructions are identical to the instruction 77EC of FIG. 24 as detailed in source code in Table XII.

In summary, the copy production machine 10 can either be hardware or software controlled for effecting the separation mode which effects a logical extension of the capability of collators in that plural sets of copies can be inserted into given collator bins with a separator sheet and with a minimal operator inconvenience. The automatic controls described above can take any of a plurality of forms including programmable logic arrays, read only memories, hard logic as indicated in the first part of the application, or a programmed computer as set forth in the preferred embodiment. The form of technology involved in implementing the present invention is not pertinent to the practice of the invention, the important features being the machine functions performed in implementing the separation mode.

Inhibiting billing for separation sheets is intended to include separately counting separation sheets. Then, the separate separation count can be used for a reduced billing rate (regular copy billing rate inhibited) or as a basis for relating copy billing. In the broad method aspects, the billing meter could, in fact, be actuated and the separate separation count used to adjust the total bill—this is still inhibiting billing.

Although the invention has been particularly shown and described with references to a preferred embodiment thereof, it will be understood by those skilled in the art that various changes in form and details may be made therein without departing from the spirit and scope of the invention.

What is claimed is:

1. A copy production machine having a copy producing portion, plural output portions for receiving produced copies from said copy production portion, and an image input section for supplying images to said copy producing portion for use in producing copies of said supplied images on copy sheets, one of said output portions having a given capacity for receiving said produced copies, means indicating an end of a copy producing run, means storing copy sheets, said copy producing portion having copy producing and standby modes, the improvement including in combination:

a control means having, a copy select register for indicating a first number of copies to be produced, said first number capable of indicating a number of copies greater than said given capacity, a copy count register for indicating the total number of copies of one image produced in a given copy production job; said copy production job being one or more copy producing runs of each image to be reproduced as said copies, separation initiating means indicating completion of a job segement, said job segment including one or more of said copy producing runs, separation sheet transporting means responsive to said separation initiating means to activate said copy production portion to transfer from said means for storing copy sheets as job segment separation sheets to said one output portion in accordance with a number of copies of each said image produced in a given one of said job segments, and accumulating means operative in response to said separation indicating means indicating a job segment for accumulating a count from all prior job segments and supplying same to said copy count register whereby said total number of copies indicated is for all job segments produced.

2. The copy production machine set forth in claim 1 further including means responsive to said separation sheet transporting means to inhibit said copy production portion from transferring an image to said transferred copy sheets during each said separation transfer.

3. The copy production machine set forth in claim 1 wherein a second of said output portions has a single copy receiving bin and means in said control means responsive to said one output portion being selected to force transfer of but one copy sheet during each of said separation transfers.

4. The copy production machine set forth in claim 1 wherein said one output portion has a plurality of copy bins and means in said control means to selectively transfer a number of separator sheets in each said separator transfer having a predetermined relation to said given number of copies such that one copy sheet is transferred to each of said copy receiving bins which receive predetermined ones of said copy sheets bearing images.

5. The copy production machine set forth in claim 1 having first and second of said means to store copy sheets and wherein copies are to be made by said copy production portion from one of said copy sheet means and means to select said copy sheets from said second of said copy sheet means during each said separation transfer and transfer such sheets through said copy producing portion.

6. The copy production machine set forth in claim 5 further including means for inhibiting said copy production portion from impressing images on said copy sheets during said separation transfer.

7. The copy production machine set forth in claim 1 wherein said separation initiating means includes manually actuable means for indicating an end of a job segment, memory means in said job initiating means for memorizing a manual actuation thereof, irrespective of the copy production mode in said machine, and means responding to said memory means and said end of run means to actuate said separation sheet transporting means.

8. The copy production machine set forth in claim 7 including means responsive to said separation sheet transporting means to reset said memory means.

9. The copy production machine set forth in claim 1 further including last copy detecting means, said last copy detecting means supplying a signal to said job initiating means to indicate a change from a copy producing mode to a standby mode in said copy producing portion and control means in said copy production machine to close down copy production and means in said control means for inhibiting said close down whereby said copy production machine transfers said copy sheets in said separation transfer without first stopping the machine.

10. The copy production machine set forth in claim 1 further including interruption means for interrupting transfer of said copy sheets during said separation sheet transfer and further including means for restarting said copy production machine during said separation sheet transfer.

11. The copy production machine set forth in claim 1 wherein said image input section has an original document imaging location, includes an original document feed for transporting original documents to and from said imaging location, sensing means indicating an original document is ready to be transported to said imaging location and means responsive to said sensing means indication inhibiting said separation sheet transporting means whereby separation is delayed until after copy production based upon an image in said original document at said sensing means.

12. The copy production machine set forth in claim 11 wherein said inhibiting means is operative to delay said separation by but one copy production run irrespective of a succession of original documents placed at said sensing means.

13. The copy production machine set forth in claim 1 wherein said image input section includes a document feed and an imaging location, said document feed capable of transporting original documents to be copied to and from said imaging location, an input tray for receiving an original document to be copied and being positioned at said document feed for enabling a positioned original document to be transported by said document feed to said imaging location, an entry sensor adjacent to said tray for sensing and indicating an original document ready to be transported to said imaging location, and control means responsive to said entry sensor indication to delay operation of said separation sheet transporting means.

14. The copy production machine set forth in claim 1 further including a plurality of sheet supply means, each capable of supplying sheets for copy production, means in predetermined ones of said copy sheet supply means indicating size of copy paper sheets in respective ones of said copy paper supply means;

means comparing said copy paper size indicators and supplying a control signal in accordance with said comparison;

means selecting a first one of said copy paper supply means as a source of copy paper to produce copies therewith;

inhibit means responsive to said comparing means supplied control signal to inhibit said control means when said copy paper size comparison indicates predetermined differences in copy paper sizes in said copy paper supplies but permits selection of a separator sheet for differences in size other than said predetermined differences.

15. The copy production machine set forth in claim 1 further including means enabling copy production requiring a plurality of image transfer passes to complete copying for one copy sheet, interim storage means for storing partially completed multi-pass copies, interim indicating means indicating copy sheets in said interim storage means, control means responsive to said interim indicating means indicating copy sheets to inhibit actuation of said separation transporting means, and having means for transferring copy sheets from said interim storage means to said output portion whereby when said interim storage means is empty said inhibition is removed.

16. A copy production machine having a copy production portion, having supply means to store copy sheets and a copy sheet path having an image transfer section, an output portion and an image input supplying images to said copy production portion for making copies thereof, an interim storage unit for storing single-imaged duplex copies, means for indicating number of copies to be produced of each image, the improvement including in combination:

interim means indicating copies in said interim storage unit, separation means indicating end of a copy job segment, control means responsive to said interim means and said separation means to transfer said copies in said interim storage unit to said output portion and having further means to actuate said copy production portion to automatically supply copy sheets as job separator sheets to said output portion, and means in said control means and operative after said separator sheets have been transported to enable further copy production.

17. The copy production machine set forth in claim 16 wherein said control means includes means indicating copy production which inhibits said transfer from said interim storage unit until said copy production stops.

18. The copy production machine set forth in claim 17 wherein said interim storage unit supplies copy sheets to said copy sheet path and said job separator sheets pass through said copy path including said image transfer section and means in said control means to inhibit image transfer during said transfer of copy sheets from said interim storage means and said transport of said job separator sheets.

19. The copy production machine set forth in claim 18 further including billing means, and means in said control means inhibiting said billing means during said transfer and said transport of said job separator sheets.

20. The copy production machine set forth in claim 19 wherein said output portion includes a copy exit tray and a collator, mode means indicating collate and non-collate copy products, means in said copy production portion responsive to said non-collate indication to select said exit tray to receive produced copies and said separator sheets and responsive to said collate indication to select said collator to receive produced copies and said separator sheets, and means in said control means responsive to said non-collate indication to limit said job separator sheets to one copy sheet and responsive to said collate indication to supply more than one copy sheet as a plurality of separator sheets in a predetermined accordance with said indication of copies to be produced.

21. The copy production machine set forth in claim 19 further including means in said control means inhibiting said image input from supplying images during said transfer and said transport of job separator sheets.

22. A separation sheet selector control for a copy production machine, including in combination:

means indicating that a copy production run state is changing between active and inactive states, separation mode selection means actuatable to indicate a separation sheet is to be transported at said change in copy production state change between active and inactive states, separation mode operating means responsive to said change in state and said indication change in states to actuate said copy production machine to a separation mode wherein separation sheets are transported within said machine as an indication of job segment separation, means inhibiting copy production during said separation mode, and inhibit means responsive to said separation mode operating means to inhibit sensing of actuation of said separation mode selection means during a predetermined portion of said separation mode while enabling such actuation at all other times during said active and inactive states.

23. The subject matter of claim 22 wherein said copy production machine has a plurality of copy sheet supplies capable of storing diverse sized copy sheets, means for indicating size of copy sheets in respective ones of said copy sheet supplies, size control means inhibiting operation of said separate mode operating means when said size indications show predetermined diverse sizes while permitting operation of said separation mode operating means when said diversity size indication is other than said predetermined showing.

24. The subject matter of claim 22 further including:

means storing partially produced copies;

means indicating copy sheets stored in said storing means, and means responsive to said copy sheet stored indication to inhibit said separation mode operating means.

25. A copy production machine having a copy production portion, an output portion and an image input supplying images to said copy production portion for making copies thereof, an interim storage unit for storing singleimaged duplex copies, the improvement including in combination:

interim means indicating copies in said interim storage unit, separation means indicating that a predetermined number of separator sheets are to be transported to said output portion, control means responsive to said interim means and said separation means to transfer said copies in said interim storage unit without further copy producing action to said output portion and having further means operative upon said control means emptying said interim storage unit to automatically supply a predetermined number of separator sheets to said output portion, and means operative after said further means having transported said separator sheets to enable further copy production.

26. The machine set forth in claim 25 further including a billing meter for costing copy production, and means inhibiting operation of said billing meter during said transfer and automatic supply.

27. The machine set forth in claim 25 further including means for cumulatively counting copies made in subsequent copy production runs whereby copies produced before and after said separator sheet automatic supply appear as a single copy production job.

28. The machine set forth in claim 25 wherein one separator sheet is forwarded irrespective of the number of copies initially in said interim means.

29. The machine set forth in claim 25 wherein said machine has a primary and an alternate paper supply and said separator sheets are selected from said alternate supply irrespective of a source of copy sheets in said interim means.

30. The copy production machine set forth in claim 25 further including an original document feed, means indicating an original document to be copied, means in said control means responsive to said original document to be copied indication to inhibit said transfer and to actuate side-2 copy production based upon said indicated original putting images on copies in said interim means; and said control means being further responsive to said separation means to automatically supply said separator sheets after said side-2 copy production.

31. A copy production machine having a copy production portion, a control for said portion to operate same in a series of independent copy production runs, the improvement including in combination, an operator's control panel having a manually actuatable switch for indicating predetermined ones of said series of independent copy runs as having a predetermined copy job relationship, means in said control for automatically adjusting its operation to reflect said predetermined copy job relationship, and separation means in said control for actuating said copy production portion to transport at least one separator sheet for identifying said predetermined job relationship in said produced copies each time said switch is actuated.

32. The copy production machine set forth in claim 31 wherein said automatic adjusting means includes cumulatively indicating copies produced before and after said separation means actuated said copy production portion.

33. The copy production machine set forth in claim 31 further including billing means for costing copy production and means inhibiting said billing means when said separation means actuates said copy production portion.

34. The copy production machine set forth in claim 31 and having an original document feed, means indicating an original document is to be fed to a copying position in said machine, and means in said control means responsive to said document feed indication for altering said predetermined job relationship by making copies of said indicated original document before allowing actuation of said copy production portion by said separation means.

35. The copy production machine set forth in claim 34 wherein means limit said job relationship alteration to but one original document for each of said separation means actuation in a given trailing separation operation.

36. A copy production machine having an original document transport with an entry sensor indicating that an original document is in a position for transport to an imaging location, a copy production portion for making copies in a copy run of an original document at said imaging location, an output portion for receiving produced copies, storage means for storing separator sheet material, means for storing a supply of substrate material for making copies, the improvement including in combination:

separation control means indicating that a separator sheet is to be transported to said output portion, compare means operatively associated with said copy production portion to indicate end of a copy run, transport means operatively connected to said copy production portion and being responsive to said separation control means indication and to said end of copy run indication to transport a separator sheet to said output portion, and means responsive to said entry sensor indication to inhibit said transport means for transporting said separator sheet.

37. The copy production machine set forth in claim 36 wherein said responsive means is operative to inhibit said transport means for copy production of but one original document.

38. A copy production machine having a copy production portion, means indicating a given number of copies are to be produced of a given image in each copy run, an original-present responsive document feed having an entry section, the improvement including in combination:

means indicating a separation request, means indicating end of a copy run, means indicating an original at said entry section, means responsive to said separation request indication and end of copy run indication to insert a separation sheet next to each copy made in an immediately preceeding copy run, and inhibition means delaying said responsive means when said original indicating means indicates an original at said entry section for permitting production of copies bearing images of said original document before said separator sheets are transported.

39. In a copy production machine having a copy production portion for producing copies, means for indicating that copies are being produced, the improvement comprising:

original document feed means having indicator means for indicating that an original document is to be copied, separation means indicating that a separator sheet is to be transported to separate copies produced by said portion, means for transporting separator sheets, and control means responsive to said original document feed indicator and to said copies being produced indicator means for delaying said separator sheet transport means until after copy production of images based upon said indicated original document is completed.

40. The method of operating a copy production machine for making sets of duplex copies;

the steps of:

(1) selecting a predetermined number of copies to be made;

(2) storing in said machine all single-side imaged duplex copies and fetching such single-side imaged duplex copies for receiving a second image for making double-sided copies, (3) transporting all double-side imaged copies to an output portion;

(4) indicating when such single-imaged duplex copies are being stored in said machine;

(5) sensing for an indication of an original to be copied residing at a predetermined position in said machine;

(6) indicating end of a copy job segment;

(7) in response to said copy job segment indication in the absence of said original indication transporting said stored single-sided copies to said output portion;

(8) in response to said original to be copied indication and said segment indication fetching said stored single-side imaged copies for receiving an image of said sensed original to be copied; and (9) after steps (8) or (9) transporting a separator sheet to an output portion of said machine.

41. The method of claim 40 further including after completing said response steps of transporting a separator sheet to said output portion,

(10) reenabling copy production based upon a first side image of a duplex copy to be produced.

42. The method set forth in claim 41 further including the steps of:

(11) selecting end of job segment indication while the machine is producing copies,

(12) memorizing in said machine the end of job segment indication,

(13) indicating an end of a given copy production run for step (6) and then

(14) performing steps (7) and (8).

43. The method set forth in claim 40 further including the step (10) suppressing image transfers in said machine during steps (7) and (9).

44. The method set forth in claim 43 further including the step (11) of suppressing original document scanning during steps (7) and (9).

45. The method set forth in claim 44 further including the step (12) of exiting an original document from an original document feed of said machine prior to completing steps (7) or (9).

46. The method set forth in claim 40 further including the steps of

(10) in each copy production run preceeding performance of steps (6)–(9) inclusive, counting copies produced up to a given number less than said predetermined number selected in step (1); and

(11) after performing said steps (6)–(9) inclusive, counting copies produced in each copy producing run of said machine beginning with said given number plus one.

47. The method set forth in claim 46 further including the steps:

(12) limiting the maximum count in step (11) to an integer times said given number of said predetermined number selected in step (1), whichever is less, and

(13) for each time step (12) said predetermined number selected in step (1) is not reached, repeating steps (2)–(12) and making said integer equal to the number of repetitions.

48. The method of operating a copy production machine;

the steps of:

sensing and indicating when a copy sheet has been supplied to a copy producing portion of said copy production machine;

sensing and indicating when a copy sheet is egressing from said copy production portion, indicating a machine cycle of the type normally an image transfer can occur, indicating an image transfer during predetermined ones of said cycles;

incrementing a billing meter in response to but one of said indications;

repeatedly indicating that a supplied copy sheet is to be used as a separator sheet;

inhibiting said incrementing once for each of said separator sheet indications; and operating said machine in a predetermined manner in accordance with all of said indications.

49. The method of operating a copy production machine operating in a succession of independent copy production runs, the steps of:

(1) selecting a given number of copies to be produced of each of one or more images, (2) limiting copy production of each successive image being produced in each copy production run to a limited number greater than one and less than said given number, (3) indicating copy production of images produced to said limited number, (4) supplying separator sheets to identify job segments, and (5) producing a number of copies of the same images up to a total of said given number or said limited number, whichever is less, but indicating total copies produced of each image.

50. The method set forth in claim 49 wherein in step (4) supplying only one separator sheet irrespective of the number of copies produced.

51. The method set forth in claim 49 including the steps of (6) manually selecting an indication of a job segment while copies are being actively produced as indicated in step (3) in one of said copy production runs, (7) memorizing in said machine said manual selection, and (8) at the end of said one copy production run performing step (4).

52. The method set forth in claim 51 further including the steps of (9) before the end of said one copy production run and while memorizing said manual selection in step (6), indicate one more image is to be produced before the end of a job segment,

(10) producing copies of said one more image as in steps (2) and (3) and then performing step (4).

53. The method set forth in claim 51 for producing sets of duplex copies, the steps of:

(6) in copy production as in steps (2) and (3), producing duplex copies in two immediately successive copy production runs, (6A) in a first of said successive copy production runs producing a one-side partially-completed duplex copy as in steps (2) and (3);

(6B) storing said partially completed copies in said machine, (6C) in a second of said successive copy production runs producing a second image on copies stored in the machine in step (6B), and (6D) supplying the step (6C) produced copies as completed copies, (7) indicating end of a copy job segment while partially completed copies are stored in said machine, (8) upon completing steps (6A, 6B) inhibiting steps (6C, 6D) and transport said partially-completed copies as completed copies and then perform step (4).

54. The method set forth in claim 49 including the steps of:

(6) intermediate said succession of copy production runs indicating said given number, and (7) during any of said succession of independent copy production runs replacing the indication of (6) with the cumulative number of step (5).

55. The method of operating a copy production machine having a copy production portion operable in a succession of copy producing runs and an output portion having a given capacity for receiving produced copies, means for storing copy sheets, the steps of:

(1) indicating in said machine a copy producing job for producing a number of copies greater than said given capacity, (2) producing copies for said job up to said given capacity, (3) indicating that succeeding copy producing runs are part of a copy producing job including immediately preceeding copy producing runs that produced said copies until said given capacity, (4) for each of said indications of (3), automatically inhibiting copy production while simultaneously transferring some of said copy sheets as separator sheets from said storing means to said output portion for separating copy sets of not more than said given capacity, (5) resuming copy production up to said given capacity, and repeating steps (1) through (5) until the copy producing job is completed.

56. The method set forth in claim 55 including indicating the total number of copies produced in each of said succession of copy producing runs only when steps (3) and (4) are performed and succeeding ones of said copy producing runs are initiated within predetermined times.

57. A copy production machine having a copy production portion for producing copies of images to be reproduced, a supply of copy sheets in said copy production portion, start means and stop means respectively for starting and stopping copy production in one or more copy production runs, the improvement including in combination:

a separation control for selectively indicating that a copy sheet is to be selected from said copy sheet supply as a separation sheet, a first separation mode means responsive to said start means and to said indication being active to supply a separation sheet at the beginning of a copy production run, a second separation mode means responsive to said stop means and said indication being active to supply a separation sheet at the end of a copy production run, and means operative when said separation sheet has been supplied by one of said separation mode means to reset said indication to an inactive condition whereby copies made during a succession of copy production runs are selectively bracketed by said separation sheets.

58. The machine set forth in claim 57 wherein said start means includes a first plurality of start means portions, said first plurality of image input handling means, and one of said portions operative to actuate said copy production machine to operate with a respective one of said image input handling means.

59. The method of operating a copy production machine having a copy production portion and having a plurality of output portions for receiving produced copies, each said output portion having one or more copy receiving bins, means directing produced copies to a given one of said output portions, said copy production portion having control means imposing a standby or producing mode therein, plural copy paper supply means in said copy production portion for supplying sheets of copy paper;

the improvement including the steps of:

signifying that a given number of copies are to be produced having a given image;

indicating a job separation request;

indicating a change in modes between said standby and producing modes; and just after indicating said change in mode, transferring a number of copy sheets from said copy production portion to said given one output portion related to said number of copy bins in said given one output portion and to said given number of copies for separating produced copies.

60. The method set forth in claim 59 further including the steps of:

indicating that a last copy was produced, right after indicating the last copy indicating a change in modes from a producing to a standby mode and delaying shutting down the machine until said copy sheets in said separation transfer are transferred without first stopping the machine.

61. The method set forth in claim 60 further including resuming copy production after transferring said separation sheets without slowing down nor substantially delaying machine operation.

62. The method of operating a copy production machine set forth in claim 59 further including the steps of interrupting transfer of said copy sheets during said separation transfer and automatically restarting said copy production machine to compiete said separation transfer.

63. A copy production machine having a copy production portion, means signifying that a given number of copies are to be produced having a given image, one output portion for receiving produced copies, means directing produced copies to said one output portion, said copy producing portion having control means imposing a standby or producing mode therein, plural copy paper supply means in said copy producing portion for individually and selectively supplying sheets of copy paper;

the improvement including in combination;

means indicating a job separation;

means indicating a change in modes between said standby and producing modes;

control means jointly responsive to said indicating means to actuate said copy production portion into a separation mode to transfer a number of copy separation sheets to said output portion intermediate successive ones of copy producing runs for achieving a separation, and means inhibiting copy production by inhibiting image transfer during said separation mode.

64. The copy production machine set forth in claim 63 further including in combination:

means in said control means responsive to a change from said producing mode to said standby mode to actuate said copy production portion to supply one of said copy separation sheets, means in said control means responsive to a change from said standby mode to said producing mode to actuate said copy production portion to supply one of said separation sheets, and reset means responsive to said control means at each said separation transfer to reset said job separation indication upon each said separation transfer.

65. The copy production machine set forth in claim 64 further including manually actuatable means to set said job separation indication active in either said standby or said producing modes.

66. The copy production machine set forth in claim 63 further having a collator output portion, means selecting either said collator output portion or said one output portion to receive copies, means in said control means responsive to said collator output portion being selected to actuate said copy production portion to supply said given number of separation sheets to said collator output portion upon each change between said standby and said producing modes whenever said job separation indication is active, and means in said control means responsive to said one output portion being selected to actuate said copy production portion to supply a single copy separation sheet to said one output portion upon each change between said standby and producing modes whenever said job separation indication is active.

* * * * *

UNITED STATES PATENT AND TRADEMARK OFFICE

CERTIFICATE OF CORRECTION

PATENT NO. : 4,201,464

DATED : May 6, 1980

INVENTOR(S) : A. J. Botte et al.

It is certified that error appears in the above-identified patent and that said Letters Patent are hereby corrected as shown below:

Claim 15, column 83, line 5, after "separation", insert --sheet--.
Claim 20, column 83, line 55, "products" should read --productions--.
Claim 47, column 87, line 59, "of" should read --or--.
Claim 53, column 88, line 56, "51" should read --49--.

Signed and Sealed this

*Fourteenth* Day of *October 1980*

[SEAL]

*Attest:*

SIDNEY A. DIAMOND

*Attesting Officer*

*Commissioner of Patents and Trademarks*